US007273686B2

(12) United States Patent
Onuma et al.

(10) Patent No.: US 7,273,686 B2
(45) Date of Patent: Sep. 25, 2007

(54) TONER

(75) Inventors: Tsutomu Onuma, Kanagawa (JP); Nobuyuki Okubo, Shizuoka (JP); Hideto Iida, Chiba (JP); Takashige Kasuya, Shizuoka (JP); Koji Nishikawa, Shizuoka (JP); Shuhei Moribe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 409 days.

(21) Appl. No.: 10/901,176

(22) Filed: Jul. 29, 2004

(65) Prior Publication Data

US 2005/0026065 A1 Feb. 3, 2005

(30) Foreign Application Priority Data

| | | |
|---|---|---|
| Aug. 1, 2003 | (JP) | 2003-205271 |
| Aug. 1, 2003 | (JP) | 2003-205272 |
| Aug. 1, 2003 | (JP) | 2003-205313 |
| Aug. 1, 2003 | (JP) | 2003-205314 |
| May 21, 2004 | (JP) | 2004-151772 |

(51) Int. Cl.
*G03G 9/08* (2006.01)

(52) U.S. Cl. ..... 430/110.3; 430/106.1; 430/108.1; 430/137.18

(58) Field of Classification Search ..... 430/110.3, 430/106.1, 108.1, 137.18
See application file for complete search history.

(56) References Cited

U.S. PATENT DOCUMENTS

| | | | | |
|---|---|---|---|---|
| 4,917,982 | A | 4/1990 | Tomono et al. | 430/99 |
| 4,921,771 | A | 5/1990 | Tomono et al. | 430/110 |
| 4,988,598 | A | 1/1991 | Tomono et al. | 430/99 |
| 4,997,739 | A | 3/1991 | Tomono et al. | 430/110 |
| 5,004,666 | A | 4/1991 | Tomono et al. | 430/110 |
| 5,023,158 | A | 6/1991 | Tomono et al. | 430/99 |
| 5,219,696 | A | 6/1993 | Demizu et al. | 430/110 |
| 5,225,303 | A | 7/1993 | Tomita et al. | 430/106.6 |

(Continued)

FOREIGN PATENT DOCUMENTS

| | | |
|---|---|---|
| DE | 3809662 | 10/1988 |

(Continued)

OTHER PUBLICATIONS

Patent Abstracts of Japan, vol. 2002, No. 6, Jun. 2002 for JP2002-040711.

(Continued)

*Primary Examiner*—Mark A. Chapman
(74) *Attorney, Agent, or Firm*—Fitzpatrick, Cella, Harper & Scinto

(57) ABSTRACT

In a toner comprising toner particles which comprise toner base particles containing at least a binder resin and a magnetic material, and inorganic fine particles, the toner base particles have been obtained through a pulverization step; and, the toner base particles having a circle-equivalent diameter of from 3 μm or more to 400 μm or less as measured with a flow type particle image analyzer have an average circularity of from 0.935 or more to less than 0.970; and the toner base particles have an average surface roughness of from 5.0 nm or more to less than 35.0 nm as measured with a scanning probe microscope. The toner can enjoy less toner consumption per sheet of images, can achieve a long lifetime in a smaller quantity of toner, and has superior developing performance in any environment.

5 Claims, 4 Drawing Sheets

U.S. PATENT DOCUMENTS

| | | | | |
|---|---|---|---|---|
| 5,240,803 | A | 8/1993 | Ota | 430/106 |
| 5,563,693 | A | 10/1996 | Takahata et al. | 355/274 |
| 5,629,118 | A | 5/1997 | Tomono et al. | 430/99 |
| 5,629,123 | A | 5/1997 | Tomono et al. | 430/110 |
| 5,700,616 | A | 12/1997 | Kasuya et al. | 430/110 |
| 5,729,811 | A | 3/1998 | Takahata et al. | 399/316 |
| 5,912,101 | A | 6/1999 | Karaki et al. | 430/110 |
| 6,007,957 | A | 12/1999 | Kobori et al. | 430/106.6 |
| 6,022,661 | A | 2/2000 | Kurose et al. | 430/110 |
| 6,033,817 | A | 3/2000 | Yusa et al. | 430/106.6 |
| 6,589,701 | B2 | 7/2003 | Yamazaki et al. | 430/106.2 |
| 6,630,275 | B2 | 10/2003 | Hiratsuka et al. | 430/106.1 |
| 2003/0036008 | A1 | 2/2003 | Yamazaki et al. | 430/45 |
| 2003/0039908 | A1 | 2/2003 | Hiratsuka et al. | 430/106.1 |
| 2005/0191575 | A1* | 9/2005 | Sugiura et al. | 430/110.3 |

FOREIGN PATENT DOCUMENTS

| | | |
|---|---|---|
| EP | 0488789 | 6/1992 |
| JP | 52-3305 | 1/1977 |
| JP | 58-215659 | 12/1983 |
| JP | 62-100775 | 5/1987 |
| JP | 02-87157 | 3/1990 |
| JP | 03-84558 | 4/1991 |
| JP | 03-229268 | 10/1991 |
| JP | 04-1766 | 1/1992 |
| JP | 04-102862 | 4/1992 |
| JP | 04-124676 | 4/1992 |
| JP | 04-204751 | 7/1992 |
| JP | 04-299357 | 10/1992 |
| JP | 04-362953 | 12/1992 |
| JP | 05-197162 | 8/1993 |
| JP | 5-346682 | 12/1993 |
| JP | 06-313980 | 11/1994 |
| JP | 06-332235 | 12/1994 |
| JP | 07-92724 | 4/1995 |
| JP | 07-104501 | 4/1995 |
| JP | 08-36316 | 2/1996 |
| JP | 10-97095 | 4/1998 |
| JP | 11-149176 | 6/1999 |
| JP | 11-202557 | 7/1999 |
| JP | 2000-56595 | 2/2000 |
| JP | 2002-23414 | 1/2002 |

OTHER PUBLICATIONS

Patent Abstracts of Japan, vol. 0031, No. 41 (E-153), Nov. 1979 for JP 54-119245.

Patent Abstracts of Japan, vol. 1997, No. 02, Feb. 1997 for JP 08-272136.

Database WPI, Section PQ, Week 200282, Derwent Publn. AN 2002-754865; XP002308038 (2002).

* cited by examiner

TONER

BACKGROUND OF THE INVENTION

1. Field of the Invention

This invention relates to a toner used in image forming processes for making electrostatic latent images into visible images, such as electrophotography, and a toner used in toner jet recording.

2. Related Background Art

In recent years, machinery making use of electrophotography has begun to be used in printers for computer data output, facsimile machines and so forth in addition to copying machines for copying original images. Accordingly, machines are severely sought to be more compact, more light-weight, more high-speed and more high-reliability, and have come to be constituted of simple components in various aspects. As the result, the performance demanded of toners has come so higher that any superior machines are not set up unless improvements in performance of the toners can be achieved.

In particular, in respect of energy saving and office space saving, machines such as printers are required to be made more compact. On that occasion, containers which hold toners therein are also necessarily required to be made compact, and a low-consumption toner is required that enables many-sheet printing in a small quantity, i.e., that can manage the printing of the same images in a smaller quantity of toner.

Techniques are disclosed in which the particle shape of toner is made close to spherical shape by production processes such as spray granulation, solution dissolution, and polymerization (e.g., Japanese Patent Applications Laid-open No. H3-84558, No. H3-229268, No. H4-1766 and No. H4-102862). These techniques, however, all require large-scale equipment for the production of toners. This not only is undesirable in view of production efficiency, but also has not achieved any sufficient reduction of toner consumption.

Techniques are also disclosed in which toners produced by pulverization are made to undergo thermal or mechanical impact to modify the shape and surface properties of particles (e.g., Japanese Patent Applications Laid-open No. H2-87157, No. H10-97095, No. H11-149176 and No. H11-202557). However, modifying the particle shape of toner by these methods can not be said to be sufficient for the reduction of toner consumption, and also has brought about difficulties such as a lowering of developing performance in some cases.

It is commonly known to add small-particle-diameter inorganic fine particles to toner base particles for the purpose of controlling chargeability, fluidity and so forth of toners to achieve good developing performance.

In toners to which such small-particle-diameter inorganic fine particles are added, it has been ascertained that the small-particle-diameter inorganic fine particles come to stand buried in surface portions of toner base particles because of, e.g., a stress applied between a toner and a carrier when the toner is used as a two-component developer, a stress applied from a developing blade and a developing sleeve when the toner is used as a one-component developer, an impact against inner walls of a developing assembly and against a toner agitation blade, and a mutual impact between toner particles.

In order to make the small-particle-diameter inorganic fine particles less buried, it is effective to use large-particle-diameter inorganic fine particles in combination, as disclosed in Japanese Patent Applications Laid-open No. H4-204751, No. H5-346682, No. H6-313980, No. H6-332235 and No. H7-92724.

The large-particle-diameter inorganic fine particles have an effect as a spacer, and hence they prevent toner base particle surfaces to which the small-particle-diameter inorganic fine particles have adhered, from coming into direct contact with the carrier, developing blade, developing sleeve, developing assembly inner walls, toner agitation member and other toner to lessen the stresses. This makes the small-particle-diameter inorganic fine particles kept from being buried in the surface portions of toner base particles, and brings achievement of longer lifetime of toners.

Japanese Patent Application Laid-open No. H4-204751 discloses a toner containing hydrophobic fine silica particles and hydrophobic fine titanium oxide particles or hydrophobic fine aluminum oxide particles, which is a toner characterized in that the hydrophobic fine titanium oxide particles or the hydrophobic fine aluminum oxide particles have peaks at 10 to 20 nm and 30 to 60 nm in primary particle diameter.

Japanese Patent Application Laid-open No. H5-346682 discloses a toner characterized in that an inorganic fine powder having a BET specific surface area of less than 80 $m^2/g$ and treated with a silicone oil and an inorganic fine powder having a BET specific surface area of 80 $m^2/g$ or more and treated with a silane coupling agent are blended.

Japanese Patent Application Laid-open No. H6-332235 discloses a toner for electrophotography which comprises toner base particles and at least two types of external additives, and is a toner for electrophotography which is characterized in that particles of 5 μm or smaller are present in a proportion of 1 to 8% by volume in particle size distribution of toner base particles, that a first external additive has an average particle diameter of 0.1 to 0.5 μm in number base of primary particles, and that a second external additive has an average particle diameter of 20 nm or less in number base of primary particles and is hydrophobic.

Japanese Patent Application Laid-open No. H7-104501 discloses a proposal of a toner making use of hydrophobic fine silica particles of 15 to 20 nm in particle diameter and hydrophobic fine silica particles or alumina fine particles of 13 nm or less in particle diameter.

However, because of the addition of two types of hydrophobic fine particles different in particle diameter, these toners have had problems in respect of mixability of the both and dispersion on the surfaces of toner base particles, and had insufficient development durability and charging stability.

Japanese Patent Application Laid-open-No. H6-313980 discloses a developer characterized in that inorganic fine particles have, in their number primary particle diameter distribution curve, i) a maximum value of number proportion at each of a primary particle diameter x (nm) (where $20 \leqq x \leqq 50$) and a primary particle diameter y (nm) (where $3x \leqq y \leqq 6x$) and ii) 10% by number or less of number proportion in the primary particle diameter (x+y)/2 (nm), have a value of X/Y within the range of from 0.5 to 2.0 where the number proportion of inorganic fine particles on the side of small particle diameter which have a primary particle diameter of less than (x+y)/2 (nm) is represented by X % by number and the number proportion of inorganic fine particles on the side of large particle diameter which have a primary particle diameter of (x+y)/2 (nm) or more by Y % by number, and have a value of z/x of from 150 to 400 where the volume-average particle diameter of toner base particles is represented by z (nm).

However, in this inorganic fine particles, the peak of the primary particle diameter on the side of small particle diameter in the number primary particle size distribution is as relatively large as 20 nm or more, and moreover a peak is also present on the side of large particle diameter. Hence, when calculated on the basis of weight, it follows that the large-particle-diameter inorganic fine particles are present in a very large number with respect to the small-particle-diameter inorganic fine particles, bringing about problems on fluidity and chargeability.

Japanese Patent Applications Laid-open No. H8-36316, No. 2000-56595 and No. 2002-23414 disclose, in a contact transfer assembly in which a bias is applied to a transfer member by a means for applying the bias and a toner held on a latent image bearing member, prepared by externally adding to and mixing in toner base particles at least two types of external additives different in average particle diameter, is transferred to a transfer medium, a transfer assembly which has defined the relationship between the loose apparent density of the toner and the hardness of the transfer member. However, the respective two types of external additives different in average particle diameter, used here, have separately been hydrophobic-treated, and hence the both differ in their agglomerative properties and readiness of dispersion on toner base particle surfaces, and it has been difficult to disperse the both uniformly on the surfaces of toner base particles.

A method is also employed in which toner base particles are incorporated with a wax for the purpose of improving releasability of the toner. Toners the base particles of which are incorporated with two or more types of waxes in order to bring out the effect of addition of the wax over the range of from a low-temperature region to a high-temperature region are disclosed in, e.g., Japanese Patent Publication No. S52-3305 and Japanese Patent Applications Laid-open No. S58-215659, No. S62-100775, No. H4-124676, No. H4-299357, No. H4-362953 and No. H5-197162. However, even when the toner base particles are incorporated with such waxes, not only no sufficient fixing performance and releasability may be obtained, but also faulty images due to faulty cleaning have occurred in some cases.

SUMMARY OF THE INVENTION

An object of the present invention is to solve the problems the related background art has had.

Another object of the present invention is to provide a toner which can enjoy less toner consumption per sheet of images, and can achieve a long lifetime in a smaller quantity of toner.

Still another object of the present invention is to provide a toner which has superior developing performance in any environment.

A further object of the present invention is to provide a toner which may cause neither sleeve ghost nor spots around line images.

Still further object of the present invention is to provide a toner which may cause no blotches.

The present invention provides a toner comprising toner particles which comprise toner base particles containing at least a binder resin and a magnetic material, and inorganic fine particles, wherein;

the toner base particles are those obtained by melt-kneading a composition containing at least the binder resin and the magnetic material, and pulverizing the resultant kneaded product; and the toner base particles having a circle-equivalent diameter of from 3 μm or more to 400 μm or less as measured with a flow type particle image analyzer have an average circularity of from 0.935 or more to less than 0.970; and the toner base particles have an average surface roughness of from 5.0 nm or more to less than 35.0 nm as measured with a scanning probe microscope.

DESCRIPTION OF THE PREFERRED EMBODIMENTS

Figure 1:
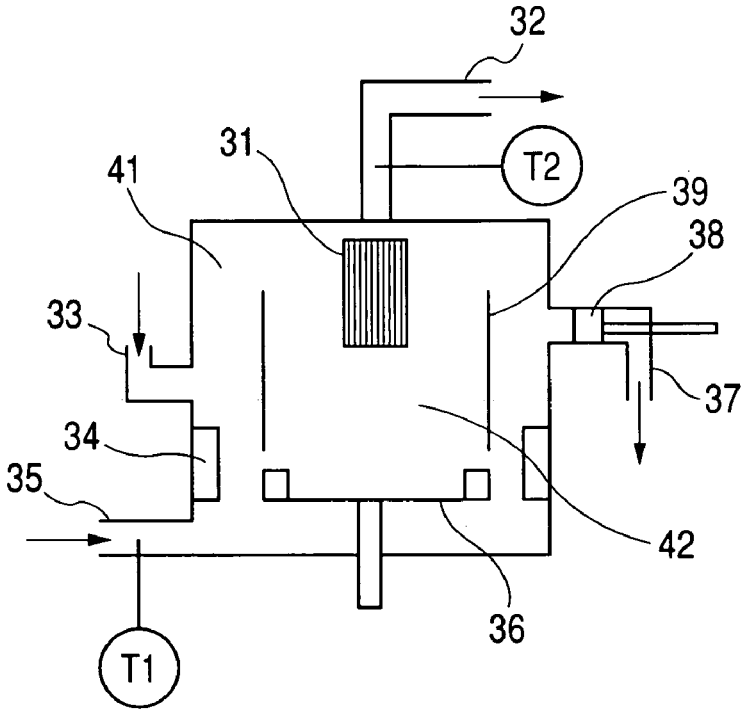
FIG. 1 is a schematic sectional view of an example of a surface modifying apparatus used in the step of surface modification in the present invention.

As a result of extensive studies, the present inventors have discovered that development characteristics of the toner can be controlled by controlling the average circularity of toner base particles and also controlling the surface roughness of toner base particles.

In the toner base particles of the present invention, toner base particles having a circle-equivalent diameter of from 3 μm or more to 400 μm or less have an average circularity of from 0.935 or more to less than 0.970, preferably from 0.935 or more to less than 0.965, more preferably from 0.935 or more to less than 0.960, and still more preferably from 0.940 or more to less than 0.955. In virtue of this feature, the toner consumption per image area can be reduced. As the toner base particles have higher circularity, the toner has higher fluidity and hence individual toner base particles come more easily freely movable. The toner contributing to the development and having been transferred to come held (herein simply "developed" for convenience) on a transfer material such as paper has a higher probability of being developed thereon per each toner particle as the toner particle has a higher circularity, and hence images (toner images) have a small height on the transfer material, so that the toner consumption can be reduced. If the circularity of the toner base particles are insufficient high, the toner tends to behave as agglomerates, and tend to be developed on the transfer material in the form of agglomerates. Such images have a large height on the transfer material, where the toner has been developed in a large quantity when developed in the same area, resulting in a large toner consumption. Also, the toner composed of toner base particles having a high circularity can readily create a denser state in images developed on the transfer material. As a result, the toner can cover the transfer material in a high coverage, and a sufficient image density can be attained even in a small toner quantity.

If the toner base particles have an average circularity of less than 0.935, the images developed on the transfer material have a large height, resulting in a large toner consumption. Also, the spaces between toner base particles may come too large to obtain a sufficient coverage also on the images developed on the transfer material, and hence, a larger toner quantity is required in order to attain necessary image density, resulting in a large toner consumption. If the toner base particles have an average circularity of more than 0.970, the toner may be fed onto the developing sleeve in excess, so that the sleeve may non-uniformly be coated thereon with the toner, resulting in occurrence of blotches.

In the toner base particles of the present invention, the toner base particles having a circle-equivalent diameter of from 3 μm or more to 400 μm or less may preferably have an average circularity of from 0.935 or more to less than 0.965, more preferably from 0.935 or more to less than 0.960, and still more preferably from 0.940 or more to less than 0.955. In virtue of this feature, the toner consumption per image area can further be reduced.

In the present invention, it is preferable that, also in regard to the toner particles in which external additives have been added, i.e., the toner particles having a circle-equivalent diameter of from 3 μm or more to 400 μm or less have an average circularity of from 0.935 or more to less than 0.970.

The average circularity referred to in the present invention is used as a simple method for expressing the shape of particles quantitatively, and is determined in the following way.

i) Using a flow type particle image analyzer FPIA-2100, manufactured by Sysmex Corporation, and in an environment of 23° C. and 60% RH, particles within the range of from 0.60 μm to 400 μm in circle-equivalent diameter are picked for measurement to measure their shapes. The circularity of each particle is determined from the following equation on the basis of the data obtained.

$$\text{Circularity } a = L_0/L$$

wherein $L_0$ represents the circumferential length of a circle having the same projected area as a particle image, and L represents the circumferential length of a particle projected image formed when image-processed at an image-processing resolution of 512×512 (pixels of 0.3 μm×0.3 μm each).

ii) In the particles of from 3 μm or more to 400 μm or less in circle-equivalent diameter, the sum total of circularities is divided by the number of all particles to find the average circularity.

The circularity referred to in the present invention is an index showing the degree of particle surface unevenness of the toner base particles and toner particles. It is indicated as 1.000 when the toner base particles and the toner particles have perfectly spherical particle shapes. The more complicate the surface shape is, the smaller the value of circularity is. Incidentally, the measuring instrument "FPIA-2100" used in the present invention employs a calculation method in which, in calculating the circularity of each particle and thereafter calculating the average circularity, particles are divided into classes where circularities of 0.400 to 1.000 are divided into 61 ranges (0.400 or more to less than 0.410, 0.410 or more to less than 0.420, . . . , 0.980 or more to less than 0.990, 0.990 or more to less than 1.000, and 1.000) according to the circularities obtained, and the average circularity is calculated using the center values and frequencies of divided points. However, between the values of the average circularity calculated by this calculation method and the values of the average circularity calculated by the above calculation equation which uses the sum total of circularities of individual particles, there is only a very small error, which is at a level that is substantially negligible. Accordingly, in the present invention, such a calculation method in which the concept of the calculation equation which uses the sum total of circularities of individual particles is utilized and is partly modified may be used, for the reasons of handling data, e.g., making the calculation time short and making the operational equation for calculation simple. In addition, compared with "FPIA-1000" used conventionally to calculate particle shapes of toner base particles and toner particles, the measuring instrument "FPIA-2100" used in the present invention is an instrument having been improved in precision of measurement of particle shapes of toner base particles and toner particles because of an improvement in magnification of processed particle images and also an improvement in processing resolution of images captured (256×256→512×512), and therefore having achieved surer capture of fine particles. Accordingly, where the particle shapes and particle size distribution must more accurately be measured as in the present invention, FPIA-2100 is more useful, with which the information concerned with particle shapes and particle size distribution can more accurately be obtained.

As a specific method for the measurement, 0.1 to 0.5 ml of a surface-active agent, preferably an alkylbenzenesulfonate, as a dispersant is added to 200 to 300 ml of water from which any impurities have previously been removed. To this solution, about 0.1 to 0.5 g of a sample for measurement is further added. The resultant suspension in which the sample has been dispersed is subjected to dispersion by means of an ultrasonic oscillator for 2 minutes. Adjusting the dispersion concentration to 2,000 to 10,000 particles/μl, the circularity distribution of particles are measured.

As the ultrasonic oscillator, the following apparatus may be used, for example. Dispersion may be carried out under the following conditions.

UH-150 (manufactured by K.K. SMT).

Output level: 5.

Constant mode.

The summary of measurement is as follows:

The sample dispersion is passed through channels (extending along the flow direction) of a flat and depressed flow cell (thickness: about 200 μm). A strobe and a CCD (charge-coupled device) camera are so fitted as to position oppositely to each other with respect to the flow cell so as to form a light path that passes crosswise with respect to the thickness of the flow cell. During the flowing of the sample dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area is calculated as the circle-equivalent diameter. The circularity of each particle is calculated from the projected area of the two-dimensional image of each particle and from the circumferential length of the projected image according to the above equation for calculating the circularity.

In the present invention, in number-base particle size distribution of toner base particles having a circle-equivalent diameter of from 0.6 μm or more to 400 μm or less as measured with the flow type particle image analyzer, toner base particles of from 0.6 μm or more to less than 3 μm in diameter may preferably be in a percentage of from 0% by number or more to less than 20% by number, more preferably from 0% by number or more to less than 17% by number, and particularly preferably from 1% by number or more to less than 15% by number. The toner base particles of from 0.6 μm or more to less than 3 μm in diameter have a great influence on the developing performance of the toner, in particular, fog characteristics. Such fine toner base particles tend to have excessively high charge to tend to participate in development in excess at-the time of development with the toner, and tend to cause fog on images. However, the controlling of the content of such fine toner base particles within the above range enables the fog to less occur.

In addition, the toner of the present invention has a certain high average circularity, and hence the toner tends to take a state in which the toner stands more densely packed, so that the developing sleeve tends to be more thickly coated thereon with the toner. In this case, the toner layer of the sleeve may differ in charge quantity between the upper layer and the lower layer to cause what is called "sleeve negative ghost" in which the image density of image areas corresponding to the second and further round of the sleeve comes lower than the image density at the leading end when images with a large area are continuously formed by development. If ultrafine powder is present in toner base particles in a large quantity on that occasion, the ultrafine powder tends to more accelerate the occurrence of difference in image density because such powder tends to have a higher charge quantity than other toner base particles, and tends to cause the sleeve negative ghost greatly. However, the controlling of the content of such fine toner base particles within the range as stated above enables the sleeve negative ghost to be kept from occurring. If the toner base particles of from 0.6 μm or more to less than 3 μm in diameter are in a percentage of more than 20% by number, the fog on images may greatly occur and further the sleeve negative ghost may greatly occur.

In the toner base particles of the present invention, toner base particles having a circularity of less than 0.960 may preferably be in a number cumulative value of from 20% by number or more to less than 70% by number, preferably from 25% by number or more to less than 65% by number, more preferably from 30% by number or more to less than 65% by number, and still more preferably from 35% by number or more to less than 65% by number. The circularity of toner base particles differs between individual toner base particles. Such difference in circularity brings a difference in characteristics as toner base particles. Hence, the percentage of toner base particles having appropriate circularities may preferably be in a proper value in order to make the toner base particles have a higher developing performance.

In the present invention, the toner base particles have an appropriate average circularity and at the same time has the appropriate circularity distribution as stated above, where the toner base particles can have uniform charge distribution and the fog can be made less occur. If the toner base particles of less than 0.960 in circularity are in a number cumulative value of less than 20% by number, the toner base particles may deteriorate during running. If the-toner base particles of less than 0.960 in circularity are in a number cumulative value of 70% by number or more, the fog may greatly occur and the image density may lower in a high-temperature and high-humidity environment.

The present invention is also characterized in that the toner base particles have an average surface roughness of from 5.0 nm or more to less than 35.0 nm as measured with a scanning probe microscope, preferably from 8.0 nm or more to less than 30.0 nm, and more preferably from 10.0 nm or more to less than 25.0 nm. Inasmuch as the toner base particles have an appropriate average surface roughness, appropriate spaces are produced between toner particles, and the toner can be improved in fluidity, so that better developing performance can be brought. Especially in the toner base particles having the average circularity that is characteristic of the present invention, the feature of having the above average surface roughness can provide the toner with superior fluidity. Also, the toner can be provided with better fluidity when ultrafine particles of less than 3 μm in diameter are present in a small number in the toner base particles of the present invention. More specifically, if such ultrafine particles are present in a large number in the toner base particles, the ultrafine particles may enter the dales of toner base particle surfaces to lessen the spaces between particles to hinder the toner from being provided with favorable fluidity. If the toner base particles have an average surface roughness of less than 5.0 nm, the toner can not be provided with sufficient fluidity to cause fading, resulting in a decrease in image density. If the toner base particles have an average surface roughness of 35.0 nm or more, the spaces between toner base particles come so many as to cause toner scatter.

In the present invention, it is preferable that, also in regard to the toner particles in which external additives have been added, i.e., the toner, the toner particles have an average surface roughness of from 10.0 nm or more to less than 26.0 nm, and preferably from 12.0 nm or more to less than 24.0 nm. If the toner particles have an average surface roughness of less than 10.0 nm, the particles of external additives are thought to stand embedded in a large number in the dales of toner base particle surfaces, resulting in a poor fluidity, to cause fading to make it difficult to-obtain good images. If the toner particles have a particle average surface roughness of 26.0 nm or more, the particles of external additives on the toner base particle surfaces are thought to stand not uniformly coated, tending to cause spots around line images because of faulty charging. Even in such a toner, those having appropriate particle surface roughness and circularity make it easy to obtain the effect of the present invention.

The toner base particles may also preferably have a maximum vertical difference of from 50 nm or more to less than 250 nm, preferably from 80 nm or more to less than 220 nm, and more preferably from 100 nm or more to less than 200 nm, as measured with a scanning probe microscope. This enables the toner to be provided with better fluidity. If the toner base particles have a maximum vertical difference of less than 50 nm, it may be unable to provide the toner with sufficient fluidity to cause fading and a decrease in image density. If the toner base particles have a maximum vertical difference of 250 nm or more, the toner scatter may occur.

The toner base particles may also preferably have a surface area of from 1.03 $\mu m^2$ or more to less than 1.33 $\mu m^2$, preferably from 1.05 $\mu m^2$ or more to less than 1.30 $\mu m^2$, and more preferably from 1.07 $\mu m^2$ or more to less than 1.28 $\mu m^2$, as surface area of an area of 1 μm square of the particle surface as measured with a scanning probe microscope. This enables the toner to be provided with better fluidity. If the toner base particles have a surface area of less than 1.03 μm , it may be unable to provide the toner with sufficient fluidity to cause fading and a decrease in image density. If the toner base particles have a surface area of 1.33 $\mu m^2$ or more, the toner scatter (spots around line images) may occur.

In the present invention, the average surface roughness of the toner base particles and that of the toner particles and the maximum vertical difference and surface area of the toner base particles are measured with a scanning probe microscope. An example of measuring methods is shown below.

Probe station: SPI3800N (manufactured by Seiko Instruments Inc.); measuring unit: SPA400.

Measuring mode: DFM(resonance mode)-shaped images.

Cantilever: SI-DF40P.

Resolution: the number of X-data; 256; the number of Y-data: 128.

In the present invention, areas of 1 μm square of the particle surfaces of the toner base particles and those of the toner particles are measured. The areas to be measured are areas of 1 μm square at middle portions, of the particle surfaces of the toner base particles and those of the toner particles which are measured with the scanning probe microscope. As the toner base particles and toner particles which are to be measured, toner base particles and toner particles which have particle diameters-equal to weight-average particle diameter (D4) measured by the Coulter counter method are picked out at random, and the toner base particles and toner particles thus picked out are measured. Data obtained by measurement are subjected to secondary correction. Five or more particles of different toner base particles and toner particles are measured, and an average value of the data obtained is calculated to find the average surface roughness of the toner base particles and that of the toner particles and the maximum vertical difference and surface area of the toner base particles.

In the toner in which external additives (inorganic fine particles) have externally been added to the toner base particles, the external additives must be removed from toner particle surfaces when the surface properties of the toner base particles are measured with the scanning probe microscope. As a specific method therefor, the following method is available, for example.

1) 45 g of the toner is put into a sample bottle, and 10 ml of methanol is added thereto.
2) The sample is dispersed for 1 minute by means of an ultrasonic cleaning machine to make the external additives separate.
3) The toner base particles and the external additives are separated by suction filtration (a 10 μm membrane filter). In the case of a toner containing a magnetic material, a magnet may be touched to the bottom of the sample bottle to make the toner base particles stationary so that only the supernatant liquid may be separated.
4) The above 2) and 3) are carried out three times in total, and the resultant toner base particles are well dried at room temperature by means of a vacuum dryer.

The toner base particles, from which the external additives have been removed, are observed on a scanning electron microscope. After making sure that the external additives have disappeared, the surfaces of the toner base particles may be observed with the scanning probe microscope. If the external additives have not well completely been removed, the steps 2) and 3) are repeated until the external additives are sufficiently removed, and thereafter the surfaces of the toner base particles are observed with the-scanning probe microscope.

As another method for removing the external additives in place of the steps 2) and 3), a method is available in which the external additives are made to dissolve with an alkali. As the alkali, an aqueous sodium hydroxide solution is preferred.

The respective terms are explained below.

Average surface roughness (Ra):

What has three-dimensionally been so extended that the center-line average roughness Ra defined in JIS B 0601 is applicable to faces for measurement. It is the value found by averaging absolute values of deviations from the reference face to the specified face, and is expressed by the following equation.

$$R_a = \frac{1}{S_o}\int_{Y_B}^{Y_T}\int_{X_L}^{X_R}|F(X,Y) - Z_o|\,dX\,dY$$

where;

F(X,Y) represents the face where the whole measurement data stand;

$S_0$ represents the area found when the specified face is supposed to be ideally flat; and $Z_0$ represents the average value of Z-data in the specified face (data in the direction vertical to the specified face).

In the present invention, the specified face is meant to be the measuring area of 1 μm square.

Maximum vertical difference:

The difference between a maximum value and a minimum value of Z-data in the specified face.

Surface area (S):

The surface area of the specified face.

A process for obtaining the toner base particles which makes use of the step of surface modification is described below as a preferred process for producing the toner base particles characteristic of the present invention. A surface modifying apparatus used in the step of surface modification and a process for producing the toner base particles which utilizes the surface modifying apparatus are specifically described below with reference to the drawings.

Incidentally, in the present invention, the surface modification is meant to smooth the surfaces of toner base particles.

Figure 2:
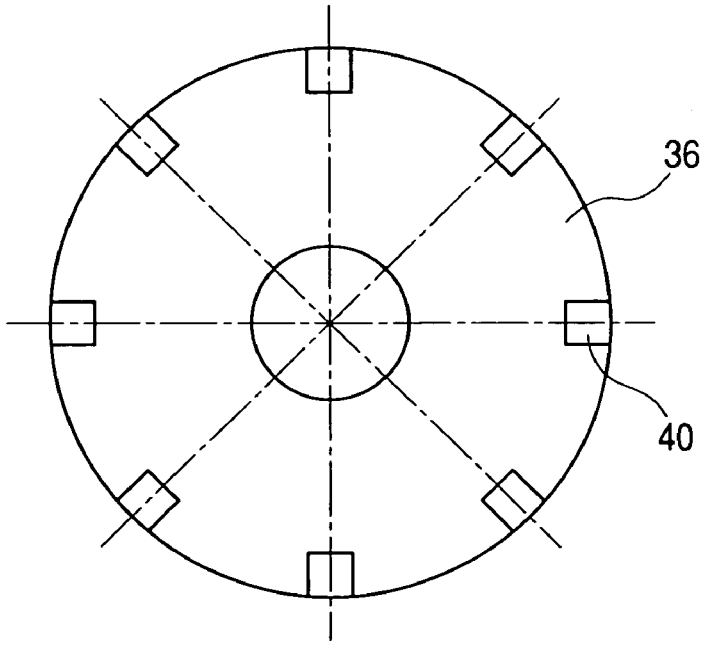
FIG. 2 is a schematic view showing an example of a top plan view of a dispersing rotor shown in FIG. 1.

FIG. 1 illustrates an example of the surface modifying apparatus usable in producing the toner base particles according to the present invention. FIG. 2 illustrates an example of a top plan view of a rotor which rotates at a high speed in the apparatus shown in FIG. 1.

The surface modifying apparatus shown in FIG. 1 is constituted of a casing; a jacket (not shown) through which cooling water or an anti-freeze can be passed; a dispersing rotor (surface modification means) 36 which is a disklike rotating member rotatable at a high speed, provided in the casing and attached to the center rotational shaft, and having a plurality of rectangular disks or cylindrical pins 40; liners 34 disposed on the outer periphery of the dispersing rotor 36 at intervals kept constant and provided with a large number of grooves at the surfaces (incidentally, the grooves at the liner surfaces may be not provided); a classifying rotor 31 which is a means for classifying a surface-modified material into those with stated particle diameters; a cold air inlet 35 for introducing cold air therethrough; a material feed opening 33 for introducing therethrough the material to be treated; a discharge valve 38 provided open-close operably so that surface modification time can freely be controlled; a powder discharge opening 37 for discharging therethrough the powder having been treated; a fine powder discharge opening 32 through which particles smaller than the desired particle size are discharged; and also a cylindrical guide ring 39 which is a means by which the interior of the casing is partitioned into a first space 41 through which the surface-modified material passes before it is introduced into the classification means and a second space 42 through which the particles from which fine powder has been removed by classification by the classification means are introduced into the surface modification means. Here, a gap formed between the dispersing rotor 36 and the liners 34 is a surface modification zone, and the part holding the classifying rotor 31 and its surroundings is a classification zone.

Incidentally, the classifying rotor 31 may be, as its direction of installation, of a vertical type as shown in FIG. 1, or a lateral type. The classifying rotor 31 may also be, as its number, provided alone as shown in FIG. 1, or in plurality.

In the surface modifying apparatus constituted as described above, material toner base particles are introduced through the material feed opening 33 in the state the discharge valve 38 is closed, whereupon the material toner base particles introduced are first sucked by a blower (not shown), and then classified by the classifying rotor 31.

In that classification, the classified, fine powder of particles smaller than the desired particle size is continuously discharged and removed out of the apparatus, and coarse powder of particles larger than the desired particle size are carried on circulating flows generated by the dispersing rotor 36, along the inner periphery of the guide ring 39 (in the second space 42) by the aid of centrifugal force, and is guided to the surface modification zone. The material guided to the surface modification zone undergoes mechanical impact force between the dispersing rotor 36 and the liners 34, and is treated by surface modification. The surface-modified particles, having been subjected to surface modification, are carried on the cold air passing through the interior of the apparatus, and is guided to the classification zone along the outer periphery of the guide ring 39 (in the first space 41), where fine powder is again discharged out of the apparatus by the action of the classifying rotor 31, and coarse powder, being carried on the circulating flows, is again returned to the surface modification zone to undergo surface modification action repeatedly. After lapse of a certain time, the discharge valve 38 is opened to collect the surface-modified particles through the discharge opening 37.

In this surface modifying apparatus, the fine powder component can be removed simultaneously with the surface modification of toner base particles in the step of the surface modification of toner base particles. Thus, ultrafine particles present in the toner base particles by no means stick to the toner base particle surfaces, and toner base particles having the desired circularity, average surface roughness and ultrafine-particle content can effectively be obtained. If the fine powder can not be removed simultaneously with the surface modification, the ultrafine particles may come present in a large quantity in the toner base particles after the surface modification, and besides, in the step of the surface modification of toner base particles, the ultrafine particles may stick to the surfaces of toner base particles having proper particle diameters, because of mechanical and thermal influence. As the result, protrusions due to the fine-particle component having stuck are produced on the surfaces of the toner base particles, making it impossible to obtain the toner base particles having the desired circularity and average surface roughness.

Incidentally, in the present invention, what is meant by "the fine powder component is removed simultaneously with the surface modification" is that the surface modification of toner base particles and the removal of fine powder are repeatedly carried out. It may be done using an apparatus like the above, having the respective steps in a single apparatus. Alternatively, the surface modification of toner base particles and the removal of fine powder may be carried out using different apparatus, and the respective steps may repeatedly be carried out.

As surface modification time in this surface modifying apparatus (i.e., cycle time, which is the time after material feed has been completed and before the discharge valve is opened), it may preferably be from 5 seconds or more to 180 seconds or less, and more preferably from 15 seconds or more to 120 seconds or less. If the surface modification time is less than 5 seconds, the surface modification time may be too short to obtain the surface-modified toner base particles sufficiently. If on the other hand the surface modification time is more than 180 seconds, the surface modification time may be so long as to cause in-machine melt adhesion due to the heat generated at the time of surface modification and cause a lowering of throughput capacity.

In the process for producing the toner base particles of the present invention, it is further preferable that cold air temperature T1 at which the cold air is introduced into the surface modification apparatus is controlled to 5° C. or less. Inasmuch as the cold air temperature T1 at which the cold air is introduced into the surface modifying apparatus is controlled to 5° C. or less, which is more preferably 0° C. or less, still more preferably −5° C. or less, particularly preferably −10° C. or less, and most preferably −15° C. or less, the in-machine melt adhesion due to the heat generated at the time of surface modification can be prevented. If the cold air temperature T1 at which the cold air is introduced into the surface modifying apparatus is more than 5° C., the in-machine melt adhesion due to the heat generated at the time of surface modification may occur.

Incidentally, the cold air introduced into the surface modifying apparatus may preferably be dehumidified air in view of the prevention of moisture condensation inside the apparatus. As a dehumidifier, any known apparatus may be used.

As air feed dew point temperature, it may preferably be −15° C. or less, and more preferably be −20° C. or less.

In the process for producing the toner base particles of the present invention, it is further preferable that the surface modifying apparatus is provided therein with a jacket for in-machine cooling and the surface modification is carried out while letting a refrigerant (preferably cooling water, and more preferably an anti-freeze such as ethylene glycol) run through the jacket. The in-machine cooling by means of the jacket enables prevention of in-machine melt adhesion due to the heat generated at the time of surface modification.

Incidentally, the refrigerant let to run through the jacket of the surface modifying apparatus may preferably be controlled to a temperature of 5° C. or less. Inasmuch as the refrigerant let to run through the jacket of the surface modifying apparatus is controlled to a temperature of 5° C. or less, which may preferably be 0° C. or less, and more preferably be −5° C. or less, the in-machine melt adhesion due to the heat generated at the time of surface modification can be prevented. If the refrigerant let to run through the jacket is more than 5° C., the in-machine melt adhesion due to the heat generated at the time of surface modification may occur.

In the process for producing the toner base particles of the present invention, it is further preferable that temperature T2 at the rear of the classifying rotor in the surface modifying apparatus is controlled to 60° C. or less. Inasmuch as the temperature T2 at the rear of the classifying rotor in the surface modifying apparatus is controlled to 60° C. or less, which may preferably be 50° C. or less, the in-machine melt adhesion due to the heat generated at the time of surface modification can be prevented. If the temperature T2 at the rear of the classifying rotor in the surface modifying apparatus is more than 60° C., the in-machine melt adhesion due to the heat generated at the time of surface modification may occur because in the surface modification zone the temperature higher than that has an influence.

In the process for producing the toner base particles of the present invention, it is further preferable that the minimum gap between the dispersing rotor and the liners in the surface modifying apparatus is set to from 0.5 mm to 15.0 mm, and more preferably from 1.0 mm to 10.0 mm. It is also preferable that the rotational peripheral speed of the dispersing rotor is set to from 75 m/sec to 200 m/sec, and more preferably from 85 m/sec to 180 m/sec. It is further preferable that the minimum opening between the tops of the rectangular disks or cylindrical pins provided on the top surface of the the dispersing rotor and the bottom of the cylindrical guide ring in the surface modifying apparatus is set to from 2.0 mm to 50.0 mm, and more preferably from 5.0 mm to 45.0 mm.

In the present invention, pulverizing faces of the dispersing rotor and liners in the surface modifying apparatus may be those having been subjected to wear-resistant treatment. This is preferable in view of productivity of the toner base particles. Incidentally, there are no limitations at all on how to carry out the wear-resistant treatment. There are also no limitations at all also on the shapes of the dispersing rotor and liners in the surface modifying apparatus.

As the process for producing the toner base particles of the present invention, it is preferable that material toner base particles beforehand made into fine particles approximate to those with the desired particle diameter are treated using an air classifier to remove fine powder and coarse powder to a certain extent, and thereafter the surface modification of toner base particles and the removal of ultrafine powder component are carried out using the surface modifying apparatus. Inasmuch as the fine powder is beforehand removed, the dispersion of toner base particles in the surface modifying apparatus is improved. In particular, the fine powder component in toner base particles has a large specific surface area, and has a relatively high charge quantity compared with other large toner base particles. Hence, it can not easily be separated from other toner base particles, and the ultrafine powder component is not properly classified by the classifying rotor in some cases. However, beforehand removing the fine powder component in toner base particles makes individual toner base particles readily dispersed in the surface modification apparatus, and the ultrafine powder component is properly classified by the classifying rotor, so that the toner base particles having the desired particle size distribution can be obtained.

In the toner base particles from which the fine powder has been removed by an air classifier, the cumulative value of number-average distribution of toner base particles of less than 4 μm in diameter may be from 10% or more to less than 50%, preferably from 15% or more to less than 45%, and more preferably, from 15% or more to less than 40%, in particle size distribution measured by the Coulter Counter method. Thus, the surface modifying apparatus in the present invention enables effective removal of the ultrafine powder component. The air classifier used in the present invention may include Elbow Jet (manufactured by Nittetsu Mining Co., Ltd.) and so forth.

Further, in the present invention, the circularity of the toner base particles and the percentage of particles of from 0.6 μm or more to less than 3 μm in diameter in the toner base particles can be controlled to more proper values by controlling the number of revolutions of the dispersing rotor and classifying rotor in the surface modifying apparatus.

In the present invention, when the wettability of the toner base particles to a methanol/water mixed solvent is measured at transmittance of light of 780 nm in wavelength, the methanol concentration at the time the transmittance is 80% and the methanol concentration at the time the transmittance is 50% may be within the range of from 35 to 75% by volume, preferably from 40 to 70% by volume, more preferably from 45 to 65% by volume, and still more preferably from 45 to 60% by volume. Toner base particles having such methanol concentration—transmittance characteristics can be obtained using the surface modifying apparatus characteristic of the present invention and setting surface modification conditions to appropriate conditions. Thus, raw materials can stand uncovered to toner base particle surfaces in an adequate proportion, and appropriate and sharp chargeability can be brought to the toner base particles. Also, the toner base particles of the present invention have the average circularity of from 0.935 or more to less than 0.970, and can have superior fluidity when made into the toner. The toner having such good fluidity and sharp charge quantity distribution can have uniform and high chargeability in the toner container, and good and stable image density can be attained even in long-term service. The toner acts effectively, especially in an environment where the toner tends to agglomerate to have a poor fluidity or to have a low charge quantity, as in a high-temperature and high-humidity environment.

If the methanol concentration at the time the transmittance is 80% and the methanol concentration at the time the transmittance is 50% are less than 35% by volume, the toner may have insufficient chargeability to make image density inferior. If on the other hand the methanol concentration at the time the transmittance is 80% and the methanol concentration at the time the transmittance is 50% are more than 75% by volume, the toner comes so highly agglomerative that no sufficient fluidity may be obtained to make developing performance insufficient in a high-temperature and high-humidty environment.

Difference in concentration between the methanol concentration at the time the transmittance is 80% and the methanol concentration at the time the transmittance is 50% may also be 10% or less, preferably 7% or less, and more preferably 5% or less, where better developing performance can be imparted to the toner. If the difference in concentration is more than 10%, the toner may have non-uniform particle surface state, and a toner improperly participating in development may increase to cause fog greatly.

Figure 3:
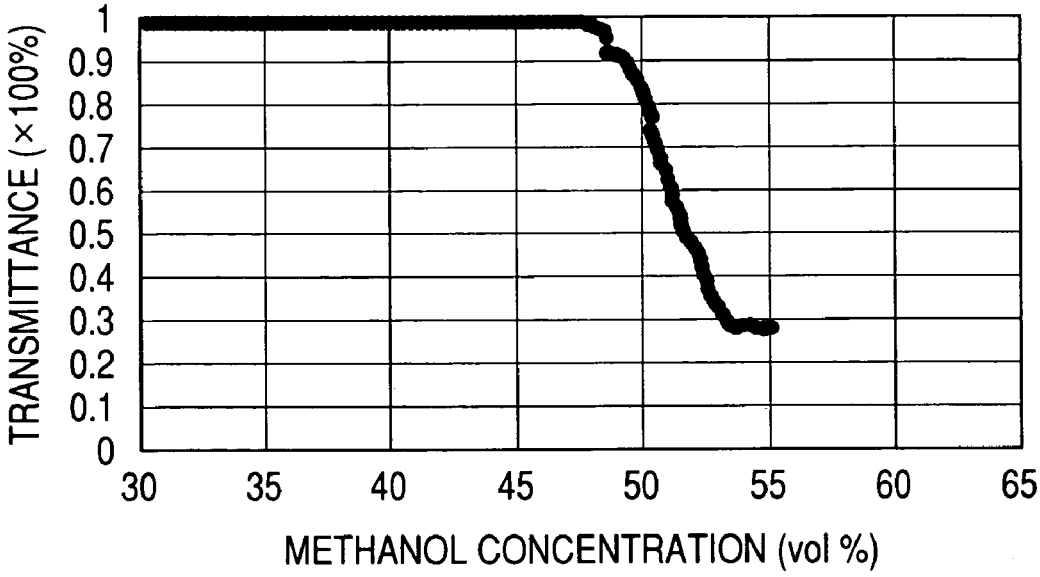
FIG. 3 is a graph showing transmittance on toner base particles I-1 in Example I-1 of the present invention, with respect to methanol concentration.

In the present invention, the wettability of the toner base particles, i.e., hydrophobic properties, is measured using a methanol drop transmittance curve. Stated specifically, e.g., a powder wettability tester WET-100P, manufactured by Rhesca Company, Limited, may be used as a measuring instrument therefor, and a methanol drop transmittance curve is used which is prepared by the following conditions and procedure. First, 70 ml of a water-containing methanol solution composed of 20 to 50% by volume of methanol and 50 to 80% by volume of water is put into a container. To this solution, 0.1 g of the specimen toner base particles are precisely weighed and added to prepare a sample fluid used for the measurement of hydrophobic properties of the toner base particles. Next, to this sample fluid, methanol is continuously added at a dropping rate of 1.3 ml/min., during which its transmittance is measured through light of 780 nm in wavelength to prepare a methanol drop transmittance curve as shown in FIG. 3. Here, the reason why methanol is used as a titration solvent is that the elution of a dye, a pigment, a charge control agent and so forth which are contained in the toner base particles has less influence and the surface state of the toner base particles can more accurately be observed.

As types of the binder resin used in the toner base particles of the toner of the present invention, the binder resin may include styrene homopolymers, styrene copolymers, polyester resins, polyol resins, polyvinyl chloride resins, phenol resins, natural resin modified phenol resins, natural resin modified maleic acid resins, acrylic resins, methacrylic resins, polyvinyl acetate resins, silicone resins, polyurethane resins, polyamide resins, furan resins, epoxy resins, xylene resins, polyvinyl butyral resins, terpene resins, cumarone indene resins, and petroleum resins.

Comonomers copolymerizable with styrene monomers in the styrene copolymers may include styrene derivatives such as vinyl toluene; acrylic acid, and acrylates such as methyl acrylate, ethyl acrylate, butyl acrylate, dodecyl acrylate, octyl acrylate, 2-ethylhexyl acrylate and phenyl acrylate; methacrylic acid, and methacrylates such as methyl methacrylate, ethyl methacrylate, butyl methacrylate and octyl methacrylate; maleic acid; dicarboxylates having a double bond, such as butyl maleate, methyl maleate and dimethyl maleate; acrylamide, acrylonitrile, methacrylonitrile, and butadiene; vinyl esters such as vinyl chloride, vinyl acetate and vinyl benzoate; olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination of two or more.

In the present invention, a styrene-acrylate-acrylic acid copolymer, a styrene-acrylate copolymer and a styrene-acrylate-methacrylic acid copolymer may be used as particularly preferred binder resins. This makes it easy to control the circularity of the toner base particles to an adequate value.

The binder resin used in the present invention may have a glass transition temperature (Tg) of from 45° C. to 80° C., and preferably from 50° C. to 70° C. in view of the storage stability. If it has a Tg lower than 45° C., the toner may deteriorate in a high-temperature atmosphere or may cause offset at the time of fixing. If it has a Tg higher than 80° C., the toner tends to have a low fixing performance.

The Tg is measured according to ASTM D3418-82, using Q-1000, manufactured by TA Instruments Japan Ltd. As a DSC curve used in the present invention, a DSC curve is used which is obtained when a sample is heated at a heating rate of 10° C./min after it has been heated once and then cooled to take a pre-history. Its definition is given as follows. Glass transition temperature (Tg): In the DSC curve at the time of heating, the temperature at the point of intersection of i) the middle-point line between the base lines before and after the appearance of changes in specific heat and ii) the DSC curve.

The binder resin may also preferably have a main-peak molecular weight of from 3,000 or more to less than 30,000, more preferably from 5,000 or more to less than 25,000, and particularly preferably from 8,000 or more to less than 20,000. This makes the toner base particles have an appropriate hardness, and makes it easy to carry out the surface modification of toner base particles.

The binder resin in the toner, and the toner as a result, of the present invention may also more preferably have a main peak in the region of molecular weight of from 3,000 or more to less than 30,000 and also have at least one sub-peak or shoulder in the region of molecular weight of from 50,000 or more to less than 100,000,000.

Inasmuch as the binder resin has a main peak in the region of molecular weight of from 3,000 or more to less than 30,000, toner base particles having a high circularity can be obtained under a small load at the time of the surface modification of toner base particles, also bringing an improvement in productivity. This also can make the toner have a good fixing performance. Inasmuch as the binder resin has a sub-peak or shoulder in the region of molecular weight of from 50,000 to less than 100,000,000, and preferably from 100,000 to less than 3,000,000, the whole toner base particles can be made to have an appropriate elasticity, and the toner base particles can have an appropriate hardness at the time of the surface modification of toner base particles. This affords an appropriate shear applied to toner base particles to make it easy to obtain the desired toner base particle shape. This also can bring an improvement in anti-offset properties of the toner.

As an effect obtained by the combination of the toner base particles having the molecular weight distribution as in the present invention with the surface modification, superior transfer efficiency can be achieved.

The toner base particles in the present invention have a low-molecular weight component and a high-molecular weight component in a well balanced state, and the whole toner base particles have an appropriate elasticity. Hence, raw materials such as a magnetic material, a wax a charge control agent and so forth can be made to distribute uniformly at toner base particle surfaces. Since the toner base particle surfaces have everywhere uniform composition, they can have the same chargeability, and the toner can be made to have sharp charge distribution. If the toner base particle surfaces have non-uniform composition, broad and non-uniform charge distribution may result. Also, inasmuch as the toner base particles in the present invention have appropriate average surface roughness, contact chargeable sites are present at the toner base particle surfaces in a large number. On that occasion, the toner base particles having a low-molecular weight component and a high-molecular weight component in a well balanced state can bring sharp and high charge quantity to the toner to improve its transfer performance from a photosensitive drum to a transfer material. Further, since they have an appropriate circularity, the toner can readily be separated from the photosensitive drum.

If the main-peak molecular weight is less than 3,000, the low-molecular weight component and the high-molecular weight component may come low compatible with each other to make the toner base particle surface composition non-uniform, making it difficult to obtain sharp charge distribution, so that the transfer efficiency tends to lower. If the main-peak molecular weight is 30,000 or more, the toner may have an inferior fixing performance, and also a high load may be required at the time of the surface modification treatment, also resulting in a low productivity. If the molecular weight at the sub-peak or shoulder is less than 50,000, the toner tends to have an inferior anti-offset performance. If the molecular weight at the sub-peak or shoulder is 100,000,000 or more, the low-molecular weight component and the high-molecular weight component may come low compatible with each other to make the toner base particle surface composition non-uniform, making it difficult to obtain sharp charge distribution, so that the transfer efficiency may lower.

In the present invention, it is preferable that the component with a molecular weight of from 3,000 or more to less than 30,000 (main-peak component) in the binder resin in the toner of the present invention is in a content of from 30 to 90% by weight and the component with a molecular weight of from 50,000 to less than 100,000,000 (sub-peak or shoulder component) is in a content of from 10 to 70% by weight.

In the present invention, a binder resin having an acid value may be used. This more strengthens the chargeability of the toner, materializes quick rise of charge of the toner, and can provide a high charge quantity. It is preferable that the low-molecular weight component or high-molecular weight component in the binder resin has an acid value and the acid value is from 0.5 mg·KOH/g to less than 30 mg·KOH/g. It is further preferable that both the low-molecular weight component and the high-molecular weight component have the acid value and, in particular, the acid value of the low-molecular weight component is larger than the acid value of the high-molecular weight component.

Acid value of toner THF-soluble matter and raw-material binder resin:

In the present invention, the acid value (JIS acid value) of toner THF(tetrahydrofuran)-soluble matter and raw-material binder resin is determined by the following method. Incidentally, the acid value of the raw-material binder resin is also meant to be the acid value of THF-soluble matter of the raw-material resin.

Basic operation is made according to JIS K-0070.

(1) A sample is used after the THF-insoluble matter of the toner and binder resin has been removed, or the THF-soluble component obtained-in the measurement of THF-insoluble matter, which has been extracted with THF solvent by means of the Soxhlet extractor, is used as a sample. A crushed product of the sample is precisely weighed in an amount of from 0.5 to 2.0 g, and the weight of the soluble component is represented by W (g).

(2) The sample is put in a 300 ml beaker, and 150 ml of a toluene/ethanol (4/1) mixed solvent is added thereto to dissolve the sample.

(3) Using an ethanol solution of 0.1 mol/l of KOH, titration is made by means of a potentiometric titrator. For example, automatic titration may be utilized which is made using a potentiometric titrator AT-400 (Win Workstation) and an ABP-410 motor buret, manufactured by Kyoto Electronics Manufacturing Co., Ltd.

(4) The amount of the KOH solution used here is represented by S (ml). A blank test not using any sample is conducted at the same time, and the amount of the KOH solution used in this blank test is represented by B (ml).

(5) The acid value is calculated according to the following expression. Letter symbol f is the factor of KOH.

$$\text{Acid value (mg·KOH/g)}=\{(S-B)\times f\times 5.61\}/W.$$

In the present invention, the molecular weight distribution of the binder resin by GPC (gel permeation chromatography) using THF (tetrahydrofuran) as a solvent is measured under the following conditions.

Columns are stabilized in a heat chamber of 40° C. To the columns kept at this temperature, THF as a solvent is flowed at a flow rate of 1 ml per minute, and about 100 μl of a sample THF solution is injected thereinto to make measurement. In measuring the molecular weight of the sample, the molecular weight distribution the sample has is calculated from the relationship between the logarithmic value of a calibration curve prepared using several kinds of monodisperse polystyrene standard samples and the number of count. As the standard polystyrene samples used for the preparation of the calibration curve, it is suitable to use samples with molecular weights of from 100 to 10,000,000, which are available from, e.g., Tosoh Corporation or Showa Denko K.K., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H($H_{XL}$), G2000H($H_{XL}$), G3000H($H_{XL}$), G4000H($H_{XL}$), G5000H($H_{XL}$), G6000H($H_{XL}$), G7000H($H_{XL}$) and TSK guard column, available from Tosoh Corporation.

The sample is prepared in the following way.

The sample is put in THF, and is left for several hours, followed by thorough shaking so as to be well mixed with the THF (until coalescent matter of the sample has disappeared), which is further left for at least 12 hours. Here, the sample is so left as to stand in THF for at least 24 hours in total. Thereafter, the solution having been passed through a sample-treating filter (pore size: 0.45 to 0.5 μm; for example, MAISHORIDISK H-25-5, available from Tosoh Corporation, and EKIKURODISK 25CR, available from German Science Japan, Ltd., may be used) is used as the sample for GPC. The sample is so adjusted as to have resin components in a concentration of from 0.5 to 5 mg/ml.

In the present invention, it is also preferable for the toner to have, in its DSC curve at the time of heating as measured with a differential scanning calorimeter (DSC), at least one endothermic-peak, and have a temperature difference between start-point onset temperature and end-point onset temperature of the endothermic peak, of from 20° C. or more to less than 80° C., preferably from 30° C. or more to less than 70° C., and more preferably from 35° C. or more to less than 65° C. In the present invention, as a method for bringing such endothermic characteristics to the toner, a method is available in which a wax is added to the toner base particles. With regard to the wax, it is described later.

Inasmuch as the toner having the toner base particles having the average circularity and average surface roughness characteristic of the present invention has the above endothermic characteristics, image defects caused be faulty cleaning can effectively be prevented. In general, in the case of toners having good fluidity, like the toner of the present invention, the toner tends to slip through the gap between a cleaning member and a photosensitive member in the step of cleaning, making it difficult to perform cleaning to tend to cause contamination of members such as a charging roller. However, in the toner base particles which contain the wax component so as to have endothermic characteristics in the broad temperature range as stated above, the wax component is appropriately present at the toner base particle surfaces. This wax component restrains slipperiness of the toner appropriately, can effectively restrain the phenomenon that the toner slips through in the cleaning step, and can restrain the contamination of members such as a charging roller.

In the present invention, it is also preferable that, in the DSC curve at the time of heating as measured by DSC (differential scanning calorimetry), the start-point onset temperature of the endothermic peak is from 50° C. or more to less than 110° C., preferably from 55° C. or more to less than 100° C., and more preferably from 60° C. or more to less than 100° C. This can provide the toner with good fixing performance. If the start-point onset temperature is less than 50° C., the toner may have a poor storage stability. If the start-point onset temperature is more than 110° C., the toner may have an insufficient fixing performance.

In the present invention, it is also preferable that, in the endothermic curve at the time of heating as measured by DSC, the end-point onset temperature of the endothermic peak is from 90° C. or more to less than 150° C., preferably from 95° C. or more to less than 145° C., and more preferably from 100° C. or more to less than 140° C. This can provide the toner with good anti-offset properties. If the end-point onset temperature is less than 90° C., the toner may have poor anti-offset properties. If the end-point onset temperature is more than 150° C., the toner may have an insufficient fixing performance.

In the present invention, it is also preferable for the toner to have, in its DSC curve at the time of heating as measured by DSC, at least one endothermic peak top temperature at from 60° C. or more to less than 140° C., preferably from 65° C. or more to less than 135° C., more preferably from 70° C. or more to less than 130° C., and still more preferably from 70° C. or more to less than 125° C. This can provide the toner with good fixing performance and anti-offset properties. If the endothermic peak top temperature is less than 60° C., the toner may have a poor storage stability. If the endothermic peak top temperature is more than 140° C., the toner may have an insufficient fixing performance.

In the present invention, the DSC characteristics of the toner may be measured with a differential thermal analysis measuring instrument (DSC measuring instrument) DSC Q-1000 (manufactured by TA Instruments Japan Ltd.) under the following conditions.

Measured according to ASTM D3418.

Sample: 3 to 15 mg, preferably 5 to 10 mg.

Measuring method: The sample is put in an aluminum pan, and an empty aluminum pan is used as reference.

Temperature curve:

Heating I (20° C. to 180° C.; heating rate: 10° C./min)

Cooling I (180° C. to 10° C.; cooling rate: 10° C./min)

Heating II (10° C. to 180° C.; heating rate: 10° C./min).

In the above temperature curve, the start-point onset temperature of the endothermic peak, the end-point onset temperature of the endothermic peak and the endothermic peak top temperature are measured from an endothermic curve obtained at Heating II.

Start-point onset temperature of endothermic peak: The temperature at the point of intersection of i) a tangent line of the curve at the lowest temperature among temperatures at which the differential values of the curve of an endothermic peak come maximum and ii) the base line.

End-point onset temperature of endothermic peak: The temperature at the point of intersection of i) a tangent line of the curve at the highest temperature among temperatures at which the differential values of the curve of an endothermic peak come minimum and ii) the base line.

Endothermic peak top temperature: The temperature at the point where the height from the base line comes maximum, in the curve of an endothermic peak.

Incidentally, where a plurality of endothermic peaks are present, the start-point onset temperature at an endothermic peak on the lowest melting point side among the endothermic peaks is regarded as the start-point onset temperature of the toner, and the end-point onset temperature at an endothermic peak on the highest melting point side among the endothermic peaks is regarded as the end-point onset temperature of the toner. Also, among peak tops in the endothermic peaks, the endothermic peak top temperature at an endothermic peak having a peak top where the height from the base line comes maximum is regarded as the endothermic peak top temperature of the toner.

As a polymerization process for producing the binder resin in the present invention, it may include solution polymerization, emulsion polymerization and suspension polymerization.

The binder resin used in the present invention may preferably be produced using a polyfunctional polymerization initiator alone or in combination with a monofunctional polymerization initiator which are as exemplified below.

As specific examples of a polyfunctional polymerization initiator having a polyfunctional structure, it may include polyfunctional polymerization initiators having in one molecule two or more functional groups such as peroxide groups, having a polymerization initiating function, as exemplified by 1,1-di-t-butylperoxy-3,3,5-trimethylcyclohexane, 1,3-bis(t-butylperoxyisopropyl)benzene, 2,5-dimethyl-2,5-(t-butylperoxy)hexane, 2,5-dimethyl-2,5-di-(t-butylperoxy)hexane, tris-(t-butylperoxy)triazine,. 1,1-di-t-butylperoxycyclohexane, 2,2-di-t-butylperoxybutane, 4,4-di-t-butylperoxyvaleric acid-n-butyl ester, di-t-butyl peroxyhexahydroterephthalate, di-t-butyl peroxyazelate, di-t-butyl peroxytrimethyladipate, 2,2-bis(4,4-di-t-butylperoxycyclohexyl)propane, 2,2-di-t-butylperoxyoctane, and various polymer oxides; and polyfunctional polymerization initiators having in one molecule both a functional group such as a peroxide group, having a polymerization initiating function, and a polymerizable unsaturated group, as exemplified by diallyl peroxydicarbonate, t-butyl peroxymaleate, t-butyl peroxyallylcarbonate, and t-butyl peroxyisopropylfumarate.

Of these, more preferred ones are 1,1-di-t-butylperoxy-3,3,5-trimethylcyclohexane, 1,1-di-t-butylperoxycyclohexane, di-t-butyl peroxyhexahydroterephthalate, di-t-butyl peroxyazelate, 2,2-bis(4,4-di-t-butylperoxycyclohexyl)propane, and t-butyl peroxyallylcarbonate.

In order to satisfy various performances required as binders for toners, any of these polyfunctional polymerization initiators may preferably be used in combination with a monofunctional polymerization initiator. In particular, it may preferably be used in combination with a polymerization initiator having a half-life of 10 hours which is lower than the decomposition temperature necessary for the polyfunctional polymerization initiator to obtain a half-life of 10 hours.

Such a monofunctional polymerization initiator may specifically include organic peroxides such as benzoyl peroxide, 1,1-di(t-butylperoxy)-3,3,5-trimethylcyclohexane, n-butyl-4,4-di(t-butylperoxy)valerate, dicumyl peroxide, α,α'-bis(t-butylperoxydiisopropyl)benzene, t-butylperoxycumene, and di-t-butyl peroxide; and azo or diazo compounds such as azobisisobutylonitrile and diazoaminoazobenzene.

Any of these monofunctional polymerization initiators may be added in the monomer at the same time the polyfunctional polymerization initiator is added. In order to keep a proper efficiency of the polyfunctional polymerization initiator, the monofunctional polymerization initiator may preferably be added after the half-life the polyfunctional polymerization initiator shows has lapsed in the polymerization step.

Any of these polymerization initiators may preferably be added in an amount of 0.05 to 2 parts by weight based on 100 parts by weight of the monomer, in view of efficiency.

It is also preferable for the binder resin to have been cross-linked with a cross-linkable monomer.

As the cross-linkable monomer, a monomer having two or more polymerizable double bonds may chiefly be used. As specific examples, it may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxyethylene(2)-2,2-bis(4-hydroxyphenyl)propane diacrylate, polyoxyethylene(4)-2,2-bis(4-hydroxyphenyl)propane diacrylate, and the above compounds whose acrylate moiety has been replaced with methacrylate; and also polyester type diacrylate compounds as exemplified by MANDA (trade name; available from Nippon Kayaku Co., Ltd.).

As a polyfunctional cross-linkable monomer, it may include pentaerythritol acrylate, trimethylolethane triacrylate, trimethylolpropane triacrylate, tetramethylolpropane triacrylate, tetramethylolmethane tetraacrylate, oligoester acrylate, and the above compounds whose acrylate moiety has been replaced with methacrylate; triallylcyanurate, and triallyltrimellitate.

Any of these cross-linkable monomers may preferably be used in an amount of from 0.00001 to 1 part by weight, and preferably from 0.001 to 0.05 part by weight, based on 100 parts by weight of other monomer components.

As methods for producing binder resin compositions, available are a solution blend method in which a high-molecular weight polymer and a low-molecular weight polymer are separately synthesized by solution polymerization and thereafter these are mixed in the state of solutions, followed by desolvation; a dry blend method which carries out melt kneading by means of an extruder or the like; and a two-stage polymerization method in which a low-molecular weight polymer obtained by solution polymerization or the like is dissolved in a monomer which is to constitute a high-molecular weight polymer, and suspension polymerization is carried out, followed by washing and then drying to obtain a resin composition. In the dry blend method, however, there is room for improvements in respect of uniform dispersion and compatibility. In the case of the two-stage polymerization method, it has many advantages on uniform dispersibility and so forth, but the solution blend method is most preferred because the low-molecular weight component can be used in a larger quantity than the high-molecular weight component, because a high-molecular weight polymer having a large molecular weight can be synthesized, and because it may less cause the problem that any unnecessary low-molecular weight polymer is secondarily produced. Also, where a stated acid value is brought into the low-molecular weight polymer component, solution polymerization is preferred, which enables the acid value to be more readily set than polymerization making use of an aqueous medium.

Where a polyester resin is used as the binder resin in the present invention, it has the composition as exemplified below.

As a dihydric alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (A) and its derivatives:

(A)

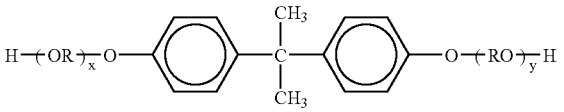

wherein R represents an ethylene group or a propylene group, x and y are each an integer of 0 or more, and an average value of x+y is 0 to 10;

and a diol represented by the following Formula (B):

(B)

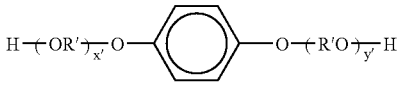

wherein R' represents

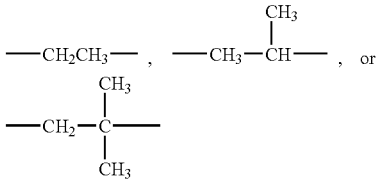

x' and y' are each an integer of 0 or more, and an average value of x'+y' is 0 to 10.

As a dibasic acid component, it may include dicarboxylic acids and derivatives thereof, as exemplified by benzene dicarboxylic acids or anhydrides thereof, such as phthalic acid, terephthalic acid, isophthalic acid and phthalic anhydride, or lower alkyl esters thereof; alkyldicarboxylic acids such as succinic acid, adipic acid, sebacic acid and azelaic acid, or anhydrides or lower alkyl esters thereof; alkenylsuccinic acids or alkylsuccinic acids, such as n-dodecenylsuccinic acid and n-dodecylsuccinic acid, or anhydrides or lower alkyl esters thereof; unsaturated dicarboxylic acids such as fumaric acid, maleic acid, citraconic acid and itaconic acid, or anhydrides or lower alkyl esters thereof.

It is also preferable to use a trihydric or higher alcohol component and a tribasic or higher acid component in combination which act as cross-linking components.

The trihydric or higher, polyhydric alcohol component may include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

The tribasic or higher, polycarboxylic acid component in the present invention may include polybasic carboxylic acids and derivatives thereof, as exemplified by trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, Empol trimer acid, and anhydrides or lower alkyl esters of these; and a tetracarboxylic acid represented by the following formula:

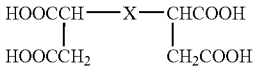

(wherein X represents an alkylene group or alkenylene group having 5 to 30 carbon atoms which may have at least one side chain having 3 or more carbon atoms), and anhydrides or lower alkyl esters thereof.

The alcohol component may be in a proportion of from 40 to 60 mol %, and preferably from 45 to 55 mol %; and the acid component, from 60 to 40 mol %, and preferably from 55 to 45 mol %.

The trihydric or tribasic or higher, polyhydric or polybasic component may preferably be in a proportion of from 5 to 60 mol % of the whole components.

The polyester resin is usually obtained by commonly known condensation polymerization.

The toner of the present invention may preferably be incorporated with a charge control agent.

A charge control agent capable of controlling the toner to be negatively chargeable includes the following compounds.

For example, organic metal complex salts and chelate compounds are effective, including monoazo metal complexes, acetylyacetone metal complexes, aromatic hydroxycarboxylic acid and aromatic dicarboxylic acid type metal complexes. Besides, they also include aromatic hydroxycarboxylic acids, aromatic mono- and polycarboxylic acids, and metal salts, anhydrides or esters thereof, and phenol derivatives such as bisphenol.

In particular, azo type metal complexes represented by the following formula (1) are preferred.

(1)

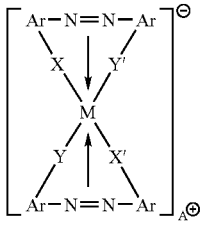

In the formula, M represents a central metal of coordination, including Sc, Ti, V, Cr, Co, Ni, Mn or Fe. Ar represents an aryl group, including a phenyl group or a naphthyl group, which may have a substituent. In such a case, the substituent may include a nitro group, a halogen atom, a carboxyl group, an anilide group, and an alkyl group having 1 to 18 carbon atoms or an alkoxyl group having 1 to 18 carbon atoms. X, X', Y and Y' each represent —O—, —CO—, —NH— or —NR— (R is an alkyl group having 1 to 4 carbon atoms). $A^+$ represents a counter ion, and represents a hydrogen ion, a sodium ion, a potassium ion, an ammonium ion or an aliphatic ammonium ion, or a mixed ion of any of these.

As the central metal, Fe is preferred. As the substituent, a halogen atom, an alkyl group or an anilide group is preferred. As the counter ion, a hydrogen ion, an alkali metal ion, an ammonium ion or an aliphatic ammonium ion is preferred. A mixture of complexes having different counter ions may also preferably be used.

Basic organic acid metal complexes represented by the following general formula (2) are also preferable as charge control agents capable of imparting negative chargeability.

(2)

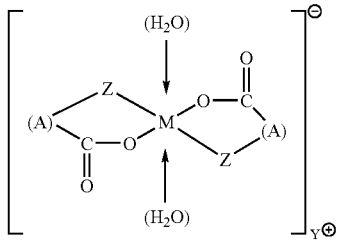

In the formula, M represents a central metal of coordination, including Cr, Co, Ni, Mn, Fe, Zn, Al, Si or B. A represents;

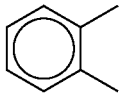

(which may have a substituent such as an alkyl group)

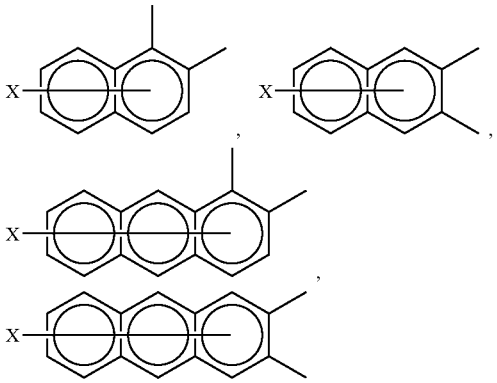

(X represents a hydrogen atom, a halogen atom, a nitro group or an alkyl group), and

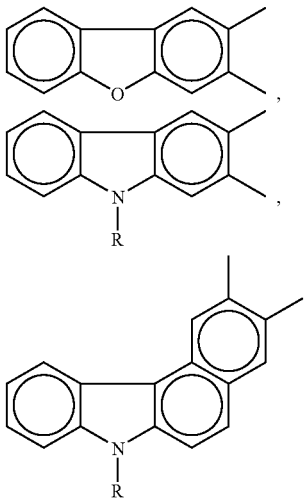

(R represents a hydrogen atom, an alkyl group having 1 to 18 carbon atoms or an alkenyl group having 2 to 16 carbon atoms);

$Y^+$ represents a counter ion, and represents a hydrogen ion, a sodium ion, a potassium ion, an ammonium ion, an aliphatic ammonium ion, or a mixed ion of any of these. Z represents —O— or

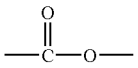

As the central metal, Fe, Cr, Si, Zn or Al is particularly preferred. As the substituent, an alkyl group, an anilide group, an aryl group or a halogen atom is preferred. As the counter ion, a hydrogen ion, an ammonium or an aliphatic ammonium ion is preferred.

A charge control agent capable of controlling the toner to be positively chargeable includes the following compounds.

Nigrosine and products modified with a fatty acid metal salt; quaternary ammonium salts such as tributylbenzylammonium 1-hydroxy-4-naphthosulfonate and tetrabutylammonium teterafluoroborate, and analogues of these, i.e., onium salts such as phosphonium salts, and lake pigments of these, triphenylmethane dyes and lake pigments of these (lake-forming agents include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate; guanidine compounds, and imidazole compounds. Any of these may be used alone or in combination of two or more kinds. Of these, triphenylmethane compounds, and quaternary ammonium salts whose counter ions are not halogens may preferably be used. Homopolymers of monomers represented by the general formula (3):

(3)

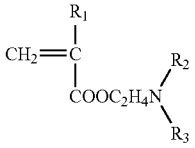

wherein $R_1$ represents a hydrogen atom or a methyl group; $R_2$ and $R_3$ each represent a substituted or unsubstituted alkyl group (preferably having 1 to 4 carbon atoms);

or copolymers of polymerizable monomers such as styrene, acrylates or methacrylates as described above may also be used as positive charge control agents. In this case, these charge control agents also even has the action as binder resins (as a whole or in part).

In particular, compounds represented by the following general formula (4) are preferred as positive charge control agents in the present invention.

(4)

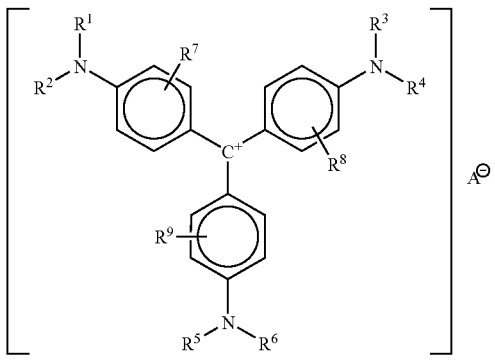

wherein $R^1$, $R^2$, $R^3$, $R^4$, $R^5$ and $R^6$ may be the same or different from one another and each represent a hydrogen atom, a substituted or unsubstituted alkyl group or a substituted or unsubstituted aryl group; $R^7$, $R^8$ and $R^9$ may be the same or different from one another and each represent a hydrogen atom, a halogen atom, an alkyl group or an alkoxyl group; and $A^-$ represents a negative ion selected from a sulfate ion, a nitrate ion, a borate ion, a phosphate ion, a hydroxide ion, an organic sulfate ion, an organic sulfonate ion, an organic phosphate ion, a carboxylate ion, an organic borate ion, and tetrafluorborate.

As methods for incorporating the toner with the charge control agent, available are a method of adding it internally to toner base particles and a method of adding it externally to toner base particles. The amount of the charge control agent used depends on the type of the binder resin, the presence or absence of any other additives, and the manner by which the toner is produced, including the manner of dispersion, and can not absolutely be specified. Preferably, the charge control agent may be used in an amount ranging from 0.1 to 10 parts by weight, and more preferably from 0.1 to 5 parts by weight, based on 100 parts by weight of the binder resin.

The toner base particles of the toner of the present invention may be incorporated with a wax. The wax used in the present invention may include the following. For example, paraffin wax and derivatives thereof, montan wax and derivatives thereof, microcrystalline wax and derivatives thereof, Fischer-Tropsch wax and derivatives thereof, polyolefin wax and derivatives thereof, and carnauba wax and derivatives thereof. The derivatives may include oxides, block copolymers with vinyl monomers, and graft modified products.

In the present invention, it is effective that any of these waxes is used in a total content of from 0.1 to 15 parts by weight, and preferably from 0.5 to 12 parts by weight, based on 100 parts by weight of the binder resin.

It is preferable for these waxes to have a melting point of from 65° C. or more to less than 130° C., preferably from 70° C. or more to less than 120° C., more preferably from 70° C. or more to less than 110° C., and still more preferably from 75° C. or more to less than 100° C., as measured with a differential scanning calorimeter (DSC). In the toner base particles, the wax having such a melting point has an appropriate hardness, and the toner base particles having the desired circularity, particle size distribution and average surface roughness can effectively be obtained in the step of the surface modification of toner base particles. If the wax has a melting point of less than 65° C., the toner may have a poor storage stability. If the wax has a melting point of 130° C. or more, the toner base particles may be so hard as to result in a poor productivity of the surface-modified toner base particles.

Incidentally, it is preferable that the thermal characteristics of the toner in the DSC curve at the time of heating, measured by DSC (differential scanning calorimetry) are controlled as described previously, by the use of such a wax.

Measurement of Melting Point of Wax:

In the present invention, the DSC characteristics of the wax may be measured with a differential thermal analysis measuring instrument (DSC measuring instrument) DSC Q-1000 (manufactured by TA Instruments Japan Ltd.) under the following conditions.

Measured According to ASTM D3418.

Sample: 0.5 to 2 mg, preferably 1 mg.

Measuring method: The sample is put in an aluminum pan, and an empty aluminum pan is used as reference.

Temperature curve:

Heating I (20° C. to 180° C.; heating rate: 10° C./min).

Cooling I (180° C. to 10° C.; cooling rate: 10° C./min).

Heating II (10° C. to 180° C.; heating rate: 10° C./min).

In the above temperature curve, the endothermic main peak temperature measured at Heating II is regarded as the melting point.

The toner base particles of the present invention contain a magnetic material. The magnetic material may also has the function of a colorant. The magnetic material to be used in the toner may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

These magnetic materials may preferably be those having a number-average particle diameter of from 0.05 μm to 1.0 μm, and more preferably from 0.1 μm to 0.5 μm. As the magnetic material, preferably usable are those having a BET specific surface area of from 2 to 40 $m^2/g$ (more preferably from 4 to 20 $m^2/g$). The shape of the magnetic materials is not limitted to special shape, and any shapes are optionally selected. As magnetic properties, the magnetic material may have a saturation magnetization of from 10 to 200 $Am^2/kg$ (preferably from 70 to 100 $Am^2/kg$), a residual magnetization of from 1 to 100 $Am^2/kg$ (preferably from 2 to 20 $Am^2/kg$) and a coercive force of from 1 to 30 kA/m (preferably from 2 to 15 kA/m) under application of a magnetic field of 795.8 kA/m, which may preferably be used. Any of these magnetic materials may be used in an amount of from 20 to 200 parts by weight, and preferably from 40 to 150 parts by weight, based on 100 parts by weight of the binder resin.

The number-average particle diameter may be determined by measuring it using a digitizer on the basis of a photograph taken on a transmission electron microscope or the like. The magnetic properties of the magnetic material may be measured with "Vibration Sample Type Magnetism Meter VSM 3S-15" (manufactured by Toei Industry Co., Ltd.) under application of an external magnetic field of 795.8 kA/m. To measure the specific surface area, according to the BET method and using a specific surface area measuring instrument AUTOSOBE (manufactured by Yuasa Ionics Co.), nitrogen gas is adsorbed on the surface of a sample, and the BET specific surface area is calculated using the BET multi-point method.

As other colorants usable in the toner of the present invention, it may include any suitable pigments and dyes. The pigments include carbon black, Aniline Black, acetylene black, Naphthol Yellow, Hanza Yellow, Rhodamine Lake, Alizarine Lake, red iron oxide, Phthalocyanine Blue and Indanethrene Blue. Any of these may be used in an amount necessary for maintaining optical density of fixed images, and may be added in an amount of from 0.1 to 20 parts by weight, and preferably from 0.2 to 10 parts by weight, based on 100 parts by weight of the binder resin. The dyes may include azo dyes, anthraquinone dyes, xanthene dyes and methine dyes. The dye may be added in an amount of from 0.1 to 20 parts by weight, and preferably from 0.3 to 10 parts by weight, based on 100 parts by weight of the binder resin.

To the toner base particles of the present invention, inorganic fine particles having been hydrophobic-treated or untreated are externally added in order to provide the toner with chargeability and fluidity.

The inorganic fine particles used in the present invention may include fine particles of oxides such as wet-process silica, dry-process silica, alumina, zinc oxide and tin oxide; double oxides such as strontium titanate, barium titanate, calcium titanate, strontium zirconate and calcium zirconate; and carbonate compounds such as calcium carbonate and magnesium carbonate. In order to improve developing performance and fluidity, they may preferably be selected from silica, titanium oxide, alumina, and double oxides of any of these.

Fine silica particles may include both what is called dry-process silica or fumed silica produced by vapor phase oxidation of silicon halides and what is called wet-process silica produced from water glass or the like. The dry-process silica is preferred, as having less silanol groups on the surfaces and insides of the fine silica particles and leaving less production residues.

What is particularly preferred is fine powder produced by vapor phase oxidation of a silicon halide, which is called the dry-process silica or fumed silica. For example, it utilizes heat decomposition oxidation reaction in oxyhydrogen frame of silicon tetrachloride gas. The reaction basically proceeds as follows.

$$SiCl_4+2H_2+O_2 \rightarrow SiO_2+4HCl$$

In this production step, it is also possible to use other metal halide such as aluminum chloride or titanium chloride together with the silicon halide to obtain a composite fine powder of silica with other metal oxide, and the silica used in the present invention includes these as well.

The fine silica particles may further preferably be those having been hydrophobic-treated. As methods for making hydrophobic, the fine silica powder may be made hydrophobic by chemical treatment with an organosilicon compound capable of reacting with or physically adsorptive on the fine silica powder. As a preferable method, the dry-process fine silica powder produced by vapor phase oxidation of a silicon halide may be treated with an organosilicon compound such as silicone oil after it has been treated with a silane compound or at the same time it is treated with a silane compound. With regard to the silane compound and the organosilicon compound, they are described later.

As a method for the treatment with silicone oil, a method may be employed in which the fine silica powder treated with a silane compound and the silicone-oil are directly mixed by means of a mixing machine such as Henschel mixer, or the silicone oil is sprayed on the fine silica powder serving as a base.

Besides, the silicone oil may be dissolved or dispersed in a suitable solvent and thereafter the base fine silica powder may be mixed, followed by removal of the solvent to prepare the treated product.

As preferable hydrophobic treatment of the fine silica powder, a method is available in which the fine silica powder is first treated with hexamethyldisilazane and then treated with silicone oil to prepare the treated product.

It is preferable to treat the fine silica powder with a silane compound and thereafter make treatment with silicone oil as described above, because its hydrophobicity can effectively be improved.

The above hydrophobic treatment made on the fine silica powder and further the treatment with silicone oil may also be made on fine titanium oxide powder. Such powder is also preferable like the silica type one.

In addition to the inorganic fine particles as described above (small-particle-diameter inorganic fine oxide particles), large-particle-diameter inorganic fine oxide particles may also be added in order to afford the function to reduce the load that is applied to the small-particle-diameter inorganic fine oxide particles when the toner and an agitation member, the toner and a developing sleeve, the toner and a developing blade, the toner and developing assembly inner walls, and the toner and the toner (toner particles themselves) come into contact with each other, to prevent the toner from deteriorating because the small-particle-diameter inorganic fine oxide particles come buried in toner base particle surfaces or come off the toner base particle surfaces.

In addition, in order to highly prevent the toner from deteriorating, make image quality higher without deterioration of image quality, and further keep a high transfer performance, it is important to control the relationship of particle diameter between the small-particle-diameter inorganic fine oxide particles and the large-particle-diameter inorganic fine oxide particles, the coverage of the both on toner base particle surfaces and further the relationship with the circularity of toner base particles.

It is preferable that first inorganic fine oxide particles A (small-particle-diameter particles) have a primary-particle number-average particle diameter of from 7 nm or more to less than 20 nm (more preferably from 10 nm or more to 15 nm or less), and coverage A of the inorganic fine oxide particles A on the toner base particles is from 0.5 to 2.0; second inorganic fine oxide particles B (large-particle-diameter particles) have a primary-particle number-average particle diameter of from 20 nm or more to 50 nm or less (more preferably from 30 nm or more to less than 40 nm), and coverage B of the inorganic fine oxide particles B on the toner base particles is from 0.02 to 0.15 (more preferably from 0.03 to 0.10); and difference in particle diameter between the inorganic fine oxide particles A and the inorganic fine oxide particles B is from 10 nm or more to 35 nm or less, and proportion X the inorganic fine oxide particles B hold with respect to the coverage of the whole inorganic fine oxide particles [={coverage B/(coverage A+coverage B)}×100] is from 1.0% to 14.0% (more preferably from 5.0% to 12.0%).

If the first, small-particle-diameter inorganic fine oxide particles A has a primary-particle number-average particle diameter of less than 7 nm, although the toner is improved in fluidity, running toner deterioration (coming buried in toner base particles) tend to occur, and, if more than 20 nm, no high fluidity can be attained, and no high image quality and no high transfer performance can be achieved.

The coverage A of the inorganic fine oxide particles A on the toner base particles may preferably be from 0.5 to 2.0 (more preferably from 0.8 to 1.5). If the coverage A is less than 0.5, no high fluidity can be attained. If it is more than 2.0, the fixing performance tends to become poor.

The coverage referred to in the present invention is the proportion of the sum total of projected areas of the inorganic fine oxide particles to the surface areas of the toner base particles, and is represented by the following expression.

$$\text{Coverage} = \left(\frac{w_A \cdot \pi r_A^2}{\rho_A \cdot \left(\frac{4}{3}\pi r_A^3\right)}\right) \div \left(\frac{W_T \cdot 4\pi R_T^2}{\rho_T \cdot \left(\frac{4}{3}\pi R_T^3\right)}\right) = \frac{w_A \times R_T \times \rho_T}{W_T \times r_A \times \rho_A \times 4}$$

(WA: the amount of inorganic fine oxide particles added; $r_A$: the average particle radius of primary-particle number-average particle diameter of inorganic fine oxide particles; $\rho_A$: the specific gravity of inorganic fine oxide particles; $W_T$: the quantity of toner; $R_T$: the number-base average particle radius of toner; and $\rho_T$: the specific gravity of toner).

If the second inorganic fine oxide particles B have a primary-particle number-average particle diameter of less than 20 nm, the difference in particle diameter with respect to the inorganic fine oxide particles A is so small as to cause the running toner deterioration (coming buried in toner base particles), and also makes it difficult to obtain the improvement in transfer performance and the effect of restraining toner scatter. If on the other hand it is more than 50 nm, the difference in particle diameter with respect to the inorganic fine oxide particles A is produced to tend to conversely accelerate the toner deterioration. This is presumed to be due to the fact that the simultaneous addition of substances having a difference in particle diameter brings about a difference in their adhesive force to toner base particles to tend to make them liberated from toner base particles or make small particles buried therein under conditions where large particles are made to adhere thereto. Also, this tendency is remarkable in toners which contain low-melting waxes often used for the sake of the low-temperature fixing performance (energy saving) that is sought in recent years. Moreover, if it is more than 50 nm, dot reproducibility tends to become poor because the fluidity of toner becomes poor, and at the same time the feeding of toner to the sleeve (developer carrying member) tends to deteriorate to tend to cause ghost seriously.

A more preferred embodiment of the present invention is that the difference in primary-particle number-average particle diameter between the first inorganic fine oxide particles A and the second inorganic fine oxide particles B is from 10 nm or more to 35 nm or less, preferably from 15 nm or more to 30 nm or less, and more preferably from 20 nm or more to 30 nm or less. If the difference in this diameter is less than 10 nm, the running toner deterioration (coming buried in toner base particles) tends to occur in the toner having the particle surface smoothness according to the present invention, also making it difficult to obtain the improvement in transfer performance and the effect of restraining toner scatter. If on the other hand the difference in this diameter is more than 35 nm, dot reproducibility tends to become poor because the fluidity of toner becomes poor, and at the same time the feeding of toner to the sleeve (developer carrying member) tends to deteriorate to tend to cause ghost seriously.

Further, if the coverage B of the inorganic fine oxide particles B in their external addition and on the toner base particles is less than 0.02, the running toner deterioration (coming buried in toner base particles) tends to occur, also making it difficult to obtain the improvement in transfer performance and the effect of restraining toner scatter. If on the other hand the coverage B of the inorganic fine oxide particles B on the toner base particles is more than 0.15, dot reproducibility tends to become poor because the fluidity of toner becomes poor, and at the same time the feeding of toner to the sleeve (developer carrying member) tends to deteriorate to tend to cause ghost seriously.

Still further, if the proportion X the inorganic fine oxide particles B hold with respect to the coverage of the whole inorganic fine oxide particles [={coverage B/(coverage A+coverage B)}×100] is less than 1.0%, the running toner deterioration (coming buried in toner base particles) tends to occur, also making it difficult to obtain the improvement in transfer performance and the effect of restraining toner scatter. If on the other hand it is more than 14.0%, dot reproducibility tends to become poor because the fluidity of toner becomes poor, and at the same time the feeding of toner to the sleeve (developer carrying member) tends to deteriorate to tend to cause ghost seriously.

In the present invention, it is a characteristic feature that the relationship between average circularity Y of the toner base particles and the proportion X the inorganic fine oxide particles B hold with respect to the coverage of the whole inorganic fine oxide particles [={coverage B/(coverage A+coverage B)}×100] satisfies the following expression.

$$(10\times10^{-3}\times X-0.925)\leqq Y\leqq(3.6\times10^{-3}\times X+0.915).$$

The use of the above constitution of external additives in the tone having such a circularity is effective in order to achieve the objects of the present invention.

The extent to which the toner undergoes deterioration depends on the circularity of the toner, because of the fluidity of that toner, the opportunity of friction and the packing of the toner. As a measure therefor, the proportion the inorganic fine oxide particles (fine silica particles) B hold with respect to the coverage of the whole inorganic fine oxide particles is specified. This makes it highly possible to prevent the toner from deterioration, also to maintain its fluidity appropriately, to improve transfer efficiency, and to remedy spots around line images and sleeve ghost.

If $(10\times10^{-3}\times X-0.925)>Y$, the running toner deterioration (coming buried in toner base particles) tends to occur and also the improvement in transfer performance and remedy of toner scatter that are aimed in the present invention can not highly be achieved.

If $Y<(3.6\times10^{-3}\times X+0.915)$, the toner may have a poor fluidity, and the improvement in dot reproducibility, transfer performance and remedy of toner scatter that are aimed in the present invention can not highly be achieved.

To the toner base particles of the present invention, other additives may optionally externally be added.

For example, they are fine resin particles or inorganic fine particles that function as a charge auxiliary agent, a conductivity-providing agent, a fluidity-providing agent, an anti-caking agent, a release agent at the time of heat roll fixing, a lubricant and an abrasive.

As the fine resin particles, those having an average particle diameter of from 0.03 μm to 1.0 μm are preferred. A polymerizable monomer constituting that resin may include monomers as exemplified by styrene; styrene derivatives such as o-methylstyrene, m-methylstyrene, p-methylstyrene, p-methoxystyrene and p-ethylstyrene; acrylic acid and methacrylic acid; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and acrylonitrile, methacrylonitrile and acrylamides.

As a polymerization process, it may include suspension polymerization, emulsion polymerization and soap-free polymerization. More preferably, resin particles obtained by soap-free polymerization are favorable.

Other inorganic fine particles may include lubricants such as polyfluoroethylene powder, zinc stearate powder and polyvinylidene fluoride powder (in particular, polyvinylidene fluoride powder is preferred); abrasives such as cerium oxide powder, silicon carbide powder and strontium titanate powder (in particular, strontium titanate powder is preferred); fluidity-providing agents such as titanium oxide powder and aluminum oxide powder (in particular, hydrophobic one is preferred); anti-caking agents; and conductivity-providing agents such as carbon black, zinc oxide powder, antimony oxide powder and tin oxide powder. White fine particles and black fine particles having polarity opposite to that of the toner may also be used as a developing performance improver in a small quantity.

The inorganic fine particles or fine resin particles blended with the toner base particles may preferably be used in an amount of from 0.01 to 5 parts by weight, and preferably from 0.01 to 3 parts by weight, based on 100 parts by weight of the toner base particles.

In the present invention, both the small-particle-diameter inorganic fine particles and the large-particle-diameter inorganic fine particles may be dry-process silica. This is particularly preferable from the viewpoint of the readiness to blend the both uniformly and carry out hydrophobic treatment and the readiness to provide the toner with chargeability and fluidity.

As the inorganic fine particles according to the present invention, those having been treated with, in particular, a silane compound or a silicone oil are preferred, of which those having been treated with the both are particularly preferred. That is, the surface treatment with such two types of treating agents enables the particles to have hydrophobicity distribution having been made uniform to high hydrophobicity, and also to be treated homogeneously to afford superior fluidity, uniform chargeability, and moisture resistance, so that toner can be provided with good developing performance, in particular, developing performance in an environment of high humidity, and running stability.

The silane compound may include alkoxysilanes such as methoxysilane, ethoxysilane and propoxysilane, halosilanes such as chlorosilane, bromosilane and iodosilane, silazanes, hydrosilanes, alkylsilanes, arylsilanes, vinylsilanes, acrylsilanes, epoxysilanes, silyl compounds, siloxanes, silylureas, silylacetamides, and silane compounds having together a different kind of substituent any of these silane compounds have. The use of any of these silane compounds can achieve fluidity, transfer performance and charge stabilization. Any of these silane compounds may be used in plurality.

As specific examples thereof, the silane compound may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals. Any of these may be used alone or in the form of a mixture of two or more types.

In the present invention, as the organosilicon compound, silicone oil is preferred, which may include reactive silicone oils such as amino modified silicone oil, epoxy modified silicone oil, carboxyl modified silicone oil, carbinol modified silicone oil, methacryl modified silicone oil, mercapto modified silicone oil, phenol modified silicone oil and heterofunctional group modified silicone oil; non-reactive silicone oils such as polyether modified silicone oil, methyl styryl modified silicone oil, alkyl modified silicone oil, fatty acid modified silicone oil, alkoxyl modified silicone oil and fluorine modified silicone oil; and straight silicone oils such as dimethylsilicone oil, methylphenylsilicone oil, diphenylsilicone oil and methylhydrogensilicone oil.

Of these silicone oils, preferred is a silicone oil having as a substituent an alkyl group, an aryl group, an alkyl group part or the whole of hydrogen atoms of which is/are substituted with a fluorine atom or atoms, or a hydrogen atom. Stated specifically, it includes dimethylsilicone oil, methylphenylsilicone oil, methylhydrogensilicone oil and fluorine modified silicone oil.

These silicone oils may preferably have a viscosity at 25° C. of from 5 to 2,000 $mm^2/s$, more preferably from 10 to 1,000 $mm^2/s$, and still more preferably from 30 to 100 $mm^2/s$. If it is less than 5 $mm^2/s$, no sufficient hydrophobicity can be obtained in some cases. If it is more 2,000 $mm^2/s$, it may become difficult to make uniform treatment when the inorganic fine particles are treated, or agglomerates tend to be produced and no sufficient fluidity can be obtained in some cases.

Those having been treated with a silane compound containing nitrogen may also be used as the hydrophobic inorganic fine particles in the present invention, which are preferred especially when used in positive toners. As examples of such a treating agent, it may include aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyldimethoxysilane, dibutylaminopropylmonomethoxysilane, dimethylaminophenyltriethoxysilane, trimethoxylsilyl-γ-propylphenylamine, trimethoxylsilyl-γ-propylbenzylamine, trimethoxylsilyl-γ-propylpiperidine, trimethoxylsilyl-γ-propylmorpholine, and trimethoxylsilyl-γ-propylimidazole. Any of these treating agents may be used alone or in the form of a mixture of two or more types, or after their multiple treatment.

As still other organic treatment, the inorganic fine particles may also be treated with a silicone oil having a nitrogen atom in the side chain. This is preferred especially when used in positive toners. Such a silicone oil includes a silicone oil having at least a unit structure(s) represented by the following formula(s) (3) and/or (4).

(3)

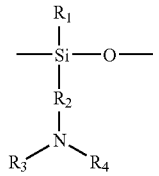

and/or (4)

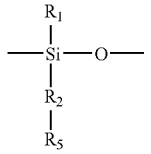

wherein $R_1$ represents a hydrogen atom, an alkyl group, an aryl group or an alkoxyl group; $R_2$ represents an alkylene group or a phenylene group; $R_3$ and $R_4$ each represent a hydrogen atom, an alkyl group or an aryl group; and $R_5$ represents a nitrogen-containing heterocyclic ring group.

Incidentally, the above alkyl group, aryl group, alkylene group and phenylene group may also have an organo group having a nitrogen atom, or may have a substituent such as a halogen atom.

Any of these silicone oils may be used alone or in the form of a mixture of two or more types, or after their multiple treatment. Any of these may also be used in combination with treatment with the silane compound.

The treatment of the inorganic fine particles with the silane compound may be carried out by a commonly known method such as dry treatment in which inorganic fine particles made into cloud by agitation is allowed to react with a vaporized silane compound, or wet treatment in which inorganic fine particles are dispersed in a solvent and the silane compound is added dropwise thereto to carry out reaction.

The treatment of the inorganic fine particles with the silane compound may preferably be carried out by adding the treating agent in an amount of from 5 to 40 parts by weight, more preferably from 5 to 35 parts by weight, an still more preferably from 10 to 30 parts by weight, based on 100 parts by weight of the base material inorganic fine particles.

The treatment with oil may be in an amount of from 3 to 35 parts by weight based on 100 parts by weight of the base material inorganic fine particles. Such treatment is preferable because the treated particles may readily uniformly be dispersed when added to toner base particles and the density decrease in a high-temperature and high-humidity environment can not easily occur.

Especially in the present invention, particularly preferably used are hydrophobic inorganic fine particles having been hydrophobic-treated with hexamethyldisilazane and thereafter further hydrophobic-treated with silicone oil. The treatment with hexamethyldisilazane is superior in the uniformity of treatment, and can provide a toner having a good fluidity. It, however, is not easy for the treatment with hexamethyldisilazane alone to make the charging stable in a high-temperature and high-humidity environment. On the other hand, the treatment with silicone oil can keep the charging high in the high-temperature and high-humidity environment, but makes it difficult to carry out uniform treatment, and may require the silicone oil in a large quantity in an attempt to carry out uniform treatment, tending to result in a poor fluidity. The treatment with hexamethyldisilazane and subsequent further treatment with silicone oil enables uniform treatment in a small oil quantity, and hence enables achievement of both the high fluidity and the charging stability in high-temperature and high-humidity environment.

The hydrophobic inorganic fine particles of the present invention may be hydrophobic-treated, e.g., in the following way.

The base materials for the small-particle-diameter inorganic fine particles and large-particle-diameter inorganic fine particles are premixed in any desired weight ratio by means of a mixing machine such as Henschel mixer, and the mixture obtained is put into a treating tank, or they are directly put into a treating tank in any desired weight ratio without being premixed. The materials in the treating tank are mechanically agitated by means of an agitation blade or air-agitated to mix the small-particle-diameter inorganic fine particles and the large-particle-diameter inorganic fine particles, during which the hexamethyldisilazane is dropwise added, or sprayed, in a stated quantity, and is thoroughly mixed. Here, the hexamethyldisilazane may be diluted with a solvent such as alcohol to carry out treatment. The base material inorganic fine particles thus mixed and dispersed and containing the treating agent stand a powder liquid formed. This powder liquid is heated to a temperature not lower than the boiling point of the hexamethyldisilazane (preferably from 150° C. to 250° C.) in an atmosphere of nitrogen, and refluxed for 0.5 to 5 hours with stirring. Thereafter, any surplus matter such as a surplus treating agent may optionally be removed.

As a method by which the surfaces of the base material inorganic fine particles is hydrophobic-treated with the silicone oil, any known technique may be used. For example, like the treatment with hexamethyldisilazane, the base materials for the small-particle-diameter inorganic fine particles and large-particle-diameter inorganic fine particles are premixed in any desired weight ratio by means of a mixing machine such as Henschel mixer, and the mixture obtained is put into a treating tank, or they are directly put into a treating tank in any desired weight ratio without being premixed. The materials in the treating tank are mechanically agitated by means of an agitation blade or air-agitated to mix the small-particle-diameter inorganic fine particles and the large-particle-diameter inorganic fine particles, during which these inorganic fine particles and the silicone oil are mixed. The mixing with the silicone oil may be direct mixing carried out using a mixing machine such as Henschel mixer, or a method may be used in which the silicone oil is sprayed on the base material inorganic fine particles. Alternatively, the silicone oil may be dissolved or dispersed in a suitable solvent, and thereafter this may be mixed with the base material inorganic fine particles, followed by removal of the solvent to prepare the treated product.

In the case when treated with both the silane compound and the silicone oil, a method may preferably be used in which the base material inorganic fine particles are treated with the silane compound and thereafter the silicone oil is sprayed, followed by heat treatment at 200° C. or more.

As a method used favorably in producing the hydrophobic inorganic fine particles used in the present invention, it is a method in which the small-particle-diameter inorganic fine particles and the large-particle-diameter inorganic fine particles in any combination selected from any of i) untreated small-particle-diameter inorganic fine particles and untreated large-particle-diameter inorganic fine particles, ii) untreated small-particle-diameter inorganic fine particles and silane compound treated large-particle-diameter inorganic fine particles, iii) silane compound treated small-particle-diameter inorganic fine particles and untreated large-particle-diameter inorganic fine particles, and iv) silane compound treated small-particle-diameter inorganic fine particles and silane compound treated large-particle-diameter inorganic fine particles, are treated in the same treating tank to treat them simultaneously with the silane compound or silicone oil, or with both the silane compound and the silicone oil.

In particular, from the viewpoint of uniform mixing of the small-particle-diameter inorganic fine particles and the large-particle-diameter inorganic fine particles, the combination of untreated small-particle-diameter inorganic fine particles and untreated large-particle-diameter inorganic fine particles is most preferred.

As a method for carrying out the hydrophobic treatment to obtain the hydrophobic inorganic fine particles according to the present invention, a batch treatment method is preferable in which the base materials small-particle-diameter inorganic fine particles and large-particle-diameter inorganic fine particles are put into a batch in stated quantities, and these are agitated at a high speed to uniformly mix the base materials small-particle-diameter inorganic fine particles and large-particle-diameter inorganic fine particles, where the treatment of the mixture is carried out in the batch while being mixed. The hydrophobic inorganic fine particles thus obtained by the batch treatment method can be obtained in a good reproducibility as those having uniformly been treated and being stable in respect of quality as well.

What is particularly preferable as the hydrophobic treatment method is a method in which untreated small-particle-diameter inorganic fine particles and untreated large-particle-diameter inorganic fine particles are treated with the silane compound in a batch type treating tank, and thereafter the treated product is, without being taken out, further treated with the silicone oil in the same treating tank. This method is advantageous in view of uniform treatment and uniform dispersion.

In the present invention, of the inorganic fine particles having been hydrophobic-treated in this way, it is preferable to use hydrophobic inorganic fine particles having a methanol wettability of 60% or more, preferably 70% or more, and more preferably 75% or more. The methanol wettability represents the hydrophobicity (the degree of making hydrophobic) of the hydrophobic inorganic fine particles. It shows that, the higher the methanol wettability is, the higher the hydrophobicity is. If the hydrophobic inorganic fine particles have a methanol wettability of less than 60%, the hydrophobic inorganic fine particles tend to absorb moisture, and hence density decrease due to a decrease of charge quantity tends to occur when the toner is used over a long period of time in a high-temperature and high-humidity environment.

In the hydrophobic inorganic-fine particles used in the present invention, no shoulder is present in the methanol drop transmittance curve. This shows that the small-particle-diameter inorganic fine particles and large-particle-diameter inorganic fine particles contained in the hydrophobic inorganic fine particles stand uniformly mixed on the level of primary particles, without being segregated from each other, and also that the hydrophobic treatment as well has no difference in treatment which may otherwise be produced depending on the particle diameters of the inorganic fine particles, and individual particles have uniformly been treated. If a shoulder is present in the methanol drop transmittance curve, the hydrophobic treatment may come non-uniform, or the small-particle-diameter inorganic fine particles and the large-particle-diameter inorganic fine particles are not uniformly mixed, so that it may be difficult to make them dispersed on the level of primary particles when added to toner base particles, resulting in unstable charge of the toner to cause fog greatly, or causing density decrease as a result of long-term service, undesirably.

The hydrophobic inorganic fine particles of the present invention are applicable in any toners such as color toners, monochrome toners and magnetic toners. In regard to developing systems as well, the effect is obtainable in any developing systems such as two-component development and magnetic one-component development.

In particular, the hydrophobic inorganic fine particles of the present invention may particularly preferably be used in an image forming method making use of a developer carrying member and a toner layer thickness control member which is kept in contact with the developer carrying member to control toner layer thickness. They further exhibit an especially superior effect when added to a toner used in an image forming method in which the process speed is 300 mm/second or more. In controlling the toner layer thickness in contact with the developer carrying member, the toner is strongly pressed against the developer carrying member by the toner layer thickness control member, and hence the mechanical load applied to the toner is very large. Especially in the case in which the process speed is 300 mm/second or more, the contact portion locally fairly rises in temperature because of friction. Hence, the toner is also rubbed in the state of high temperature, so that the inorganic fine particles adhering to the surfaces of toner base particles tend to be buried, and the toner may deteriorate to cause density decrease. The hydrophobic inorganic fine particles used in the present invention may readily uniformly be dispersed on the surfaces of toner base particles, and the effect of preventing deterioration that is attributable to the large-particle-diameter inorganic fine particles may readily be exhibited. Hence, the present invention can deal with a developing assembly having been made high-speed which has the toner layer thickness control member kept in contact with the developer carrying member to control toner layer thickness.

The toner of the present invention may preferably have a weight-average particle diameter of from 2.5 μm to 10.0 μm, more preferably from 5.0 μm to 9.0 μm, and still more preferably from 6.0 μm to 8.0 μm. In this case, superior technical advanatges can be shown.

The weight-average particle diameter and particle size distribution of the toner are measured by the Coulter counter method. For example, Coulter Multisizer (manufactured by Coulter Electronics, Inc.) may be used. As an electrolytic solution, an aqueous 1% NaCl solution is prepared using first-grade sodium chloride. For example, ISOTON R-II (available from Coulter Scientific Japan Co.) may be used. Measurement is made by adding as a dispersant 0.1 to 5 ml of a surface active agent (preferably an alkylbenzene-sulfonate) to 100 to 150 ml of the above aqueous electrolytic solution, and further adding 2 to 20 mg of a sample for measurement. The electrolytic solution in which the sample has been suspended is subjected to dispersion for about 1 minute to about 3 minutes in an ultrasonic dispersion machine. The volume distribution and number distribution of the toner are calculated by measuring the volume and number of toner particles of 2.00 μm or larger diameter by means of the above measuring instrument, using an aperture of 100 μm as its aperture. Then the weight-base, weight average particle diameter (D4) according to the present invention, determined from the volume distribution, is calculated. As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

The toner of the present invention may be used in combination with a carrier so as to be used as a two-component developer. As the carrier used in two-component development, a conventionally known carrier may be used. Stated specifically, usable as the carrier are particles formed of a metal such as iron, nickel, cobalt, manganese, chromium or a rare earth element, or an alloy or an oxide thereof, having been surface-oxidized or unoxidized, and having an average particle diameter of from 20 μm to 300 μm.

Preferred is a carrier on the particle surfaces of which a material such as a styrene resin, an acrylic resin, a silicone resin, a fluorine resin or a polyester resin has been deposited or coated.

The toner base particles according to the present invention are obtained by melt-kneading a composition containing the binder resin, the magnetic material and optionally other components (kneading step), and pulverizing the kneaded product obtained (pulverization step). Constituent materials of the toner base particles may preferably be well premixed by means of a ball mill or any other mixing machine, followed by kneading using a heat kneading machine. The pulverization step may also be divided into a crushing step and a fine grinding step. Also, as a post step thereof, classification may be carried out (classification step). Further, in order to satisfy the average circularity and average surface roughness of the toner base particles and toner particles according to the present invention, it is preferable to modify the toner base particle surfaces by means of the surface modifying apparatus in the manner described previously. In particular, it is preferable to carry out the surface modification after the classification step. It is also preferable to carry out the removal of fine powder and the surface modification simultaneously.

Where the toner particles are produced through the kneading step as in the present invention, the constituent materials of the toner base particles can uniformly and finely be dispersed in the particles. Also, since the kneaded product in which the constituent materials have well been dispersed is pulverized, the constituent materials can favorably be distributed at the toner base particle surfaces, so that the effect attributable to the toner base particles having the specific average surface roughness and average circularity that are characteristic of the present invention can sufficiently be brought out. Where the toner base particles are produced not through the kneading step and classification step, it is difficult to control the distribution of constituent materials at the toner base particle surfaces, and no sufficient effect can be brought out even if the toner base particles have proper average surface roughness and average circularity. For example, where the toner base particles are produced by emulsion agglomeration, functional groups having hydrophilicity may inevitably come present at toner base particle surfaces in a large quantity to make it difficult to control the charging performance and fluidity of the toner particles, and make it difficult to achieve both the reduction of toner consumption and the good developing performance.

As the mixing machine, it may include, e.g., Henschel Mixer (manufactured by Mitsui Mining & Smelting Co., Ltd.); Super Mixer (manufactured by Kawata MFG Co., Ltd.); Conical Ribbon Mixer (manufactured by Y.K. Ohkawara Seisakusho); Nauta Mixer, Turbulizer, and Cyclomix (manufactured by Hosokawa Micron Corporation); Spiral Pin Mixer (manufactured by Pacific Machinery & Engineering Co., Ltd.); and Rhedige Mixer (manufactured by Matsubo Corporation). As the kneading machine, it may include KRC Kneader (manufactured by Kurimoto, Ltd.); Buss-Kneader (manufactured by Coperion Buss Ag.); TEM-type Extruder (manufactured by Toshiba Machine Co., Ltd.); TEX Twin-screw Extruder (manufactured by The Japan Steel Works, Ltd.); PCM Kneader (manufactured by Ikegai Corp.); Three-Roll Mill, Mixing Roll Mill, and Kneader (manufactured by Inoue Manufacturing Co., Ltd.); Kneadex (manufactured by Mitsui Mining & Smelting Co., Ltd.); MS-type Pressure Kneader, and Kneader-Ruder (manufactured by Moriyama Manufacturing Co., Ltd.); and Banbury Mixer (manufactured by Kobe Steel, Ltd.).

As the grinding machine, it may include Counter Jet Mill, Micron Jet, and Inomizer (manufactured by Hosokawa Micron Corporation); IDS-type Mill, and PJM Jet Grinding Mill (manufactured by Nippon Pneumatic MFG Co., Ltd.); Cross Jet Mill (manufactured by Kurimoto, Ltd.); Ulmax (manufactured by Nisso Engineering Co., Ltd.); SK Jet O-Mill (manufactured by Seishin Enterprise Co., Ltd.); Criptron (manufactured by Kawasaki Heavy Industries, Ltd); Turbo Mill (manufactured by Turbo Kogyo Co., Ltd.); and Super Rotor (manufactured by Nisshin Engineering Inc.). As the classifier, it may include Classyl, Micron Classifier, and Spedic Classifier (manufactured by Seishin Enterprise Co., Ltd.); Turbo Classifier (manufactured by Nisshin Engineering Inc.); Micron Separator, Turboprex (ATP), and TSP Separator (manufactured by Hosokawa Micron Corporation); Elbow Jet (manufactured by Nittetsu Mining Co., Ltd.); Dispersion Separator (manufactured by Nippon Pneumatic MFG Co., Ltd.); and YM Microcut (manufactured by Yasukawa Shoji K.K.). As a sifter used to sieve coarse powder and so forth, it may include Ultrasonics (manufactured by Koei Sangyo Co., Ltd.); Rezona Sieve and Gyro Sifter (manufactured by Tokuju Corporation); Vibrasonic Sifter (manufactured by Dulton Company Limited); Sonicreen (manufactured by Shinto Kogyo K.K.); Turbo-Screener (manufactured by Turbo Kogyo Co., Ltd.); Microsifter (manufactured by Makino mfg. co., ltd.); and circular vibrating screens.

EXAMPLES

The present invention is described below by giving Examples. The present invention is by no means limited to these Examples.

Examples I-1 to I-8 & Comparative Examples I-1 to I-7

Binder resins used are shown in Table 1, magnetic materials in Table 2, and waxes in Table 3.

TABLE 3

| | Type | Melting point (° C.) | Number-average molecular weight | Weight-average molecular weight |
|---|---|---|---|---|
| Wax I-1 | Paraffin | 76 | 380 | 500 |
| Wax I-2 | Fischer-Tropsch | 105 | 790 | 1,180 |
| Wax I-3 | Polyethylene | 120 | 2,250 | 3,390 |
| Wax I-4 | Polypropylene | 145 | 1,000 | 8,880 |

Preparation of Toner I-1

| | (by weight) |
|---|---|
| Binder Resin I-1 | 100 parts |
| Magnetic Material I-1 | 95 parts |
| Monoazo iron complex (T-77, available from Hodogaya Chemical Co., Ltd.) | 2 parts |
| Wax I-1 | 4 parts |

The above materials were premixed by means of Henschel mixer, and thereafter the mixture obtained was melt-kneaded by means of a twin-screw kneader heated to 110° C. The kneaded product obtained and having been cooled was crushed by means of a hammer mill to obtain a toner material crushed product. The crushed product obtained was finely pulverized by mechanical pulverization using a mechanical grinding machine Turbo Mill (manufactured by Turbo Kogyo Co., Ltd.; the surfaces of its rotor and stator were coated by plating of a chromium alloy containing chromium carbide (plating thickness: 150 μm; surface hardness: HV 1,050)), controlling air temperature under condi

TABLE 1

| | Composition | Tg (° C.) | Peak molecular weight | Number = average molecular weight Mn | Weight = average molecular weight Mw |
|---|---|---|---|---|---|
| Binder Resin I-1 | Styrene-butyl acrylate-acrylic acid copolymer (weight ratio: 78/21/1) | 62.1 | 13,500 | 8,500 | 74,000 |
| Binder Resin I-2 | Styrene-butyl acrylate-monobutyl maleate copolymer (weight ratio: 70/20/10) | 60.3 | 18,000 | 7,900 | 350,000 |
| Binder Resin I-3 | Polyester resin obtained by condensation-polymerizing bisphenol-A propylene oxide adduct (2 mol added) , bisphenol-A ethylene oxide adduct (2 mol added), terephthalic acid and trimellitic anhydride (mol ratio: 31/13/39/17) | 58.5 | 7,000 | 5,000 | 600,000 |

TABLE 2

| Composition | Si content (wt. %) | Number = average particle diameter (μm) | BET specific surface area | Coercive force Hc (kA/m) | Saturation magnetization σs ($Am^2/kg$) | Residual magnetization σr ($Am^2/kg$) |
|---|---|---|---|---|---|---|
| Magnetic Material: | | | | | | |
| I-1 Magnetic iron oxide | 1.0 | 0.19 | 9.2 | 5.7 | 85.0 | 5.5 |
| I-2 Magnetic iron oxide | 0.0 | 0.22 | 12.3 | 7.3 | 88.3 | 8.7 |

tions shown in Table 4. The finely pulverized product thus obtained was classified by means of a multi-division classifier utilizing the Coanda effect (Elbow Jet Classifier, manufactured by Nittetsu Mining Co., Ltd.) to classify and remove fine powder and coarse powder simultaneously. As to the untreated toner base particles thus obtained, the weight-average particle diameter (D4) measured by the Coulter Counter method was 6.6 μm, and the cumulative value of number-average distribution of toner base particles of less than 4 μm in diameter was 25.2%.

The untreated toner base particles were put to the surface modifying apparatus shown in FIG. 1, to carry out surface modification and removal of fine powder. In that treatment, in this Example, sixteen (16) rectangular disks were provided at the upper part of the dispersing rotor, the space (gap) between the guide ring and the rectangular disks on the dispersing rotor was set to 60 mm, and the space (gap) between the dispersing rotor and the liners to 4 mm. Also, the rotational peripheral speed of the dispersing rotor was set to 140 mr/sec, and the blower air feed rate to 30 $m^3$/min. The feed rate of the finely pulverized product was set to 300 kg/hr, and the cycle time to 45 sec. The temperature of the refrigerant let to run through the jacket was set to −15° C., and the cold-air temperature T1 to −20° C. Still also, the number of revolutions of the dispersing rotor was so controlled that the percentage of particles of from 0.6 μm or more to less than 3 μm in diameter came to the desired value. Through the foregoing steps, Toner Base Particles I-1 were obtained, whose weight-average particle diameter (D4) measured by the Coulter Counter method was 6.8 μm and the cumulative value of number-average distribution of toner base particles of less than 4 μm in diameter was 18.1%. As to Toner Base Particles I-1, the physical properties measured with FPIA-2100, the values of methanol concentrations with respect to transmittance of 780 nm wavelength light and the values measured with a scanning probe microscope are shown in Table 5, and the methanol concentration—transmittance curve is shown in FIG. 3.

100 parts by weight of this toner base particles and 1.2 parts by weight of hydrophobic fine silica powder having been treated with hexamethyldisilazane and then with dimethylsilicone oil were mixed by means of Henschel mixer to prepare Toner I-1 (toner particles).

As to this Toner I-1, the average circularity of the toner particles having a circle-equivalent diameter of from 3 μm or more to 400 μm or less as measured with FPIA-2100 was 0.947, and the average surface roughness measured with a scanning probe microscope was 19.1 nm.

Preparation of Toners I-2 to I-8

Toner Base Particles I-2 to I-8 and Toners I-2 to I-8 were obtained in the same manner as Toner I-1 except that the binder resin, magnetic material and wax used were as shown in Table 4, further the fine grinding conditions of Turbo Mill were changed as shown in Table 4, the classification conditions in the multi-division classifier were changed, and further the conditions of the surface modifying apparatus were set as shown in Table 4. As to Toner Base Particles I-2 to I-8, the physical properties measured with FPIA-2100, the values of methanol concentrations with respect to transmittance of 780 nm wavelength light and the values measured with a scanning probe microscope are shown in Table 5.

Preparation of Toner I-9

Toner Base Particle I-9 and Toner I-9 were obtained in the same manner as Toner I-1 except that the binder resin, magnetic material and wax used were as shown in Table 4, further the fine grinding conditions of Turbo Mill were changed as shown in Table 4, the classification conditions in the multi-division classifier were changed, and the toner base particles obtained were treated by making them pass through hot air of 300° C. instantaneously. As to Toner Base Particle I-9, the physical properties measured with FPIA-2100, the values of methanol concentrations with respect to transmittance of 780 nm wavelength light and the values measured with a scanning probe microscope are shown in Table 5.

As to this Toner I-9, the average circularity of the toner particles having a circle-equivalent diameter of from 3 μm or more to 400 μm or less as measured with FPIA-2100 was 0.973, and the average surface roughness measured with a scanning probe microscope was 3.7 nm.

Preparation of Toner I-10

Toner Base Particle I-10 and Toner I-10 were obtained in the same manner as Toner I-1 except that the binder resin, magnetic material and wax used were as shown in Table 4, further the fine grinding conditions of Turbo Mill were changed as shown in Table 4, the classification conditions in the multi-division classifier were changed, and further the surface modification using the surface modifying apparatus was not carried out. As to Toner Base Particle I-10, the physical properties measured with FPIA-2100, the values of methanol concentrations with respect to transmittance of 780 nm wavelength light and the values measured with a scanning probe microscope are shown in Table 5.

Preparation of Toner I-11

Toner Base Particle I-11 and Toner I-11 were obtained in the same manner as Toner I-1 except that the binder resin, magnetic material and wax used were as shown in Table 4, a jet stream grinding machine was used in place of the mechanical grinding machine, further the classification conditions in the multi-division classifier were changed, and the toner base particles obtained were treated by making them pass through hot air of 300° C. instantaneously. As to Toner Base Particle I-11, the physical properties measured with FPIA-2100, the values of methanol concentrations with respect to transmittance of 780 nm wavelength light and the values measured with a scanning probe microscope are shown in Table 5.

Preparation of Toner I-12

Toner Base Particle I-12 and Toner I-12 were obtained in the same manner as Toner I-1 except that the binder resin, magnetic material and wax used were as shown in Table 4, a jet stream grinding machine was used in place of the mechanical grinding machine, the classification conditions in the multi-division classifier were changed, and further the surface modification using the surface modifying apparatus was not carried out. As to Toner Base Particle I-12, the physical properties measured with FPIA-2100, the values of methanol concentrations with respect to transmittance of 780 nm wavelength light and the values measured with a scanning probe microscope are shown in Table 5.

Preparation of Toner I-13

Toner Base Particle I-13 and Toner I-13 were obtained in the same manner as Toner I-1 except that the binder resin, magnetic material and wax used were as shown in Table 4, a jet stream grinding machine was used in place of the mechanical grinding machine, further the classification conditions in the multi-division classifier were changed, and the toner base particles obtained were treated by making them pass through hot air of 300° C. instantaneously. As to Toner Base Particle I-13, the physical properties measured with FPIA-2100, the values of methanol concentrations with respect to transmittance of 780 nm wavelength light and the values measured with a scanning probe microscope are shown in Table 5.

Preparation of Toner I-14

Toner Base Particle I-14 and Toner I-14 were obtained in the same manner as Toner I-1 except that the binder resin, magnetic material and wax used were as shown in Table 4, a jet stream grinding machine was used in place of the mechanical grinding machine, the classification conditions in the multi-division classifier were changed, and further the surface modification using the surface modifying apparatus was not carried out. As to Toner Base Particle I-14, the physical properties measured with FPIA-2100, the values of methanol concentrations with respect to transmittance of 780 nm wavelength light and the values measured with a scanning probe microscope are shown in Table 5.

Preparation of Toner I-15

| | (by weight) |
|---|---|
| Binder Resin I-1 | 100 parts |
| Magnetic Material I-1 | 95 parts |
| Monoazo iron complex (T-77, available from Hodogaya Chemical Co., Ltd.) | 2 parts |
| Wax I-1 | 4 parts |

The above materials were premixed by means of Henschel mixer. Thereafter, the mixture obtained was melt-kneaded by means of a twin-screw kneader heated to 110° C. The kneaded product obtained and having been cooled was crushed by means of a hammer mill to obtain a toner material crushed product. The crushed product obtained was finely pulverized by mechanical pulverization using a mechanical grinding machine Turbo Mill (manufactured by Turbo Kogyo Co., Ltd.; the surfaces of its rotor and stator were coated by plating of a chromium alloy containing chromium carbide (plating thickness: 150 μm; surface hardness: HV 1,050)), controlling air temperature under conditions shown in Table 4. The finely pulverized product thus obtained was classified by means of a multi-division classifier utilizing the Coanda effect (Elbow Jet Classifier, manufactured by Nittetsu Mining Co., Ltd.) to classify and remove fine powder and coarse powder simultaneously. As to the untreated toner base particles before treatment obtained here, the weight-average particle diameter (D4) measured by the Coulter Counter method was 6.8 μm, and the cumulative value of number-average distribution of toner base particles of less than 4 μm in diameter was 15.2%.

Figure 5:
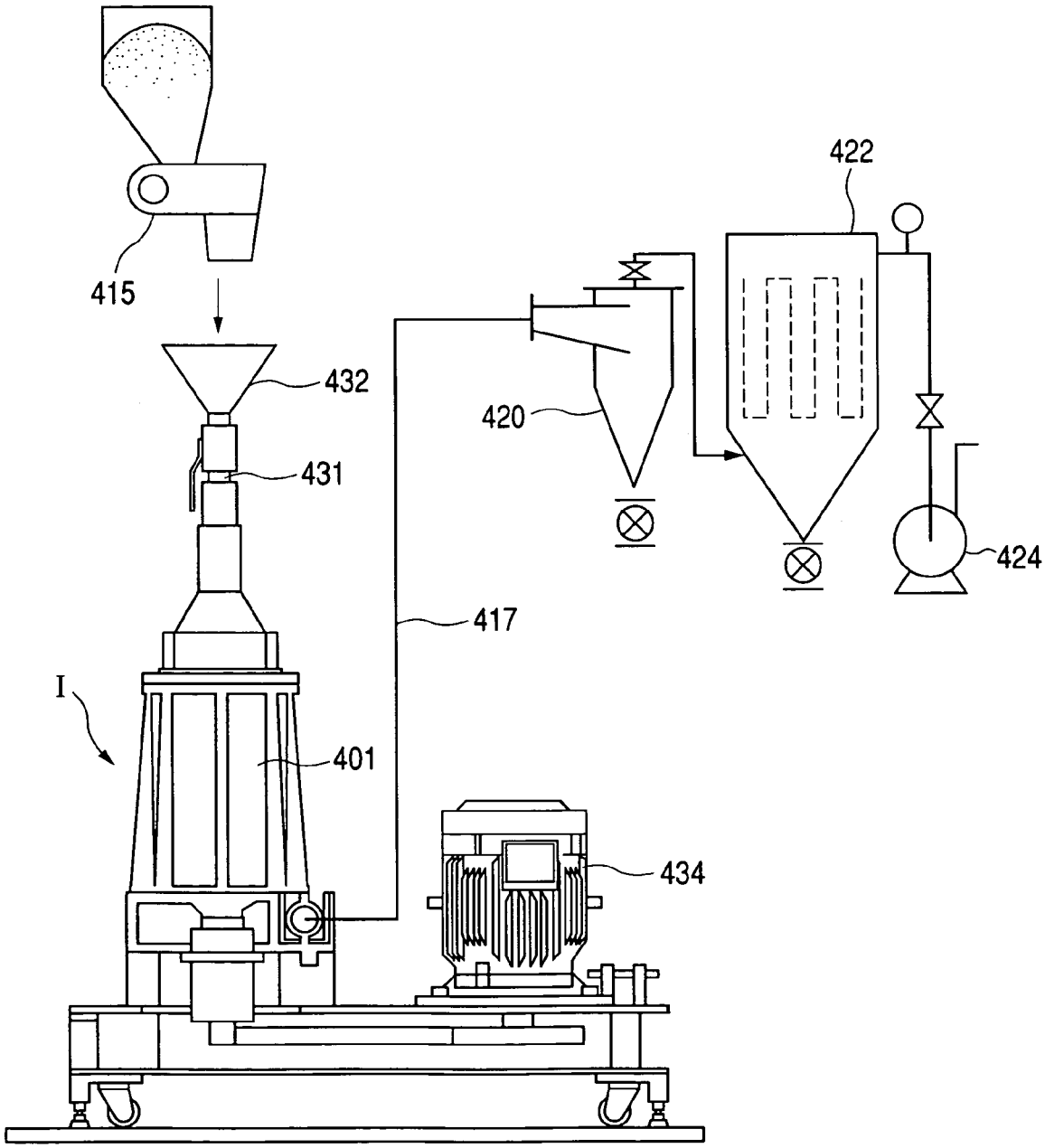
FIG. 5 is a schematic outline view of a surface treatment apparatus system used in Comparative Example.

The toner base particles thus obtained was surface-modified through a surface treatment step in which the particles were passed through the interior of a surface modifying apparatus shown in FIG. 5, which applies mechanical impact force continuously.

Figure 6:
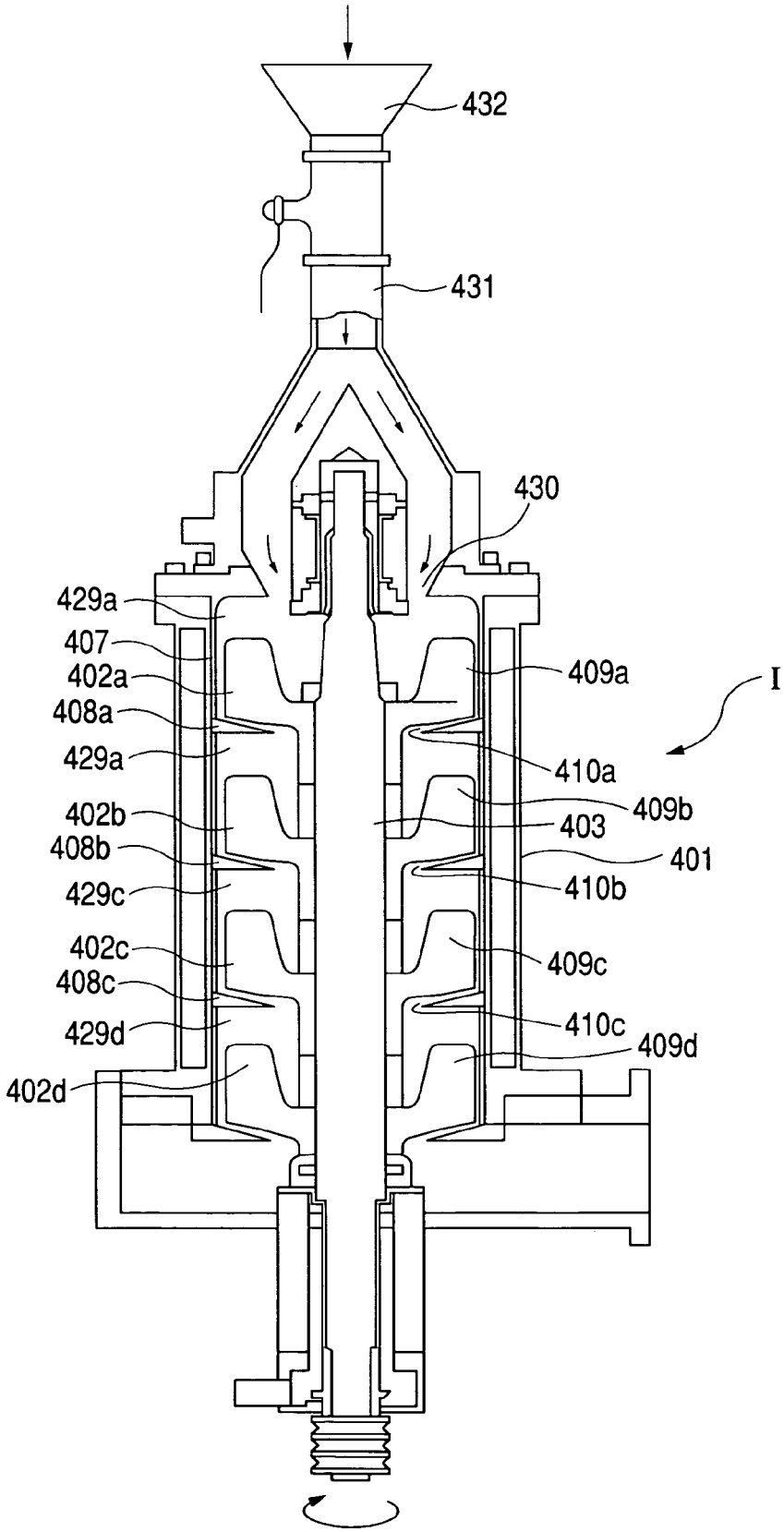
FIG. 6 is a schematic sectional view of the surface treatment apparatus shown in FIG. 5.

The surface treatment (surface modification) carried out using this apparatus is briefly described with reference to FIGS. 5 and 6. FIG. 5. is a diagrammatic schematic structural view showing the structure of a surface modifying apparatus system. FIG. 6 is a diagrammatic partial sectional view showing the structure of a treatment section 401 of a surface modifying apparatus I. This surface modifying apparatus is an apparatus in which toner base particles are pressed against the inner wall of a casing by centrifugal force by means of high-speed rotating blades to repeatedly apply at least a thermomechanical impact force produced by compression and frictional force, to carry out surface treatment of the toner base particles. As shown in FIG. 6, the treatment section 401 has four rotors 402*a*, 402*b*, 402*c* and 402*d* which are vertically set up. These rotors 402*a* to 402*d* are rotated by rotating a rotary drive shaft 403 by means of an electric motor 434 in such a way that the peripheral speed at the outermost edges is 30 to 60 m/sec. A suction blower 424 is further operated to suck air at a flow that is equal to, or larger than, the air flow generated by the rotation of blades 409*a* to 409*d* provided integrally with the respective rotors 402*a* to 402*d*.

The toner base particles are suction-introduced from a feeder 415 into a hopper 432 together with air. The toner base particles thus introduced are passed through a powder feed pipe 431 and a powder feed opening 430 and introduced to the center of a first cylindrical treatment chamber 429*a*. Here, the toner base particles are surface-treated in the first cylindrical treatment chamber 429*a* by means of the blade 409*a* and a sidewall 407. Then, the toner base particles having been surface-treated are passed through a first powder discharge opening 410*a* provided at the center of a guide plate 408*a*, and introduced to the center of a second cylindrical treatment chamber 429*b*, and are further spherical-treated by means of the blade 409*b* and the sidewall 407. The toner base particles having been surface-treated in the second cylindrical treatment chamber 429*b* are passed through a second powder discharge opening 410*b* provided at the center of a guide plate 408*b*, and introduced to the center of a third cylindrical treatment chamber 429*c*, and are further surface-treated by means of the blade 409*c* and the sidewall 407. The toner base particles are further passed through a third powder discharge opening 410*c* provided at the center of a guide plate 408*c*, and introduced to the center of a fourth cylindrical treatment chamber 429*d*, and are surface-treated by means of the blade 409*d* and the sidewall 407.

The air which is transporting the toner base particles is discharged outside the apparatus system via the first to fourth cylindrical treatment chambers 429*a* to 429*d* through a carry pipe 417, a cyclone 420, a bag filter 422 and the suction blower 424. The toner base particles introduced into the respective cylindrical treatment chambers 429*a* to 429*d* undergo mechanical impact action instantaneously, and further collide against the sidewall 407 to undergo mechanical impact force. The rotation of blades 409*a* to 409*d* having the stated size, provided on the rotors 402*a* to 402*d*, respectively, causes convection which circulates in the upper spaces of the rotor faces from the centers to the peripheries and from the peripheries to the centers. The toner base particles stagnate in the cylindrical treatment chambers 429*a* to 429*d*, and are surface-treated. The surfaces of the toner base particles are treated in virtue of the heat generated by this mechanical impact force.

As a specific method for the surface treatment (surface modification), each rotor was rotated at a peripheral speed of 40 m/sec and the suction blower was suction-set at an air flow of 3.0 $m^2$, in the state of which the toner base particles were fed at a rate of 20 kg per hour by means of an automatic feeder, and the system was operated for 1 hour to carry out the surface treatment. Here, the pass time of toner particles through the treatment apparatus was about 20 seconds. Also, the discharge opening air stream temperature of the apparatus at this point was 49° C.

Through the foregoing steps, negatively chargeable Toner Base Particles I-15 were obtained, whose weight-average particle diameter (D4) measured by the Coulter Counter method was 6.8 μm and the cumulative value of number-average distribution of toner base particles of less than 4 μm in diameter was 18.0%. As to Toner Base Particles I-15, the physical properties measured with FPIA-2100, the values of methanol concentrations with respect to transmittance of 780 nm wavelength light and the values measured with a scanning probe microscope are shown in Table 5.

100 parts by weight of this toner base particles and 1.2 parts by weight of hydrophobic fine silica powder having been treated with hexamethyldisilazane and then with dimethylsilicone oil were mixed by means of Henschel mixer to prepare Toner I-15 (toner particles).

TABLE 4

| | | | | Before surface modification toner base particles particle size distribution | | | | Surface modifying apparatus | | | | | After surface modification, toner base particles particle size distribution | |
|---|---|---|---|---|---|---|---|---|---|---|---|---|---|---|
| | | | | Mechanical grinding machine air temp. | | Wt. av. particle | | Peripheral speed | | | | Classifying rotor rear temp. | | |
| | Binder resin | Magnetic material | Wax | T1 (° C.) | T2 (° C.) | diam. (μm) | (1) (%) | Dispersing rotor (m/sec) | Classifying rotor (m/sec) | Cycle time (sec) | Cold air temp. T1 (° C.) | T2 (° C.) | Wt. av. particle diam. (μm) | (1) (%) |
| Toner Base Particles: | | | | | | | | | | | | | | |
| I-1 | I-1 | I-1 | I-1 | 0 | 45 | 6.6 | 25.2 | 140 | 83 | 45 | −20 | 30 | 6.8 | 18.1 |
| I-2 | I-1 | I-1 | I-1 | 0 | 45 | 6.5 | 26.3 | 140 | 90 | 65 | −20 | 35 | 6.7 | 19.5 |
| I-3 | I-1 | I-1 | I-1 | 0 | 45 | 6.6 | 23.0 | 140 | 87 | 30 | −20 | 28 | 6.8 | 17.8 |
| I-4 | I-1 | I-1 | I-1 | 0 | 45 | 6.7 | 25.4 | 145 | 85 | 45 | −15 | 37 | 6.8 | 18.3 |
| I-5 | I-1 | I-1 | I-1 | 0 | 45 | 6.7 | 28.3 | 135 | 76 | 50 | −15 | 31 | 6.9 | 17.5 |
| I-6 | I-1 | I-1 | I-2 | 3 | 48 | 6.6 | 31.2 | 148 | 76 | 50 | −15 | 40 | 6.8 | 17.9 |
| I-7 | I-2 | I-1 | I-3 | 3 | 48 | 6.6 | 34.4 | 150 | 69 | 50 | −12 | 46 | 6.8 | 18.2 |
| I-8 | I-3 | I-2 | I-4 | 3 | 48 | 6.5 | 38.0 | 150 | 69 | 55 | −12 | 48 | 6.7 | 19.6 |
| I-9 | I-1 | I-1 | I-4 | −20 | 25 | 6.8 | 18.4 | Hot air treatment | | | | | 6.8 | 18.1 |
| I-10 | I-1 | I-1 | I-4 | −20 | 25 | 6.7 | 19.6 | (none) | | | | | 6.7 | 19.6 |
| I-11 | I-1 | I-2 | I-4 | JSG | | 6.9 | 17.2 | Hot air treatment | | | | | 6.9 | 16.9 |
| I-12 | I-1 | I-2 | I-4 | JSG | | 6.8 | 18.2 | (none) | | | | | 6.8 | 18.2 |
| I-13 | I-1 | I-1 | I-1 | JSG | | 6.9 | 18.6 | Hot air treatment | | | | | 6.9 | 18.1 |
| I-14 | I-1 | I-1 | I-1 | JSG | | 6.9 | 17.9 | (none) | | | | | 6.9 | 17.9 |
| I-15 | I-1 | I-1 | I-1 | 0 | 45 | 6.8 | 15.2 | Apparatus shown in FIG. 5 | | | | | 6.8 | 18.0 |

(1): Cumulative value of number-average distribution of 4 μm or smaller particles
JSG: Jet stream grinding

TABLE 5

| Toner Base Particles: | Average circularity of ≧3 μm-≦400 μm particles | Percentage of ≧0.6 μm-<3 μm particles (no. %) | Number cumulative value of <0.960 circularity toner base particles (no. %) | Methanol concentration at transmittance of: 80% (A) (vol. %) | 50% (B) (vol. %) | (B) − (A) (vol. %) | Average surface roughness (nm) | Max-*imum vert. dif. (nm) | Surface area ($\mu m^2$) |
|---|---|---|---|---|---|---|---|---|---|
| I-1 | 0.947 | 14.8 | 48 | 50 | 52 | 2 | 14.8 | 132 | 1.22 |
| I-2 | 0.950 | 3.5 | 37 | 51 | 54 | 3 | 12.5 | 111 | 1.18 |
| I-3 | 0.941 | 6.5 | 63 | 48 | 52 | 4 | 20.3 | 128 | 1.24 |
| I-4 | 0.954 | 10.8 | 33 | 59 | 64 | 5 | 11.2 | 106 | 1.15 |
| I-5 | 0.937 | 13.5 | 64 | 42 | 47 | 5 | 23.0 | 187 | 1.27 |
| I-6 | 0.957 | 15.2 | 27 | 62 | 68 | 6 | 8.7 | 90 | 1.06 |
| I-7 | 0.963 | 19.4 | 23 | 65 | 73 | 8 | 7.6 | 72 | 1.04 |
| I-8 | 0.969 | 22.2 | 18 | 61 | 77 | 16 | 5.4 | 49 | 1.02 |
| I-9 | 0.973 | 27.6 | 15 | 64 | 84 | 20 | 4.2 | 40 | 1.01 |
| I-10 | 0.929 | 31.4 | 73 | 32 | 54 | 22 | 43.4 | 370 | 1.52 |
| I-11 | 0.976 | 37.3 | 12 | 58 | 76 | 18 | 3.3 | 28 | 1.01 |
| I-12 | 0.911 | 50.8 | 79 | 43 | 67 | 24 | 65.1 | 483 | 1.71 |
| I-13 | 0.974 | 36.4 | 13 | 57 | 74 | 17 | 3.5 | 32 | 1.01 |
| I-14 | 0.912 | 49.3 | 78 | 42 | 66 | 24 | 63.8 | 474 | 1.68 |
| I-15 | 0.945 | 23.0 | 52 | 47 | 53 | 6 | 41.2 | 315 | 1.43 |

*Maximum vert. dif. means Maximum vertical difference.

Next, using Toners I-1 to I-15 thus prepared, evaluation was made in the following way. Results of evaluation are shown in Table 6.

Using a laser beam printer LASER JET 4300n, manufactured by Hewlett-Packard Co., the following evaluation was made.

(1) Image Density, Fog:

In each environment of a normal-temperature and normal-humidity environment (23° C./60% RH), a low-temperature and low-humidity environment (15° C./10% RH) and a high-temperature and high-humidity environment (32.5° C./80% RH), a 9,000-sheet image reproduction test was conducted at a print speed of 2 sheets/10 seconds and a print percentage of 5% on copying machine plain paper (A4 size, 75 g/m$^2$ in basis weight). After the printer was left for a day, the 9,000-sheet image reproduction test was again conducted, 18,000 sheets in total. The results are shown in Table 6.

The image density was measured with MACBETH REFLECTION DENSITOMETER (manufactured by Macbeth Co.), as relative density with respect to an image printed on a white background area with a density of 0.00 of an original.

The fog was calculated from a difference between the whiteness of a transfer sheet and the whiteness of the transfer sheet after print of solid white which were measured with a reflectometer manufactured by Tokyo Denshoku Co., Ltd.

(2) Toner Consumption:

Before and after the 18,000-sheet image reproduction test was conducted in the normal-temperature and normal-humidity environment (23° C./60% RH) at a print percentage of 4% on copying machine plain paper (A4 size, 75 g/m$^2$ in basis weight), the quantity of the toner in the toner container was measured to examine toner consumption per sheet of images.

Figure 4:
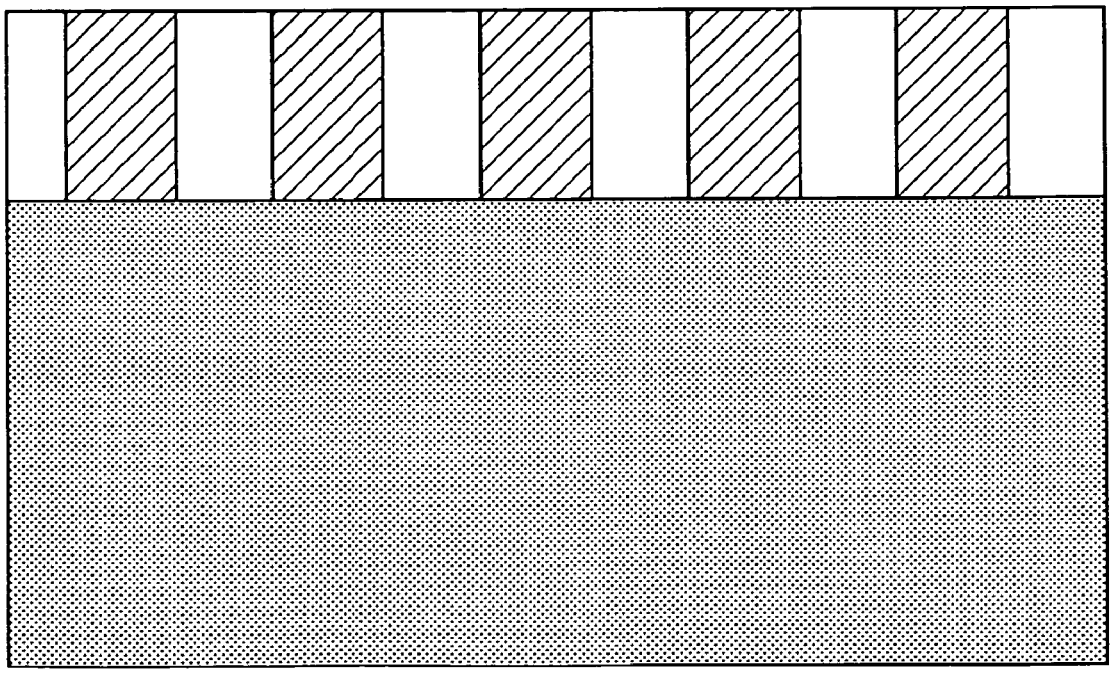
FIG. 4 illustrates a pattern used to make evaluation on sleeve ghost.

(3) Sleeve Negative Ghost:

Images were printed on 18,000 sheets of usual copying machine plain paper (A4 size, 75 g/m$^2$ in basis weight) in the low-temperature and low-humidity environment (15° C./10% RH). Evaluation on sleeve negative ghost was made at intervals of 4,500 sheets. For image evaluation in regard to ghost, solid black stripes were reproduced for only one round of the sleeve and thereafter a halftone image was reproduced. Its pattern is schematically shown in FIG. 4. As an evaluation method, on a sheet of printed images, the difference in reflection density measured with the Macbeth reflection densitometer on the second round of the sleeve, between a place where the solid black images were formed (black print areas) on the first round and a place where they were not formed (non-image areas) was calculated as shown below. The negative ghost is a ghost phenomenon in which, usually on images coming on the second round of the sleeve, the image density at the part having stood black print areas on the first round of the sleeve is lower than the image density at the part having stood non-image areas on the first round of the sleeve, and the shape of the pattern reproduced on the first round appears as it is.

Reflection density difference=(reflection density at a place where no image was formed on the first round)−(reflection density at a place where solid black images were formed on the first round).

The smaller the difference in reflection density is, the less the ghost appears to show a better level. As overall evaluation of the ghost, evaluation was made according to four ranks of A, B, C and D. The worst evaluation result in the evaluation at intervals of 4,500 sheets is shown in Table 6.

Reflection Density Difference

A: 0.00 or more to less than 0.02.

B: 0.02 or more to less than 0.04.

C: 0.04 or more to less than 0.06.

D: 0.06 or more.

(4) Spots Around Line Images:

In the running test in the normal-temperature and normal-humidity environment, a lattice pattern with 100 μm (latent image) lines (1 cm in interval) was printed at the initial stage and on the 18,000th sheet, and spots around line images formed were visually observed on an optical microscope to make evaluation.

A: Lines are very sharp and spots around line images are little seen.

B: On the level of being slightly spotted, and lines are relatively sharp.

C: Spots around line images a little much appear, and lines look vague.

D: Not reach the level of C.

(5) Blotches:

In the running test in the low-temperature and low-humidity environment, the evaluation on blotches was made by the state of toner coat on the developing sleeve during image reproduction and by printed images.

A: No blotch is seen at all on the developing sleeve.

B: Blotches are slightly seen on the developing sleeve, but their influence does not appear on images.

C: Blotches are seen on the developing sleeve, and their influence appear faintly on images.

D: Blotches are seen on the developing sleeve, and their influence appear greatly on images.

TABLE 6

| | Low-temp./low-humidity environment | | | | High-temperature/high-humidity environment | | Normal-temperature/normal-humidity environment | | |
|---|---|---|---|---|---|---|---|---|---|
| | Image density after 18,000 sheet running | Fog after 18,000 sheet running | Sleeve negative ghost | Blotch | Image density on 1st-in = morning 9,000 sheets | Image density after 18,000 sheet running | Image density after 18,000 sheet running | Toner consumption (mg/sh.) | Spots around line images |
| Example: | | | | | | | | | |
| I-1 Toner I-1 | 1.40 | 1.5 | A | A | 1.35 | 1.38 | 1.39 | 42 | A |
| I-2 Toner I-2 | 1.39 | 1.4 | A | A | 1.33 | 1.36 | 1.38 | 42 | A |

TABLE 6-continued

| | | Low-temp./low-humidity environment | | | | High-temperature/ high-humidity environment | | Normal-temperature/ normal-humidity environment | | |
|---|---|---|---|---|---|---|---|---|---|---|
| | | Image density after 18,000 sheet running | Fog after 18,000 sheet running | Sleeve negative ghost | Blotch | Image density on 1st-in = morning 9,000 sheets | Image density after 18,000 sheet running | Image density after 18,000 sheet running | Toner consumption (mg/sh.) | Spots around line images |
| I-3 | Toner I-3 | 1.39 | 1.8 | A | A | 1.32 | 1.35 | 1.37 | 43 | B |
| I-4 | Toner I-4 | 1.38 | 1.9 | A | A | 1.32 | 1.34 | 1.36 | 44 | A |
| I-5 | Toner I-5 | 1.39 | 2.2 | A | A | 1.33 | 1.35 | 1.37 | 47 | B |
| I-6 | Toner I-6 | 1.36 | 2.3 | B | A | 1.29 | 1.31 | 1.33 | 45 | A |
| I-7 | Toner I-7 | 1.34 | 2.4 | B | B | 1.28 | 1.30 | 1.32 | 45 | A |
| I-8 | Toner I-8 | 1.32 | 2.6 | B | B | 1.26 | 1.29 | 1.30 | 46 | B |
| Comparative Example: | | | | | | | | | | |
| I-1 | Toner I-9 | 1.21 | 3.5 | C | D | 1.10 | 1.17 | 1.19 | 50 | C |
| I-2 | Toner I-10 | 1.18 | 3.7 | C | C | 1.08 | 1.15 | 1.17 | 52 | D |
| I-3 | Toner I-11 | 1.16 | 3.8 | D | D | 1.06 | 1.12 | 1.14 | 53 | C |
| I-4 | Toner I-12 | 1.14 | 4.0 | D | C | 1.05 | 1.09 | 1.12 | 55 | D |
| I-5 | Toner I-13 | 1.17 | 3.7 | D | D | 1.07 | 1.14 | 1.16 | 54 | C |
| I-6 | Toner I-14 | 1.15 | 3.9 | D | C | 1.06 | 1.09 | 1.13 | 54 | D |
| I-7 | Toner I-15 | 1.38 | 2.8 | C | A | 1.32 | 1.34 | 1.35 | 48 | C |

Prepaeation of Toner II-1

| | (by weight) |
|---|---|
| Binder resin (styrene-butyl acrylate copolymer; St/BA = 83/17; main peak molecular weight: 10,000; sub-peak molecular weight: 650,000: Mn: 5,500; Mw: 350,000) | 100 parts |
| Magnetic material (spherical; number-average particle diameter: 0.2 μm; magnetic properties in a magnetic field of 1 kOe, σr: 5.1 $Am^2/kg$ and σs: 69.6 $Am^2/kg$) | 90 parts |
| Monoazo iron complex (T-77, available from Hodogaya Chemical Co., Ltd.) | 1 part |
| Wax | 4 parts |

(low-molecular weight polyethylene; melting point: 102° C.; Mn: 850; Mw: 1,250)

The above materials were premixed by means of Henschel mixer, and thereafter the mixture obtained was melt-kneaded by means of a twin-screw kneader heated to 100° C. The kneaded product obtained and having been cooled was crushed by means of a hammer mill to obtain a toner material crushed product. The crushed product obtained was finely pulverized by mechanical pulverization using a mechanical grinding machine Turbo Mill (manufactured by Turbo Kogyo Co., Ltd.; the surfaces of its rotor and stator were coated by plating of a chromium alloy containing chromium carbide (plating thickness: 150 μm; surface hardness: HV 1,050)), controlling air temperature under conditions shown in Table 7. The finely pulverized product thus obtained was classified by means of a multi-division classifier utilizing the Coanda effect (Elbow Jet Classifier, manufactured by Nittetsu Mining Co., Ltd.) to classify and remove fine powder and coarse powder simultaneously. As to the material toner base particles thus obtained, the weight-average particle diameter (D4) measured by the Coulter Counter method was 6.6 μm, and the cumulative value of number-average distribution of toner base particles of less than 4 μm in diameter was 24.8% by number.

The material toner base particles were put to the surface modifying apparatus shown in FIG. 1 to carry out surface modification and removal of fine powder. In that treatment, in this Example, sixteen (16) rectangular disks were provided at the upper part of the dispersing rotor, the space (gap) between the guide ring and the rectangular disks on the dispersing rotor was set to 60 mm, and the space (gap) between the dispersing rotor and the liners to 3.5 mm. Also, the rotational peripheral speed of the dispersing rotor was set to 140 m/sec, and the blower air feed rate to 30 $m^3$/min. The feed rate of the finely pulverized product was set to 300 kg/hr, and the cycle time to 45 sec. The temperature of the refrigerant let to run through the jacket was set to −15° C., and the cold-air temperature T1 to −20° C. Still also, the number of revolutions of the dispersing rotor was so controlled that the percentage of particles of from 0.6 μm or more to less than 3 μm in diameter came to the desired value. Through the foregoing steps, Toner Base Particles II-1 were obtained, whose weight-average particle diameter (D4) measured by the Coulter Counter method was 6.8 μm and the cumulative value of number-average distribution of toner base particles of less than 4 μm in diameter was 18% by number. As to Toner Base Particles II-1, the physical properties measured with FPIA-2100 and the values measured with a scanning probe microscope are shown in Table 8.

Preparation of Toner Base Particles II-2 to II-5

Toner Base Particles II-2 to II-5 were obtained in the same manner as Toner Base Particles II-1 except that the fine grinding conditions of Turbo Mill, the classification conditions in the multi-division classifier and the conditions of the surface modifying apparatus were changed as shown in Table 7. As to Toner Base Particles II-2 to II-5, the physical properties measured with FPIA-2100 and the values measured with a scanning probe microscope are shown in Table 8.

Preparation of Toner Base Particles II-6

Toner Base Particle II-6 was obtained in the same manner as Toner Base Particle II-1 except that the fine grinding conditions of Turbo Mill were changed as shown in Table 7, the classification conditions in the multi-division classifier were changed, and the toner base particles obtained were treated by making them pass through hot air of 300° C. instantaneously. As to Toner Base Particle II-6, the physical properties measured with FPIA-2100 and the values measured with a scanning probe microscope are shown in Table 8.

Preparation of Toner Base Particles II-7

Toner Base Particle II-7 was obtained in the same manner as Toner Base Particle II-1 except that a jet stream grinding machine was used-in place of the mechanical grinding machine, the classification conditions in the multi-division classifier were changed, and further the surface modification using the surface modifying apparatus was not carried out. As to Toner Base Particle II-7, the physical properties measured with FPIA-2100 and the values measured with a scanning probe microscope are shown in Table 8.

TABLE 9

| Composition | | Primary particles, average particle diameter (nm) | Treating agent(s) |
|---|---|---|---|
| Inorganic Fine Particles: | | | |
| A1 | Dry-process silica | 14 | Hexamethyldisilazane/ dimethylsilicone oil |
| A2 | Dry-process silica | 8 | Hexamethyldisilazane/ dimethylsilicone oil |
| A3 | Dry-process silica | 18 | Hexamethyldisilazane/ dimethylsilicone oil |
| A4 | Dry-process silica | 20 | Hexamethyldisilazane |

TABLE 7

| | Before surface modification, toner base particles particle | | | | Surface modifying apparatus | | | | | After surface modification, toner base particles particle | |
|---|---|---|---|---|---|---|---|---|---|---|---|
| | Mechanical grinding machine air temp. | | Wt. av. particle size distribution | | Peripheral speed | | | | Classifying rotor rear temp. | Wt. av. particle size distribution | |
| Toner Base Particles: | T1 (° C.) | T2 (° C.) | diam. (μm) | (1) (no. %) | Dispersing rotor (m/sec) | Classifying rotor (m/sec) | Cycle time (sec) | Cold air temp. T1 (° C.) | T2 (° C.) | diam. (μm) | (1) (no. %) |
| II-1 | −5 | 42 | 6.6 | 24.8 | 140 | 80 | 45 | −20 | 30 | 6.8 | 18.0 |
| II-2 | −5 | 41 | 6.5 | 25.8 | 145 | 89 | 65 | −20 | 35 | 6.7 | 20.1 |
| II-3 | −5 | 40 | 6.7 | 25.3 | 140 | 83 | 45 | −15 | 37 | 6.8 | 18.2 |
| II-4 | −5 | 40 | 6.6 | 27.9 | 135 | 77 | 50 | −15 | 31 | 6.8 | 17.5 |
| II-5 | −5 | 38 | 6.6 | 33.8 | 150 | 69 | 50 | −12 | 46 | 6.8 | 18.2 |
| II-6 | −15 | 25 | 6.8 | 18.1 | Hot air treatment | | | | | 6.8 | 18.0 |
| II-7 | JSG | | 6.7 | 22.5 | (none) | | | | | 6.7 | 22.5 |

(1): Cumulative value of number-average distribution of 4 μm or smaller particles
JSG: Jet stream grinding

TABLE 8

| Toner Base Particles: | Average circularity of ≧3 μm-≦400 μm particles | Percentage of ≧0.6 μm-<3 μm particles (no. %) | Number cumulative value of <0.960 circularity toner base particles (no. %) | Average surface roughness (nm) | Maximum P—V difference (nm) | Surface area ($\mu m^2$) |
|---|---|---|---|---|---|---|
| II-1 | 0.947 | 14.8 | 48 | 30.1 | 164 | 1.13 |
| II-2 | 0.950 | 3.5 | 63 | 24.8 | 139 | 1.12 |
| II-3 | 0.954 | 10.8 | 64 | 17.2 | 84 | 1.11 |
| II-4 | 0.937 | 13.5 | 33 | 34.5 | 162 | 1.14 |
| II-5 | 0.963 | 19.4 | 27 | 8.6 | 46 | 1.07 |
| II-6 | 0.973 | 27.6 | 72 | 4.1 | 20 | 1.02 |
| II-7 | 0.920 | 50.2 | 78 | 88.4 | 345 | 1.52 |

TABLE 10

| | Composition | Primary particles, average particle diameter (nm) | Treating agent(s) |
|---|---|---|---|
| Inorganic Fine Particles: | | | |
| B1 | Dry-process silica | 35 | Hexamethyldisilazane/ dimethylsilicone oil |
| B2 | Dry-process silica | 47 | Hexamethyldisilazane/ dimethylsilicone oil |
| B3 | Dry-process silica | 39 | Hexamethyldisilazane/ dimethylsilicone oil |
| B4 | Dry-process silica | 47 | Hexamethyldisilazane |
| B5 | Titanium oxide | 55 | Dimethylsilicone oil |

TABLE 11

| Toner: | Toner base Particles | Small-particle-diameter inorganic fine particles A Type | Amount (pbw) | Coverage A | Small-particle-diameter inorganic fine particles B Type | Amount (pbw) | Coverage B | Coverage B × 100/ (Coverage A + Coverage B) |
|---|---|---|---|---|---|---|---|---|
| I-1 | II-1 | A1 | 1.20 | 0.91 | B1 | 0.20 | 0.065 | 6.7 |
| II-2 | II-2 | A1 | 1.20 | 0.91 | B2 | 0.30 | 0.070 | 7.1 |
| II-3 | II-4 | A2 | 1.20 | 1.72 | B1 | 0.10 | 0.030 | 1.7 |
| II-4 | II-3 | A3 | 1.20 | 0.69 | B1 | 0.20 | 0.060 | 8.0 |
| II-5 | II-4 | A1 | 1.20 | 0.91 | B3 | 0.30 | 0.030 | 3.2 |
| II-6 | II-5 | A4 | 1.35 | 0.77 | B4 | 0.30 | 0.070 | 8.3 |
| II-7 | II-5 | A4 | 1.20 | 0.70 | B2 | 0.35 | 0.085 | 10.8 |
| II-8 | II-3 | A2 | 1.50 | 2.15 | B5 | 0.10 | 0.020 | 0.9 |
| II-9 | II-3 | A4 | 1.00 | 0.57 | B4 | 0.50 | 0.120 | 17.4 |
| II-10 | II-4 | A4 | 1.20 | 0.70 | — | — | — | — |
| II-11 | II-6 | A4 | 1.20 | 0.70 | B2 | 0.35 | 0.085 | 10.8 |
| II-12 | II-7 | A4 | 1.20 | 0.70 | B2 | 0.35 | 0.085 | 10.8 |

Examples II-1 to II-10 & Comparative Examples II-1 and II-2

Using Toner Base Particles II-1 to II-7, based on 100 parts by weight of each Toner Base Particles, inorganic fine particles A shown in Table 9 and inorganic fine particles B shown in Table 10 were mixed by external addition by means of Henschel mixer in the proportion shown in Table 11 to obtain Toner II-1 to II-12 (toner particles).

As to Toner II-1 prepared using Toner Base Particles II-1 as base particles, the average circularity of the toner particles having a circle-equivalent diameter of from 3 μm or more to 400 μm or less as measured with FPIA-2100 was 0.947, and the average surface roughness measured with a scanning probe microscope was 18.0 nm. Also, as to Toner II-12 prepared using Toner Base Particles II-7 as base particles, the average circularity of the toner particles having a circle-equivalent diameter of from 3 μm or more to 400 μm or less as measured with FPIA-2100 was 0.920, and the average surface roughness measured with a scanning probe microscope was 28.5 nm.

Next, using Toners II-1 to II-12 thus prepared, evaluation was made in the following way. Results of evaluation are shown in Table 12.

Using a laser beam printer LASER JET 4300n, manufactured by Hewlett-Packard Co., which was so altered that its process speed was changed to 1.1 times and the touch pressure of the developing blade of its developing cartridge to 1.1 times, the following evaluation was made. Results of evaluation are shown in Table 12.

(1) Image Density, Fog:

Evaluated according to evaluation criteria in Example I-1.

(2) Sleeve Negative Ghost:

Evaluated according to evaluation criteria in Example I-1.

(3) Spots Around Line Images:

Evaluated according to evaluation criteria in Example I-1.

(4) Initial-stage Density Build-up:

In the normal-temperature and normal-humidity environment (23° C./50% RH), the running was tested up to 100 sheets at a process speed of 2 sheets/10 seconds in the sate the toner was filled in a quantity of 80 g and the developing blade was changed for new one standing uncoated at all, where a variation of density was evaluated as a difference between the first sheet and the 100th sheet.

The image density was measured with MACBETH REFLECTION DENSITOMETER (manufactured by Macbeth Co.), as relative density with respect to an image printed on a white background area with a density of 0.00 of an original.

(5) Fixing Performance:

To evaluate fixing performance, images were reproduced using copying machine plain paper of 90 g/m$^2$ in basis weight and using an altered machine of a laser beam printer LASER JET 4300n, manufactured by Hewlett-Packard Co. Fixed images obtained immediately after start of operation were rubbed with a sheet of soft and thin paper under application of a load of 4.9 kPa, and a rate (%) of decrease in image density before and after the rubbing was measured to make evaluation according to the following evaluation criteria. Incidentally, the toner laid-on quantity on the images was 5 g/m$^2$.

A: Less than 2%.

B: 2% to 4%.

C: 4% to 8%.

D: More than 8%.

TABLE 12

| | | Low-temp./low-humidity environment | | | High-temperature/high-humidity environment | | | Normal-temp./normal-humidity environment | |
|---|---|---|---|---|---|---|---|---|---|
| | | Image density after 18,000 sheet running | Fog after 18,000 sheet running | Sleeve negative ghost | Image density on 1st-in = morning 9,000 sheets | Image density after 18,000 sheet running | Spots around line images | Initial = stage density difference | Fixing performance |
| Example: | | | | | | | | | |
| II-1 | Toner II-1 | 1.42 | 1.1 | A | 1.40 | 1.38 | A | 0.01 | A |
| II-2 | Toner II-2 | 1.40 | 1.2 | A | 1.39 | 1.38 | A | 0.01 | B |
| II-3 | Toner II-3 | 1.38 | 2.0 | A | 1.32 | 1.35 | B | 0.02 | C |
| II-4 | Toner II-4 | 1.38 | 1.8 | A | 1.35 | 1.35 | B | 0.02 | A |
| II-5 | Toner II-5 | 1.38 | 1.7 | A | 1.36 | 1.34 | B | 0.03 | B |
| II-6 | Toner II-6 | 1.35 | 2.3 | B | 1.29 | 1.31 | B | 0.03 | B |
| II-7 | Toner II-7 | 1.34 | 2.4 | B | 1.28 | 1.30 | B | 0.04 | A |
| II-8 | Toner II-8 | 1.32 | 2.6 | B | 1.25 | 1.27 | B | 0.04 | C |
| II-9 | Toner II-9 | 1.20 | 2.8 | C | 1.20 | 1.20 | C | 0.06 | A |
| II-10 | Toner II-10 | 1.35 | 2.1 | B | 1.20 | 1.25 | C | 0.05 | A |
| Comparative Example: | | | | | | | | | |
| II-1 | Toner II-11 | 1.17 | 3.5 | D | 1.05 | 1.11 | C | 0.07 | A |
| II-2 | Toner II-12 | 1.13 | 3.9 | D | 1.04 | 1.10 | D | 0.08 | A |

Low-Molecular Weight Component

Production Example L-1

300 parts by weight of xylene was introduced into a four-necked flask, and the atmosphere in the flask was sufficiently displaced with nitrogen gas with stirring, and thereafter the xylene was heated and refluxed, where, under the reflux, a liquid mixture of 68.8 parts by weight of styrene, 22 parts by weight of n-butyl acrylates, 9.2 parts by weight of monobutyl maleate and 1.8 parts by weight of di-t-butyl peroxide was dropwise added over a period of 4 hours. Thereafter, this was kept for 2 hours to complete polymerization, followed by desolvation to obtain a low-molecular weight polymer (L-1). This polymer was subjected to GPC and measurement of acid value to find that its peak molecular weight was 15,000 and acid value was 30 mg·KOH/g. Values thereof are shown in Table 13.

Low-Molecular Weight Component

Production Examples L-2 to L-5

Low-molecular weight polymers L-2 to L-5 were obtained in the same manner as in Low-molecular Weight Component Production Example L-1 except that the amounts of the styrene, n-butyl acrylates and monobutyl maleate and the amount of the polymerization initiator were changed as shown in Table 13. The values of the peak molecular weight and acid value of the low-molecular weight polymers L-2 to L-5 each are shown in Table 13.

High-Molecular Weight Component

Production Example H-1

180 parts by weight of deaerated water and 20 parts by weight of a 2% by weight aqueous solution of polyvinyl alcohol were introduced into a four-necked flask, and thereafter a liquid mixture of 75.3 parts by weight of styrene, 2.0 parts by weight of n-butyl acrylate, 4.7 parts by weight of monobutyl maleate, 0.65 part by weight of di-t-butyl peroxide, 0.008 part by weight of divinylbenzene and 0.15 part by weight of 2,2-bis(4,4-di-t-butylperoxycyclohexyl)propane was added thereto, followed by stirring to prepare a suspension. The atmosphere in the flask was sufficiently displaced with nitrogen gas, and the contents were heated to 90° C. to start polymerization. This was kept for 24 hours at the same temperature to obtain a high-molecular weight polymer (H-1). Thereafter, the polymer (H-1) was filtered, washed with water and then dried, and thereafter subjected to GPC and measurement of acid value to find that its peak molecular weight was 2,300,000 and acid value was 8.7 mg·KOH/g. Values thereof are shown in Table 13.

High-Molecular Weight Component

Production Examples H-2 to H-4

High-molecular weight polymers H-2 to H-4 were obtained in the same manner as in High-molecular Weight Component Production Example H-1 except that the amounts of the styrene, n-butyl acrylates, monobutyl maleate, di-t-butyl peroxide, divinylbenzene and 2,2-bis(4,4-di-t-butylperoxycyclohexyl)propane were changed as shown in Table 13 and divinylbenzene was optionally added. The values of the peak molecular weight and acid value of the high-molecular weight polymers H-2 to H-4 each are shown in Table 13.

TABLE 13

| | Styrene | n-Butyl acrylate | Mono-butyl maleate | Divinyl-benzene | Di-t = butyl peroxide | 2,2-bis(4,4 = di-t-butylperoxy-cyclohexyl)propane | Peak molecular weight | Acid value (mgKOH/g) |
|---|---|---|---|---|---|---|---|---|
| L-1 | 68.8 | 22.0 | 9.2 | — | 1.80 | — | 15,000 | 30.0 |
| L-2 | 72.0 | 20.0 | 8.0 | — | 1.30 | — | 28,000 | 27.2 |
| L-3 | 70.2 | 21.0 | 8.8 | — | 2.00 | — | 3,100 | 28.6 |
| L-4 | 69.5 | 22.0 | 8.5 | — | 1.10 | — | 35,000 | 28.4 |
| L-5 | 85.0 | 15.0 | — | — | 1.50 | — | 24,000 | 0 |
| H-1 | 75.3 | 20.0 | 4.7 | 0.008 | 0.65 | 0.15 | $2.3 \times 10^6$ | 8.7 |
| H-2 | 71.5 | 21.0 | 7.5 | 0.003 | 0.90 | 0.22 | 48,000 | 19.6 |
| H-3 | 78.7 | 20.0 | 1.3 | 0.050 | 0.05 | 0.08 | $1.1 \times 10^8$ | 3.3 |
| H-4 | 83.0 | 17.0 | — | 0.006 | 0.72 | 0.17 | $1.9 \times 10^6$ | 0 |

Binder Resin

Production Example III-1

The low-molecular weight component L-1 and the high-molecular weight component H-1 were mixed in a xylene solution in the proportion shown-in Table 14 to obtain Binder Resin III-1. Physical properties of the binder resin obtained are shown in Table 14.

Binder Resin

Production Examples III-2 to III-8

Binder Resins III-2 to III-8 were obtained in the same manner as in Binder Resin Production Example III-1 except that the types of polymers to be mixed were changed as shown in Table 14.

TABLE 14

| Binder Resin: | Low = molecular weight polymer | High = molecular weight polymer | Low/high polymer ratio (L/H) | Main = peak molecular weight | Sub-peak or shoulder molecular weight | Main = peak component content (wt. %) | Sub-peak or shoulder component content (wt. %) | Acid value (mgKOH/g) | Tg (° C.) |
|---|---|---|---|---|---|---|---|---|---|
| III-1 | L-1 | H-1 | 75/25 | 15,000 | $2.3 \times 10^6$ | 73.8 | 26.2 | 24.1 | 60.2 |
| III-2 | L-2 | H-1 | 70/30 | 28,000 | $2.3 \times 10^6$ | 69.3 | 30.7 | 21.7 | 61.5 |
| III-3 | L-2 | H-4 | 65/35 | 28,000 | $1.9 \times 10^6$ | 64.4 | 35.6 | 17.1 | 62.2 |
| III-4 | L-5 | H-4 | 70/30 | 24,000 | $1.9 \times 10^6$ | 70.6 | 29.4 | 0 | 60.5 |
| III-5 | L-4 | H-1 | 80/20 | 35,000 | $2.3 \times 10^6$ | 78.8 | 21.2 | 23.9 | 62.1 |
| III-6 | L-4 | H-2 | 50/50 | 35,000 | 48,000 | 53.2 | 46.8 | 23.8 | 58.6 |
| III-7 | L-3 | H-1 | 65/35 | 2,700 | $2.3 \times 10^6$ | 65.1 | 34.9 | 21.6 | 58.3 |
| III-8 | L-1 | H-3 | 85/15 | 15,000 | $1.1 \times 10^8$ | 85.4 | 14.6 | 25.3 | 64.8 |

Example III-1

Preparation of Toner III-1

| | (by weight) |
|---|---|
| Binder Resin III-1 | 100 parts |
| Spherical magnetic iron oxide (number-average particle diameter: 0.21 μm; magnetic properties in a magnetic field of 1 kOe, σr: 5.1 $Am^2/kg$ and σs: 69.6 $Am^2/kg$) | 95 parts |
| Monoazo iron complex (T-77, available from Hodogaya Chemical Co., Ltd.) | 2 parts |
| Wax | 4 parts |

(Fischer-Tropsch wax; melting point: 104° C.; Mn: 780; Mw: 1,060)

The above materials were premixed by means of Henschel mixer, and thereafter the mixture obtained was melt-kneaded by means of a twin-screw kneader heated to 110° C. The kneaded product obtained and having been cooled was crushed by means of a hammer mill to obtain a toner material crushed product. The crushed product obtained was finely pulverized by mechanical pulverization using a mechanical grinding machine Turbo Mill, (manufactured by Turbo Kogyo Co., Ltd.; the surfaces of its rotor and stator were coated by plating of a chromium alloy containing chromium carbide (plating thickness: 150 μm; surface hardness: HV 1,050)], controlling air temperature under conditions shown in Table 15. The finely pulverized product thus obtained was classified by means of a multi-division classifier utilizing the Coanda effect (Elbow Jet Classifier, manufactured by Nittetsu Mining Co., Ltd.) to classify and remove fine powder and coarse powder simultaneously. As to the material toner base particles thus obtained, the weight-average particle diameter (D4) measured by the Coulter Counter method was 6.6 μm, and the cumulative value of number-average distribution of toner base particles of less than 4 μm in diameter was 25.3% by number.

The material toner base particles were put to the surface modifying apparatus shown in FIG. 1, to carry out surface modification and removal of fine powder. In that treatment, in this Example, sixteen (16) rectangular disks were provided at the upper part of the dispersing rotor, the space (gap) between the guide ring and the rectangular disks on the dispersing rotor was set to 60 mm, and the space (gap) between the dispersing rotor and the liners to 4 mm. Also, the rotational peripheral speed of the dispersing rotor was set to 140 m/sec, and the blower air feed rate to 30 $m^3$/min. The feed rate of the finely pulverized product was set to 300 kg/hr, and the cycle time to 45 sec. The temperature of the refrigerant let to run through the jacket was set to −15° C., and the cold-air temperature T1 to −20° C. Still also, the number of revolutions of the dispersing rotor was so controlled that the percentage of particles of from 0.6 μm or more to less than 3 μm in diameter came to the desired value. Through the foregoing steps, Toner Base Particles III-1 were obtained, whose weight-average particle diameter (D4) measured by the Coulter Counter method was 6.8 μm and the cumulative value of number-average distribution of toner base particles of less than 4 μm in diameter was 18.1% by number.

As to Toner Base Particles III-1, the physical properties measured with FPIA-2100, the values of methanol concentrations with respect to transmittance of 780 nm wavelength light and the values measured with a scanning probe microscope are shown in Table 16.

100 parts by weight of this toner base particles and 1.2 parts by weight of hydrophobic fine silica powder having been treated with hexamethyldisilazane and then with dimethylsilicone oil were mixed by means of Henschel mixer to prepare Toner III-1 (toner particles).

As to this Toner III-1, the average circularity of the toner particles having a circle-equivalent diameter of from 3 μm or more to 400 μm or less as measured with FPIA-2100 was 0.947, and the average surface roughness measured with a scanning probe microscope was 16.5 nm.

Preparation of Toners III-2 to III-10

Toner Base Particles III-2 to III-10 and Toners III-2 to III-10 were obtained in the same manner as Toner III-1 except that the binder resin used was as shown in Table 15, further the fine grinding conditions of Turbo Mill were changed as shown in Table 15, the classification conditions in the multi-division classifier were changed, and further the conditions of the surface modifying apparatus were set as shown in Table 15. As to Toner Base Particles III-2 to III-10, the physical properties measured with FPIA-2100, the values of methanol concentrations with respect to transmittance of 780 nm wavelength light and the values measured with a scanning probe microscope are shown in Table 16. Of these, as to Toner III-10, the average circularity of the toner particles having a circle-equivalent diameter of from 3 μm or more to 400 μm or less as measured with FPIA-2100 was 0.934, and the average surface roughness measured with a scanning probe microscope was 30.0 nm.

Preparation of Toner III-11

Toner Base Particle III-11 and Toner III-11 were obtained in the same manner as Toner III-1 except that the binder resin used was as shown in Table 15, further the-fine grinding conditions of Turbo Mill were changed as shown in Table 15, the classification conditions in the multi-division classifier were changed, and the toner base particles obtained were treated by making them pass through hot air of 300° C. instantaneously. As to Toner Base Particle III-11, the physical properties measured with FPIA-2100, the values of methanol concentrations with respect to transmittance of 780 nm wavelength light and the values measured with a scanning probe microscope are shown in Table 16.

Preparation of Toner III-12

Toner Base Particle III-12 and Toner III-12 were obtained in the same manner as Toner III-1 except that the binder resin used was as shown in Table 15, further the fine grinding conditions of Turbo Mill were changed as shown in Table 15, the classification conditions in the multi-division classifier were changed, and further the surface modification using the surface modifying apparatus was not carried out. As to Toner Base Particle III-12, the physical properties measured with FPIA-2100, the values of methanol concentrations with respect to transmittance of 780 nm wavelength light and the values measured with a scanning probe microscope are shown in Table 16.

Preparation of Toner III-13

Toner Base Particle III-13 and Toner III-13 were obtained in the same manner as Toner III-1 except that the binder resin used was as shown in Table 15, a jet stream grinding machine was used in place of the mechanical grinding machine, further the classification conditions in the multi-division classifier were changed, and the toner base particles obtained were treated by making them pass through hot air of 300° C. instantaneously. As to Toner Base Particle III-13, the physical properties measured with FPIA-2100, the values of methanol concentrations with respect to transmittance of 780 nm wavelength light and the values measured with a scanning probe microscope are shown in Tables 16(A) and 16(B).

Preparation of Toner III-14

Toner Base Particle III-14 and Toner III-14 were obtained in the same manner as Toner III-1 except that the binder resin used was as shown in Table 15, a jet stream grinding machine was used in place of the mechanical grinding machine, the classification conditions in the multi-division classifier were changed, and further the surface modification using the surface modifying apparatus was not carried out. As to Toner Base Particle III-14, the physical properties measured with FPIA-2100, the values of methanol concentrations with respect to transmittance of 780 nm wavelength light and the values measured with a scanning probe microscope are shown in Tables 16(A) and 16(B).

TABLE 15

| | | Mechanical grinding machine air temp. | | Before surface modification, toner base particles particle size distribution | | Surface modifying apparatus: Peripheral speed | | | | | After surface modification, toner base particles particle size distribution | |
|---|---|---|---|---|---|---|---|---|---|---|---|---|
| Toner Base Particles: | Binder Resin: | T1 (° C.) | T2 (° C.) | Wt. av. particle diam. (μm) | (1) (no. %) | Dispersing rotor (m/sec) | Classifying rotor (m/sec) | Cycle time (sec) | Cold air temp. T1 (° C.) | Classifying rotor rear temp. T2 (° C.) | Wt. av. particle diam. (μm) | (1) (no. %) |
| III-1 | III-1 | 0 | 45 | 6.6 | 25.3 | 140 | 83 | 45 | −20 | 30 | 6.8 | 18.1 |
| III-2 | III-1 | 0 | 45 | 6.5 | 26.3 | 140 | 90 | 65 | −20 | 35 | 6.7 | 19.6 |
| III-3 | III-1 | 0 | 45 | 6.5 | 22.5 | 135 | 87 | 30 | −20 | 28 | 6.7 | 17.2 |
| III-4 | III-1 | 3 | 48 | 6.5 | 38.0 | 135 | 69 | 50 | −12 | 39 | 6.8 | 20.0 |
| III-5 | III-1 | 3 | 48 | 6.8 | 26.6 | 140 | 69 | 50 | −12 | 42 | 6.7 | 18.3 |
| III-6 | III-2 | 0 | 45 | 6.7 | 37.5 | 140 | 69 | 50 | −15 | 31 | 6.9 | 17.8 |
| III-7 | III-2 | 3 | 48 | 6.5 | 38.5 | 135 | 69 | 50 | −12 | 41 | 6.9 | 20.3 |
| III-8 | III-3 | 0 | 45 | 6.7 | 36.9 | 145 | 69 | 50 | −12 | 44 | 6.8 | 17.8 |
| III-9 | III-4 | 0 | 45 | 6.6 | 37.5 | 145 | 69 | 50 | −12 | 42 | 6.7 | 18.1 |
| III-10 | III-5 | 3 | 48 | 6.7 | 38.2 | 140 | 69 | 50 | −12 | 43 | 6.7 | 18.8 |
| III-11 | III-5 | −20 | 25 | 6.8 | 18.4 | Hot air treatment | | | | | 6.8 | 18.1 |
| III-12 | III-6 | −20 | 25 | 6.7 | 19.6 | (none) | | | | | 6.7 | 19.6 |
| III-13 | III-7 | JSG | | 6.9 | 17.2 | Hot air treatment | | | | | 6.9 | 16.9 |
| III-14 | III-8 | JSG | | 6.8 | 18.2 | (none) | | | | | 6.8 | 18.2 |

(1): Cumulative value of number-average distribution of 4 μm or smaller particles
JSG: Jet stream grinding

TABLE 16(A)

| | Toner base particles | | | | | | | | |
|---|---|---|---|---|---|---|---|---|---|
| Toner Base Particles: | Average circularity of ≧3 μm-≦400 μm particles | Percentage of ≧0.6 μm-<3 μm particles (no. %) | Number cumulative value of <0.960 circularity toner base particles (no. %) | Methanol concentration at transmittance of: 80% (A) (vol. %) | 50% (B) (vol. %) | (B) − (A) (vol. %) | Average surface roughness (nm) | Max-imum vert. dif. (nm)* | Surface area ($\mu m^2$) |
| III-1 | 0.947 | 14.0 | 45 | 52 | 50 | 2 | 17.3 | 163 | 1.19 |
| III-2 | 0.951 | 3.5 | 38 | 51 | 54 | 3 | 15.7 | 152 | 1.06 |
| III-3 | 0.942 | 6.5 | 64 | 48 | 54 | 6 | 25.1 | 198 | 1.20 |
| III-4 | 0.937 | 14.8 | 67 | 43 | 51 | 8 | 27.5 | 192 | 1.26 |
| III-5 | 0.965 | 16.8 | 25 | 61 | 72 | 11 | 11.5 | 103 | 1.12 |
| III-6 | 0.935 | 18.6 | 64 | 40 | 50 | 10 | 28.0 | 212 | 1.37 |
| III-7 | 0.936 | 19.2 | 64 | 38 | 49 | 11 | 29.3 | 252 | 1.35 |
| III-8 | 0.968 | 20.4 | 18 | 60 | 78 | 18 | 9.8 | 48 | 1.04 |
| III-9 | 0.969 | 21.2 | 17 | 61 | 76 | 15 | 8.3 | 40 | 1.03 |
| III-10 | 0.934 | 20.3 | 71 | 33 | 46 | 13 | 31.2 | 260 | 1.38 |
| III-11 | 0.975 | 26.5 | 14 | 65 | 85 | 20 | 4.1 | 35 | 1.02 |
| III-12 | 0.930 | 31.2 | 71 | 30 | 55 | 25 | 42.1 | 311 | 1.41 |
| III-13 | 0.978 | 35.0 | 12 | 60 | 77 | 17 | 3.1 | 27 | 1.03 |
| III-14 | 0.914 | 49.6 | 79 | 42 | 66 | 24 | 69.4 | 404 | 1.48 |

*Maximum vert. dif. means Maximum vertical difference.

TABLE 16(B)

| | Main-peak molecular weight | Sub-peak or shoulder molecular weight | Main-peak component content (wt. %) | Sub-peak or shoulder component content (wt. %) |
|---|---|---|---|---|
| Toner III-1 | 15,000 | 2,200,000 | 74.1 | 25.9 |
| Toner III-2 | 15,000 | 2,200,000 | 74.3 | 25.7 |

TABLE 16(B)-continued

| | Main-peak molecular weight | Sub-peak or shoulder molecular weight | Main-peak component content (wt. %) | Sub-peak or shoulder component content (wt. %) |
|---|---|---|---|---|
| Toner III-3 | 15,000 | 2,200,000 | 73.9 | 26.1 |
| Toner III-4 | 15,000 | 2,200,000 | 74.0 | 26.0 |
| Toner III-5 | 15,000 | 2,200,000 | 73.8 | 26.2 |
| Toner III-6 | 28,000 | 2,100,000 | 69.1 | 30.9 |
| Toner III-7 | 28,000 | 2,100,000 | 70.3 | 29.7 |
| Toner III-8 | 28,000 | 1,900,000 | 64.1 | 35.9 |
| Toner III-9 | 24,000 | 1,800,000 | 70.3 | 29.7 |
| Toner III-10 | 35,000 | 2,100,000 | 78.8 | 21.2 |
| Toner III-11 | 35,000 | 2,300,000 | 80.5 | 19.5 |
| Toner III-12 | 33,000 | 44,000 | 49.8 | 50.2 |
| Toner III-13 | 3,500 | 2,100,000 | 65.5 | 34.5 |
| Toner III-14 | 15,000 | 1,000,000 | 88.0 | 12.0 |

Examples III-1 to III-9 & Comparative Examples III-1 to III-5

Next, using Toners III-1 to III-14 thus prepared, evaluation was made in the following way. Results of evaluation are shown in Table 17.

Using a laser beam printer LASER JET 4300n, manufactured by Hewlett-Packard Co., the following evaluation was made.

(1) Toner Consumption:

Evaluated according to evaluation criteria in Example I-1.

(2) Fixing Test:

In regard to low-temperature fixing performance, a fixing unit of the above evaluation machine was taken out and was so altered that evaluation was able at a process speed 1.1 times the usual speed. In its heat fixing assembly, the temperature of the heater was controlled at intervals of 5° C. in the temperature range of from 150° C. to 240° C. After the temperature of the fixing roller surface came constant, recording mediums on which unfixed toner images were formed were each inserted to the fixing nip, and the fixed images obtained were back and forth rubbed five times with Silbon paper under application of a load of 4.9 kPa. The fixing temperature at which the rate of decrease in image density before and after the rubbing came to 10% or less was regarded as a measure of low-temperature fixing performance. The lower this temperature is, the better low-temperature fixing performance the toner has. As the unfixed images, unfixed solid black images formed on plain paper (75 g/m$^2$ in basis weight) in a toner development level set to 0.6 mg/cm$^2$ were fixed.

In regard to anti-offset properties, like the above fixing conditions, recording mediums on which unfixed toner images were formed were each inserted to the fixing nip in the state the fixing roller surface was sufficiently heated, to make evaluation. An image the upper half of which has a 100 μm wide horizontal line pattern (100 μm in width and 100 μm in interval) and solid black and the lower half of which is white was printed, and the maximum temperature at which any stain appear on the white image was checked. Copying machine plane paper on which the offset tends to occur (60 g/m$^2$ in basis weight) was used as test paper. To make evaluation, stains on images caused by a high-temperature offset phenomenon was visually observed, and the temperature at which stains appeared was regarded as a measure of high-temperature anti-offset properties. The higher this temperature is, the better high-temperature anti-offset properties the toner has.

(3) Transfer Efficiency:

In the normal-temperature and normal-humidity environment (23° C./60% RH) and using copying machine plain paper (A4 size, 75 g/m$^2$ in basis weight), evaluation was made at intervals of 100 sheets from the initial stage up to 500 sheets. As a method for the evaluation, the machine was stopped during the reproduction of solid images, where the quantity per unit area of the toner held on the photosensitive drum as a result of development and the quantity per unit area of the toner transferred to a transfer material were measured. Then, the quantity of the toner on the transfer material was divided by the quantity of the toner on the photosensitive drum to determine the transfer efficiency. Then, the results at intervals of 100 sheets were averaged.

(4) Blotches:

Evaluated according to evaluation criteria in Example I-1.

(5) Sleeve Negative Ghost:

Evaluated according to evaluation criteria in Example I-1.

(6) Spots Around Line Images:

Evaluated according to evaluation criteria in Example I-1.

(7) Image Density, Fog:

Evaluated according to evaluation criteria in Example I-1.

TABLE 17

| | | Normal-temp./normal-humidity environment | | | | Low-temp./low-humid. environment | | | | | | High-temp./ high-humidity environment | |
|---|---|---|---|---|---|---|---|---|---|---|---|---|---|
| | | | | | | | | | Image density | | | Image density | |
| | Toner | Toner consumption (mg/sh.) | Low = temp. fixing (° C.) | High = temp. anti-offset (° C.) | Transfer efficiency (%) | (1) | (2) | (3) | Initial stage | On 18,000 sheets | Fog on 18,000 sheets | Initial stage | On 18,000 sheets |
| Example: | | | | | | | | | | | | | |
| III-1 | III-1 | 40 | 140 | 250 | 95.3 | A | A | A | 1.49 | 1.47 | 0.3 | 1.50 | 1.47 |
| III-2 | III-2 | 41 | 140 | 250 | 93.1 | A | A | A | 1.47 | 1.43 | 0.5 | 1.48 | 1.44 |
| III-3 | III-3 | 42 | 140 | 250 | 92.8 | A | A | A | 1.45 | 1.40 | 0.8 | 1.47 | 1.42 |
| III-4 | III-4 | 46 | 140 | 250 | 92.6 | A | B | B | 1.42 | 1.37 | 1.2 | 1.42 | 1.39 |
| III-5 | III-5 | 43 | 140 | 250 | 91.7 | A | A | A | 1.43 | 1.36 | 1.2 | 1.44 | 1.36 |
| III-6 | III-6 | 44 | 145 | 250 | 88.7 | B | B | C | 1.39 | 1.31 | 1.6 | 1.40 | 1.33 |
| III-7 | III-7 | 47 | 145 | 250 | 89.5 | B | C | C | 1.38 | 1.29 | 1.7 | 1.36 | 1.29 |
| III-8 | III-8 | 50 | 145 | 245 | 86.0 | C | C | B | 1.32 | 1.22 | 2.3 | 1.25 | 1.18 |
| III-9 | III-9 | 48 | 140 | 245 | 85.6 | C | C | C | 1.30 | 1.21 | 2.6 | 1.21 | 1.17 |
| Comparative Example: | | | | | | | | | | | | | |
| III-1 | III-10 | 51 | 150 | 250 | 85.9 | B | C | D | 1.26 | 1.20 | 2.5 | 1.26 | 1.19 |
| III-2 | III-11 | 51 | 150 | 250 | 83.3 | D | D | C | 1.27 | 1.21 | 2.6 | 1.19 | 1.10 |
| III-3 | III-12 | 53 | 150 | 230 | 82.6 | C | D | D | 1.11 | 1.04 | 2.9 | 1.20 | 1.09 |
| III-4 | III-13 | 54 | 135 | 250 | 81.5 | D | D | C | 1.12 | 1.00 | 2.6 | 1.11 | 1.04 |
| III-5 | III-14 | 56 | 140 | 255 | 80.3 | C | D | D | 1.07 | 0.98 | 3.5 | 1.06 | 0.96 |

(1): Blotch;
(2): Sleeve negative ghost;
(3): Spots around line images

Examples IV-1 to IV-8 & Comparative Examples IV-1 to IV-4

Binder resins used in Examples and Comparative Examples are shown in Table 18, magnetic materials in Table 19, and waxes in Table 20.

TABLE 18

| | Composition | Tg (° C.) | Peak molecular weight | Number = average molecular weight Mn | Weight = average molecular weight Mw |
|---|---|---|---|---|---|
| Binder Resin IV-1 | Styrene-butyl acrylate-acrylic acid copolymer (weight ratio: 77/22/1) | 61.8 | 13,600 | 8,300 | 73,000 |
| Binder Resin 1V-2 | Styrene-butyl acrylate-monobutyl maleate copolymer (weight ratio: 69/21/10) | 60.1 | 17,600 | 7,700 | 320,000 |
| Binder Resin 1V-3 | Polyester resin obtained by condensation-polymerizing bisphenol-A propylene oxide adduct (2 mol added), bisphenol-A ethylene oxide adduct (2 mol added), terephthalic acid and trimellitic anhydride (mol ratio: 32/13/39/16) | 57.6 | 6,800 | 4,700 | 560,000 |

TABLE 19

| Magnetic Material: | Composition | Si content (wt. %) | Number = average particle diameter (μm) | BET specific surface area | Coercive force Hc (kA/m) | Saturation magnetization σs ($Am^2/kg$) | Residual magnetization σr ($Am^2/kg$) |
|---|---|---|---|---|---|---|---|
| IV-1 | Magnetic iron oxide | 1.1 | 0.19 | 8.9 | 5.6 | 83.8 | 5.4 |
| IV-2 | Magnetic iron oxide | 0.0 | 0.21 | 11.2 | 7.2 | 88.5 | 9.3 |

TABLE 20

| | Type | Melting point (° C.) | Number-average molecular weight | Weight-average molecular weight |
|---|---|---|---|---|
| Wax IV-1 | Paraffin | 75 | 370 | 490 |
| Wax IV-2 | Paraffin | 64 | 250 | 360 |
| Wax IV-3 | Fishcer-Tropsch | 104 | 780 | 1,060 |
| Wax IV-4 | Fishcer-Tropsch | 86 | 510 | 830 |
| Wax IV-5 | Polyethylene | 121 | 2,320 | 3,510 |
| Wax IV-6 | Polypropylene | 144 | 980 | 8,690 |

Preparation of Toner IV-1

| | (by weight) |
|---|---|
| Binder Resin IV-1 | 100 parts |
| Magnetic Material IV-1 | 95 parts |
| Monoazo iron complex (T-77, available from Hodogaya Chemical Co., Ltd.) | 2 parts |
| Wax IV-1 | 5 parts |
| Wax IV-3 | 2 parts |

The above materials were premixed by means of Henschel mixer, and thereafter the mixture obtained was melt-kneaded by means of a twin-screw kneader heated to 110° C. The kneaded product obtained and having been cooled was crushed by means of a hammer mill to obtain a toner material crushed product. The crushed product obtained was finely pulverized by mechanical pulverization using a mechanical grinding machine Turbo Mill (manufactured by Turbo Kogyo Co., Ltd.; the surfaces of its rotor and stator were coated by plating of a chromium alloy containing chromium carbide (plating thickness: 150 μm; surface hardness: HV 1,050)], controlling air temperature under conditions shown in Table 21. The finely pulverized product thus obtained was classified by means of a multi-division classifier utilizing the Coanda effect (Elbow Jet Classifier, manufactured by Nittetsu Mining Co., Ltd.) to classify and remove fine powder and coarse powder simultaneously. As to the material toner base particles thus obtained, the weight-average particle diameter (D4) measured by the Coulter Counter method was 6.6 μm, and the cumulative value of number-average distribution of toner base particles of less than 4 μm in diameter was 25.4%.

The material toner base particles were put to the surface modifying-apparatus shown in FIG. 1, to carry out surface modification and removal of fine powder. In that treatment, in this Example, sixteen (16) rectangular disks were provided at the upper part of the dispersing rotor, the space (gap) between the guide ring and the rectangular disks on the dispersing rotor was set to 60 mm, and the space (gap) between the dispersing rotor and the liners to 4 mm. Also, the rotational peripheral speed of the dispersing rotor was set to 138 m/sec, and the blower air feed rate to 30 $m^3$/min. The feed rate of the finely pulverized product was set to 300 kg/hr, and the cycle time to 47 sec. The temperature of the refrigerant let to run through the jacket was set to −15° C., and the cold-air temperature T1 to −20° C. Still also, the number of revolutions of the dispersing rotor was so controlled that the percentage of particles of from 0.6 μm or more to less than 3 μm in diameter came to the desired value. Through the foregoing steps, Toner Base Particles IV-1 were obtained, whose weight-average particle diameter (D4) measured by the Coulter Counter method was 6.8 μm and the cumulative value of number-average distribution of toner base particles of less than 4 μm in diameter was 18.0%. As to Toner Base Particles IV-1, the physical properties measured with FPIA-2100, the values of methanol concentrations with respect to transmittance of 780 nm wavelength light and the values measured with a scanning probe microscope are shown in Table 22.

100 parts by weight of this toner base particles and 1.2 parts by weight of hydrophobic fine silica powder having been treated with hexamethyldisilazane and then with dimethylsilicone oil were mixed by means of Henschel mixer to prepare negatively chargeable Toner IV-1 (toner particles). As to negatively chargeable Toner IV-1, the average circularity of the toner particles having a circle-equivalent diameter of from 3 μm or more to 400 μm or less as measured with FPIA-2100 was 0.948, and the average surface roughness measured with a scanning probe microscope was 18.5 nm.

Preparation of Toners IV-2 to IV-8

Toner Base Particles IV-2 to IV-8 and Toners IV-2 to IV-8 were obtained in the same manner as Toner IV-1 except that the binder resin, magnetic material-and wax used were as shown in Table 21, further the fine grinding conditions of Turbo Mill were changed as shown in Table 21, the classification conditions in the multi-division classifier were changed, and further the conditions of the surface modifying apparatus were set as shown in Table 21. As to Toner Base Particles IV-2 to IV-8, the physical properties measured with FPIA-2100, the values of methanol concentrations with respect to transmittance of 780 nm wavelength light and the values measured with a scanning probe microscope are shown in Table 22.

Preparation of Toner IV-9

Toner Base Particle IV-9 and Toner IV-9 were obtained in the same manner as Toner IV-1 except that the binder resin, magnetic material and wax used were as shown in Table 21, further the fine grinding conditions of Turbo Mill were changed as shown in Table 21, the classification conditions in the multi-division classifier were changed, and the toner base particles obtained were treated by making them pass through hot air of 300° C. instantaneously. As to Toner Base Particle IV-9, the physical properties measured with FPIA-2100, the values of methanol concentrations with respect to transmittance of 780 nm wavelength light and the values measured with a scanning probe microscope are shown in Table 22.

As to Toner IV-9, the average circularity of the toner particles having a circle-equivalent diameter. of from 3 μm or more to 400 μm or less as measured with FPIA-2100 was 0.974, and the-average surface roughness measured with a scanning probe microscope was 4.1 nm.

Preparation of Toner IV-10

Toner Base Particle IV-10 and Toner IV-10 were obtained in the same manner as Toner IV-1 except that the binder resin, magnetic material and wax used were as shown in Table 21, further the fine grinding conditions of Turbo Mill were changed as shown in Table 21, the classification conditions in the multi-division classifier were changed, and further the surface modification using the surface modifying apparatus was not carried out. As to Toner Base Particle IV-10, the physical properties measured with FPIA-2100, the values of methanol concentrations with respect to transmittance of 780 nm wavelength light and the values measured with a scanning probe microscope are shown in Table 22.

Preparation of Toner IV-11

Toner Base Particle IV-11 and Toner IV-11 were obtained in the same manner as Toner IV-1 except that the binder resin, magnetic material and wax used were as shown in Table 21, a jet stream grinding machine was used in place of the mechanical grinding machine, further the classification conditions in the multi-division classifier were changed, and the toner base particles obtained were treated by making them pass through hot air of 300° C. instantaneously. As to Toner Base Particle IV-11, the physical properties measured with FPIA-2100, the values of methanol concentrations with respect to transmittance of 780 nm wavelength light and the values measured with a scanning probe microscope are shown in Table 22.

Preparation of Toner IV-12

Toner Base Particle IV-12 and Toner IV-12 were obtained in the same manner as Toner IV-1 except that the binder resin, magnetic material and wax used were as shown in Table 21, a jet stream grinding machine was used in place of the mechanical grinding machine, the classification conditions in the multi-division classifier were changed, and further the surface modification using the surface modifying apparatus was not carried out. As to Toner Base Particle IV-12, the physical properties measured with FPIA-2100, the values of methanol concentrations with respect to transmittance of 780 nm wavelength light and the values measured with a scanning probe microscope are shown in Tables 22(A) and 22(B).

TABLE 21

| | | | | | | | surface modif., toner base particles | | Surface modifiying apparatus | | | | | surface modif., toner base particles | |
|---|---|---|---|---|---|---|---|---|---|---|---|---|---|---|---|
| | | | | | | | particle size distribution | | Peripheral speed | | | | Classifying rotor | particle size distribution | |
| | Binder resin (pbw) | Magnetic material (pbw) | Wax(es) (pbw) | | Mechanical grinding machine air temp. T1 (° C.) | T2 (° C.) | Wt. av. particle diam. (μm) | (1) (%) | Dispersing rotor (m/sec) | Classifying rotor (m/sec) | Cycle time (sec) | Cold air temp. T1 (° C.) | T2 (° C.) | Wt. av. particle diam. (μm) | (1) (%) |
| Toner Base Particles | | | | | | | | | | | | | | | |
| IV-1 | IV-1 (100) | IV-1 (95) | IV-1 (5) | IV-3 (2) | 0 | 45 | 6.6 | 25.4 | 138 | 82 | 47 | −20 | 31 | 6.8 | 18.0 |
| IV-2 | IV-1 (100) | IV-1 (95) | IV-1 (5) | IV-3 (2) | 0 | 45 | 6.6 | 26.2 | 138 | 91 | 67 | −20 | 36 | 6.7 | 19.7 |
| IV-3 | IV-1 (100) | IV-1 (95) | IV-1 (5) | IV-5 (2) | 0 | 45 | 6.7 | 23.1 | 138 | 88 | 32 | −20 | 27 | 6.8 | 17.6 |
| IV-4 | IV-1 (100) | IV-1 (95) | IV-4 (3) | IV-3 (4) | 0 | 45 | 6.6 | 25.3 | 143 | 86 | 47 | −15 | 36 | 6.8 | 18.2 |
| IV-5 | IV-1 (100) | IV-1 (95) | IV-4 (2) | IV-6 (4) | 0 | 45 | 6.7 | 28.1 | 132 | 75 | 52 | −15 | 30 | 6.8 | 17.3 |
| IV-6 | IV-1 (100) | IV-1 (95) | IV-2 (4) | IV-4 (3) | 3 | 48 | 6.5 | 31.0 | 146 | 75 | 52 | −15 | 41 | 6.7 | 17.8 |
| IV-7 | IV-2 (100) | IV-1 (95) | IV-2 (6) | IV-5 (4) | 3 | 48 | 6.6 | 34.6 | 148 | 68 | 52 | −12 | 47 | 6.8 | 18.1 |
| IV-8 | IV-3 (100) | IV-2 (95) | IV-6 (6) | | 3 | 48 | 6.5 | 38.2 | 148 | 68 | 57 | −12 | 48 | 6.7 | 19.5 |
| IV-9 | IV-1 (100) | IV-1 (95) | IV-2 (2) | IV-5 (5) | −20 | 25 | 6.8 | 18.3 | Hot air treatment | | | | | 6.8 | 18.2 |
| IV-10 | IV-1 (100) | IV-1 (95) | IV-2 (2) | IV-5 (5) | −20 | 25 | 6.8 | 19.1 | (none) | | | | | 6.8 | 19.5 |
| IV-11 | IV-1 (100) | IV-2 (95) | IV-5 (7) | | JSG | | 6.9 | 16.8 | Hot air treatment | | | | | 6.9 | 16.8 |
| IV-12 | IV-1 (100) | IV-2 (95) | IV-5 (7) | | JSG | | 6.8 | 18.1 | (none) | | | | | 6.8 | 18.1 |

(1): Cumulative value of number-average distribution of 4 μm or smaller particles JSG: Jet stream grinding

TABLE 22(A)

| Toner Base Particles: | Toner base particles: Average circularity of ≧3 μm-≦400 μm particles | Percentage of ≧0.6 μm-<3 μm particles (no. %) | Number cumulative value of <0.960 circularity toner base particles (no. %) | Methanol concentration at transmittance of: 80% (A) (vol. %) | 50% (B) (vol. %) | (B) − (A) (vol. %) | Average surface roughness (nm) | Maximum vert. dif. (nm) | Surface area (μm²) |
|---|---|---|---|---|---|---|---|---|---|
| IV-1 | 0.948 | 14.5 | 47 | 51 | 53 | 2 | 14.9 | 133 | 1.21 |
| IV-2 | 0.952 | 3.6 | 38 | 53 | 56 | 3 | 12.3 | 109 | 1.17 |
| IV-3 | 0.940 | 6.4 | 64 | 47 | 50 | 3 | 20.2 | 129 | 1.25 |
| IV-4 | 0.953 | 10.6 | 32 | 60 | 64 | 4 | 11.1 | 107 | 1.16 |
| IV-5 | 0.938 | 13.8 | 64 | 41 | 46 | 5 | 23.3 | 188 | 1.28 |
| IV-6 | 0.958 | 15.6 | 26 | 62 | 69 | 7 | 8.6 | 89 | 1.05 |
| IV-7 | 0.964 | 19.2 | 21 | 63 | 72 | 9 | 7.5 | 70 | 1.03 |
| IV-8 | 0.968 | 23.0 | 17 | 61 | 78 | 17 | 5.3 | 48 | 1.01 |
| IV-9 | 0.974 | 27.8 | 14 | 63 | 83 | 20 | 4.0 | 38 | 1.01 |
| IV-10 | 0.927 | 31.3 | 75 | 31 | 54 | 23 | 44.8 | 372 | 1.53 |
| IV-11 | 0.978 | 37.6 | 10 | 58 | 75 | 17 | 3.4 | 30 | 1.01 |
| IV-12 | 0.910 | 50.9 | 80 | 44 | 69 | 25 | 64.7 | 495 | 1.72 |

*Maximum vert. dif. means Maximum vertical difference.

TABLE 22(B)

| | Toner: Start-point onset temperature (° C.) | End-point onset temperature (° C.) | Difference between start- and end-point onset temperatures (° C.) | Peak top temperature (° C.) |
|---|---|---|---|---|
| Toner IV-1 | 67 | 115 | 48 | 81 |
| Toner IV-2 | 67 | 115 | 48 | 81 |
| Toner IV-3 | 65 | 128 | 63 | 121 |
| Toner IV-4 | 79 | 116 | 37 | 106 |
| Toner IV-5 | 80 | 148 | 68 | 128 |
| Toner IV-6 | 58 | 91 | 33 | 68 |
| Toner IV-7 | 52 | 131 | 79 | 64 |
| Toner IV-8 | 130 | 152 | 22 | 145 |
| Toner IV-9 | 55 | 138 | 83 | 131 |
| Toner IV-10 | 55 | 138 | 83 | 131 |
| Toner IV-11 | 126 | 141 | 15 | 131 |
| Toner IV-12 | 126 | 141 | 15 | 131 |

Next, using Toners IV-1 to IV-12 thus prepared, evaluation was made in the following way. Results of evaluation are shown in Table 23.

Using a laser beam printer LASER JET 4300n, manufactured by Hewlett-Packard Co., the following evaluation was made.

(1) Image Density, Fog:

Evaluated according to evaluation criteria in Example I-1.

(2) Toner Consumption:

Evaluated according to evaluation criteria in Example I-1.

(3) Sleeve Negative Ghost:

Evaluated according to evaluation criteria in Example I-1.

(4) Spots Around Line Images:

Evaluated according to evaluation criteria in Example I-1.

(5) Blotches:

Evaluated according to evaluation criteria in Example I-1.

(6) Image Defects Caused by Faulty Cleaning:

In the running test in the normal-temperature and normal-humidity environment, printed images during image reproduction were visually observed to make evaluation.

A: No image defects appear at all.

B: Minute stains appear, but no problem in practical use.

C: Dotlike or linear stains appear, and appearance and disappearance are repeated.

D: Stains appear, and do not disappear.

(7) Low-Temperature Fixing Performance, High-Temperature Anti-Offset Properties:

The toner was put into a process cartridge, and LASER JET 4300n, manufactured by Hewlett-Packard Co., was used. Further, this was so altered that the surface temperature of the heating roller of its heat-and-pressure roller fixing assembly was changeable from 120° C. to 250° C. on the outside. Changing preset temperature at intervals of 5° C., an image sample was printed in the low-temperature and low-humidity environment (15° C./10% RH). Here, when the low-temperature fixing test was conducted, the process speed of LASER JET 4300n was set to a 1.2 time speed so as to be under severer conditions for low-temperature fixing, to make evaluation.

Low-temperature Fixing Performance:

Fixed images were rubbed with soft thin paper under application of a load of 4.9 kPa. The lowest temperature at which the rate of decrease in image density before and after the rubbing was 10% or less was regarded as lowest fixing temperature to make evaluation. Copying machine plane paper on which the fixing is severe (90 g/m$^2$ in basis weight) was used as test paper.

High-temperature Anti-offset Properties:

A sample image with an image area percentage of about 5% was printed, and evaluation was made according to the extent of stains on images. The maximum temperature at which no stains appear on images was checked. Here, copying machine plane paper on which the offset tends to occur (60 g/m$^2$ in basis weight) was used as test paper.

TABLE 23

| | | Low-temp./low-humidty environment | | | | High-temperature/ high-humidity environment | | Normal-temperature/ normal-humidity environment | | | | | |
|---|---|---|---|---|---|---|---|---|---|---|---|---|---|
| | Toner | Image density after 18,000 sheet running | Fog after 18,000 sheet running | (1) | (2) | Image density on 1st-in = morning 9,000 sheets | Image density after 18,000 sheet running | Image density after 18,000 sheet running | Toner consumption (mg/sh.) | (3) | (4) | Low = temp. fixing (° C.) | High = temp. anti-offset (° C.) |
| Example: | | | | | | | | | | | | | |
| IV-1 | IV-1 | 1.41 | 1.4 | A | A | 1.36 | 1.39 | 1.40 | 41 | A | A | 145 | 245 |
| IV-2 | IV-2 | 1.40 | 1.3 | A | A | 1.34 | 1.37 | 1.39 | 41 | A | A | 145 | 245 |
| IV-3 | IV-3 | 1.39 | 1.8 | A | A | 1.33 | 1.37 | 1.37 | 42 | B | A | 145 | 245 |
| IV-4 | IV-4 | 1.39 | 1.9 | A | A | 1.32 | 1.35 | 1.36 | 44 | A | A | 150 | 245 |
| IV-5 | IV-5 | 1.39 | 2.2 | A | A | 1.33 | 1.35 | 1.37 | 46 | B | A | 150 | 245 |
| IV-6 | IV-6 | 1.37 | 2.2 | B | A | 1.30 | 1.32 | 1.34 | 44 | A | B | 140 | 235 |
| IV-7 | IV-7 | 1.35 | 2.3 | B | B | 1.29 | 1.31 | 1.33 | 44 | A | B | 140 | 240 |
| IV-8 | IV-8 | 1.33 | 2.5 | B | B | 1.26 | 1.30 | 1.31 | 46 | B | B | 155 | 245 |
| Comparative Example: | | | | | | | | | | | | | |
| IV-1 | IV-9 | 1.22 | 3.5 | C | D | 1.11 | 1.17 | 1.19 | 50 | C | D | 155 | 235 |
| IV-2 | IV-10 | 1.19 | 3.6 | C | C | 1.09 | 1.16 | 1.17 | 51 | D | D | 155 | 235 |
| IV-3 | IV-11 | 1.16 | 3.8 | D | D | 1.06 | 1.13 | 1.15 | 52 | C | D | 160 | 235 |
| IV-4 | IV-12 | 1.15 | 3.9 | D | C | 1.05 | 1.10 | 1.13 | 54 | D | D | 160 | 235 |

(1): Sleeve negative ghost;
(2): Blotch;
(3): Spots around line images;
(4) Image stain This application claims priority from Japanese Patent Nos. 2003-205313 filed Aug. 1, 2003, 2003-205314 filed Aug. 1, 2003, 2003-205271 filed Aug. 1, 2003, 2003-205272 filed Aug. 1, 2003, and 2004-151772 filed on May 21, 2004, which are hereby incorporated by reference herein.

What is claimed is:

1. A magnetic toner comprising toner particles which comprise toner base particles containing at least a binder resin and a magnetic material, and inorganic fine particles, wherein:

the toner base particles have been obtained through a pulverization step;

wherein, in wettability of the toner base particles to a methanol/water mixed solvent, the methanol concentration at the time the transmittance of light of 780 nm in wavelength is 80% and the methanol concentration at the time the transmittance thereof is 50% are from 35% by volume to 75% by volume;

the toner base particles having a circle-equivalent diameter of from 3 μm or more to 400 μm or less as measured with a flow type particle image analyzer have an average circularity of from 0.935 or more to less than 0.970; and the toner base particles have an average surface roughness of from 5.0 nm or more to less than 35.0 nm as measured with a scanning probe microscope; and the magnetic material is used in an amount of from 20 parts by weight or more to 200 parts by weight or less based on 100 parts by weight of the binder resin.

2. The magnetic toner according to claim 1, wherein, in number-base particle size distribution of toner base particles having a circle-equivalent diameter of from 0.6 μm or more to 400 μm or less as measured with the flow type particle image analyzer, toner base particles of from 0.6 μm or more to less than 3 μm in diameter are in a percentage of from 0% by number or more to less than 20% by number.

3. The magnetic toner according to claim 1, wherein toner base particles having a circularity of less than 0.960 is in a number cumulative value of from 20% by number or more to less than 70% by number.

4. The magnetic toner according to claim 1, wherein the toner base particles have a maximum vertical difference of from 50 nm or more to less than 250 nm as measured with a scanning probe microscope.

5. The magnetic toner according to claim 1, wherein the toner base particles have a surface area of from 1.03 μm$^2$ or more to less than 1.33 μm$^2$ as surface area of an area of 1 μm square of the particle surface as measured with a scanning probe microscope.

* * * * *